US009093046B2

(12) United States Patent
Kitagawa et al.

(10) Patent No.: US 9,093,046 B2
(45) Date of Patent: Jul. 28, 2015

(54) SIGNAL PROCESSING DEVICE, LIQUID CRYSTAL APPARATUS, ELECTRONIC EQUIPMENT, AND SIGNAL PROCESSING METHOD

(71) Applicant: Seiko Epson Corporation, Tokyo (JP)

(72) Inventors: Taku Kitagawa, Shiojiri (JP); Hiroyuki Hosaka, Matsumoto (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 13/793,713

(22) Filed: Mar. 11, 2013

(65) Prior Publication Data

US 2013/0241914 A1 Sep. 19, 2013

(30) Foreign Application Priority Data

Mar. 15, 2012 (JP) ..... 2012-058983

(51) Int. Cl.
*G09G 3/36* (2006.01)

(52) U.S. Cl.
CPC ..... *G09G 3/3696* (2013.01); *G09G 3/3648* (2013.01); *G09G 2320/0209* (2013.01); *G09G 2340/16* (2013.01); *G09G 2360/16* (2013.01)

(58) Field of Classification Search
CPC ... H04N 5/14; G09G 3/3648; G09G 2340/00; G09G 2320/0271; G09G 2320/0209
See application file for complete search history.

(56) References Cited

U.S. PATENT DOCUMENTS

| | | | | |
|---|---|---|---|---|
| 8,466,866 | B2 * | 6/2013 | Iisaka et al. | 345/89 |
| 2008/0018630 | A1 | 1/2008 | Fujino | |
| 2011/0051006 | A1 | 3/2011 | Iisaka et al. | |
| 2011/0051007 | A1 | 3/2011 | Hosaka et al. | |
| 2011/0109815 | A1 | 5/2011 | Hosaka et al. | |
| 2011/0176071 | A1 | 7/2011 | Iisaka et al. | |
| 2011/0181795 | A1 | 7/2011 | Hosaka et al. | |
| 2011/0205207 | A1 | 8/2011 | Hosaka et al. | |
| 2011/0205208 | A1 | 8/2011 | Iisaka et al. | |
| 2011/0205439 | A1 | 8/2011 | Iisaka et al. | |
| 2011/0205440 | A1 | 8/2011 | Hosaka et al. | |
| 2011/0205452 | A1 | 8/2011 | Hosaka et al. | |
| 2011/0205479 | A1 | 8/2011 | Hosaka et al. | |
| 2012/0147272 | A1 | 6/2012 | Hosaka et al. | |

FOREIGN PATENT DOCUMENTS

| | | | |
|---|---|---|---|
| JP | 2008-046613 | A | 2/2008 |
| JP | 2008-281947 | A | 11/2008 |
| JP | 2011-053390 | A | 3/2011 |
| JP | 2011-053417 | A | 3/2011 |
| JP | 2011-150223 | A | 5/2011 |
| JP | 2011-107174 | A | 6/2011 |
| JP | 2011-107497 | A | 6/2011 |

(Continued)

*Primary Examiner* — Abbas Abdulselam
(74) *Attorney, Agent, or Firm* — ALG Intellectual Property, LLC

(57) ABSTRACT

A signal processing device which is used in a liquid crystal apparatus, includes a detection portion that detects a boundary between a first pixel to which a first voltage lower than a first reference voltage is applied and a second pixel to which a second voltage higher than a second reference voltage is applied on the basis of signals for controlling voltages applied to a plurality of pixels, and a correction portion that corrects the first voltage correlated with the first pixel to a third voltage which is higher than the first voltage and lower than the second voltage correlated with the second pixel.

19 Claims, 32 Drawing Sheets

(56) References Cited

FOREIGN PATENT DOCUMENTS

| | | | |
|---|---|---|---|
| JP | 2011-145501 | A | 7/2011 |
| JP | 2011-170235 | A | 9/2011 |
| JP | 2011-170236 | A | 9/2011 |
| JP | 2011-175136 | A | 9/2011 |
| JP | 2011-175137 | A | 9/2011 |
| JP | 2011-175199 | A | 9/2011 |
| JP | 2011-175200 | A | 9/2011 |
| JP | 2012-113226 | A | 6/2012 |
| JP | 2012-127991 | A | 7/2012 |
| JP | 2012-155212 | A | 8/2012 |
| JP | 2012-168229 | A | 9/2012 |
| JP | 2012-242797 | A | 12/2012 |
| JP | 2012-242798 | A | 12/2012 |
| WO | WO-2012-101990 | A | 8/2012 |

* cited by examiner

SCANNING LINE DRIVING CIRCUIT

VIDEO PROCESSING CIRCUIT

VIDEO SIGNAL (PREVIOUS FRAME)

VIDEO SIGNAL (CURRENT FRAME)

BOUNDARY COMPARISON

APPLIED BOUNDARY DETECTION

CORRECTION PROCESS

CORRECTION PROCESS (THREE PIXELS)

CORRECTION PROCESS (ONE PIXEL)

CORRECTION PROCESS (THREE PIXELS)

CORRECTION PROCESS (ONE PIXEL)

CORRECTION PROCESS (THREE PIXELS)

RISK BOUNDARY DETECTION ($\theta b = 45$ DEGREES)

RISK BOUNDARY + APPLIED BOUNDARY DETECTION

CORRECTION PROCESS ($\theta b = 45$ DEGREES)

RISK BOUNDARY DETECTION ($\theta b = 225$ DEGREES)

RISK BOUNDARY DETECTION ($\theta b = 90$ DEGREES)

CORRECTION PROCESS ($\theta b = 225$ DEGREES)

CORRECTION PROCESS ($\theta b = 90$ DEGREES)

CORRECTION PROCESS ($\theta b = 45$ DEGREES)

CORRECTION PROCESS ($\theta b = 225$ DEGREES)

CORRECTION PROCESS ($\theta b = 90$ DEGREES)

N-TH FRAME (N+1)-TH FRAME
(BEFORE CORRECTION)

(N+1)-TH FRAME
(AFTER CORRECTION)

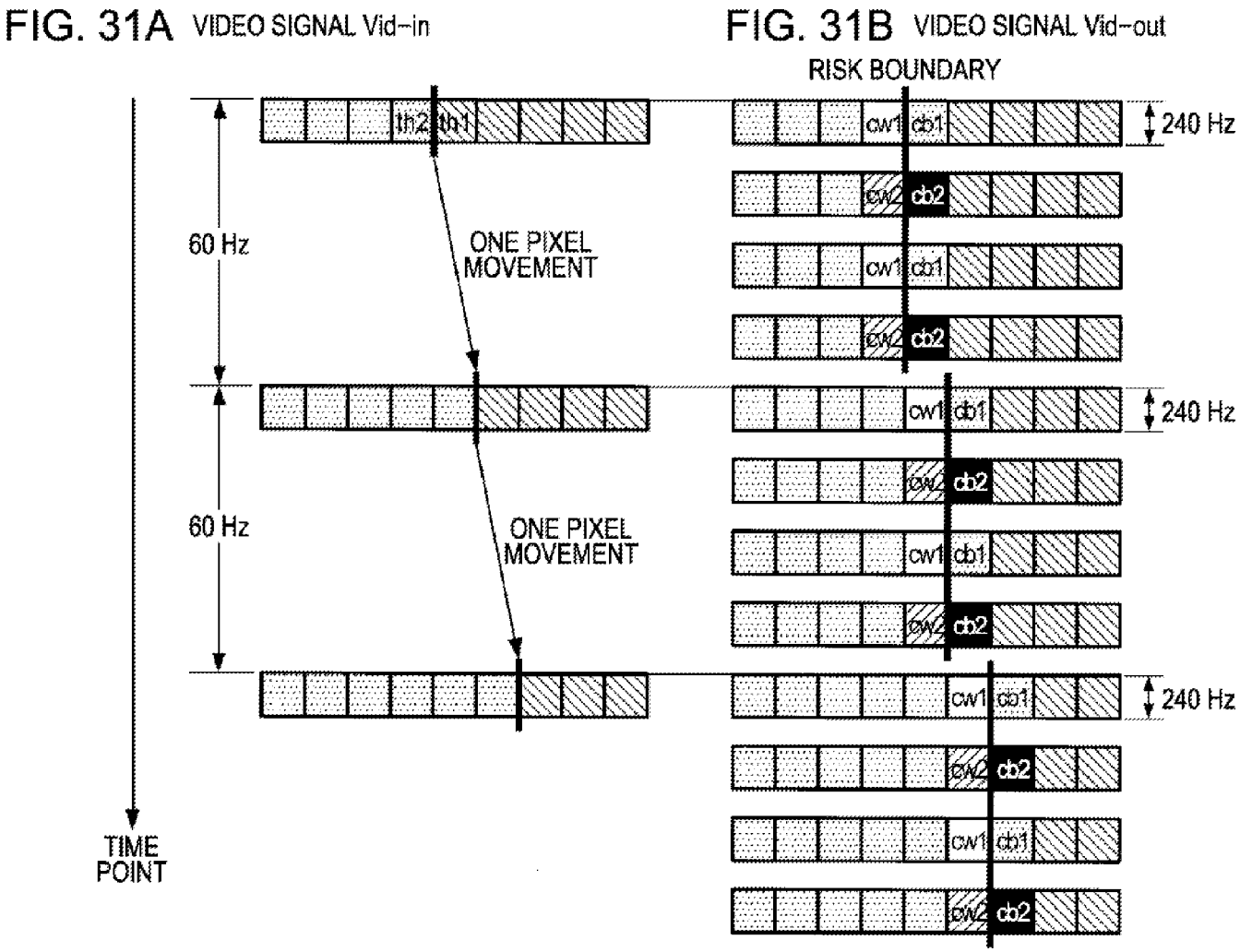
FIG. 31A VIDEO SIGNAL Vid-in
FIG. 31B VIDEO SIGNAL Vid-out
RISK BOUNDARY
240 Hz
240 Hz
240 Hz
60 Hz
60 Hz
ONE PIXEL MOVEMENT
ONE PIXEL MOVEMENT
TIME POINT
th1
th2
cb1
cb2
cw1
cw2

SIGNAL PROCESSING DEVICE, LIQUID CRYSTAL APPARATUS, ELECTRONIC EQUIPMENT, AND SIGNAL PROCESSING METHOD

BACKGROUND

1. Technical Field

The present invention relates to a technique capable of reducing display defects in a liquid crystal panel.

2. Related Art

A liquid crystal panel has a configuration in which liquid crystal is interposed between a pixel electrode provided for each pixel and a common electrode provided so as to be common to a plurality of pixels. In this liquid crystal panel, there are cases where poor liquid crystal alignment (reverse tilt domain) occurs due to a transverse electric field generated between pixels adjacent to each other, thereby causing display defects. Techniques for suppressing display defects from occurring due to the poor liquid crystal alignment are disclosed in JP-A-2008-281947 and JP-A-2008-46613. JP-A-2008-281947 and JP-A-2008-46613 disclose the techniques in which a black and white boundary of a video signal is detected using a difference between signal levels of pixels adjacent to each other (that is, a voltage difference of liquid crystal elements), and the video signal is corrected such that the video signal with the detected black and white boundary has a small difference between the signal levels.

In a method of uniformly correcting a video signal under a condition that a signal level difference between adjacent pixels is large as in the techniques disclosed in JP-A-2008-281947 and JP-A-2008-46613, there is concern in which the video signal is corrected excessively in a location where a transverse electric field is weak, thereby causing display contradiction which is likely to be perceived by a user, and, conversely, the video signal is corrected insufficiently in a location where the transverse electric field is strong, thereby causing display defects due to a reverse tilt domain. As above, a correction amount of a video signal required to reduce the reverse tilt domain is different depending on the transverse electric field generated in the pixels.

SUMMARY

An advantage of some aspects of the invention is to suppress occurrence of display defects due to a reverse tilt domain by correcting a video signal according to the strength of a transverse electric field generated in pixels.

According to an aspect of the invention, there is provided a signal processing device which is used in a liquid crystal apparatus including a plurality of pixels, the device including a detection portion that detects a boundary between a first pixel correlated with a first voltage lower than a first reference voltage and a second pixel correlated with a second voltage higher than a second reference voltage on the basis of a signal for controlling a voltage applied to each of the plurality of pixels; and a correction portion that corrects the first voltage correlated with the first pixel to a third voltage which is higher than the first voltage and lower than the second voltage correlated with the second pixel, wherein the second reference voltage is higher than the first reference voltage, and wherein the third voltage is higher when the second voltage is high than when the second voltage is low.

According to the aspect of the invention, it is possible to suppress occurrence of display defects due to a reverse tilt domain by correcting a video signal according to the strength of a transverse electric field occurring in a pixel.

In the invention, the correction portion may correct the first voltage correlated with the first pixel to the third voltage when the first voltage is lower than a third reference voltage which is lower than the first reference voltage.

According to the invention, it is possible to set the first pixel in which an alignment state of liquid crystal molecules is determined as being likely to be disarrayed, as a correction target of a video signal.

In the invention, the correction portion may make a fourth voltage lower when a difference between the first voltage and the second voltage is large than when the difference is small.

According to the invention, it is possible to correct a video signal of the first pixel to an extent necessary to reduce a reverse tilt domain according to the strength of a transverse electric field.

In the invention, the correction portion may set the third voltage and the fourth voltage to correspond to the second voltages of the two or more second pixels which are continuously located in an opposite direction to the boundary from the second pixel adjacent to the boundary.

According to the invention, it is possible to suppress occurrence of a reverse tilt domain caused by a weak transverse electric field.

In the invention, the correction portion may set the third voltage and the fourth voltage to correspond to the maximum voltage of the second voltages of the two or more second pixels.

According to the invention, it is possible to more reliably suppress occurrence of a reverse tilt domain caused by a weak transverse electric field.

In the invention, the correction portion may correct a video signal designating the second voltage of the second pixel adjacent to the detected boundary, to a video signal designating a fifth voltage which is lower than the second voltage and corresponds to the first voltage of the first pixel adjacent to the boundary.

According to the invention, it is possible to suppress occurrence of display defects due to a reverse tilt domain by correcting a video signal according to the strength of a transverse electric field occurring in a pixel while suppressing correction of a video signal per pixel.

In the invention, the correction portion may correct a video signal designating the second voltage of the second pixel adjacent to the detected boundary, to a video signal designating a fifth voltage which is lower than the second voltage and corresponds to the first voltage of the first pixel adjacent to the boundary.

According to the invention, it is possible to set the second pixel which tends to attribute to occurrence of a reverse tilt domain as a correction target of a video signal.

In the invention, the correction portion may set a fifth voltage and a sixth voltage to be lower as a difference between the first voltage of the first pixel adjacent to the boundary and the second voltage becomes larger.

According to the invention, it is possible to correct a video signal of the second pixel to an extent necessary to reduce a reverse tilt domain according to the strength of a transverse electric field.

In the invention, the correction portion may set the fifth voltage and the sixth voltage to correspond to the first voltages of the two or more first pixels which are continuously located in an opposite direction to the boundary from the first pixel adjacent to the boundary.

According to the invention, it is possible to suppress occurrence of a reverse tilt domain caused by a weak transverse electric field.

In the invention, the correction portion may set the fifth voltage and the sixth voltage to correspond to the minimum voltage of the first voltages of the two or more first pixels.

According to the invention, it is possible to more reliably suppress occurrence of a reverse tilt domain caused by a weak transverse electric field.

In the invention, the correction portion may correct a video signal designating an applied voltage to a pixel set as a correction target so as to be higher than the applied voltage in some period of display period corresponding to the video signal and so as to be lower than the applied voltage in the other period of the display period.

According to the invention, it is possible to make occurrence of a reverse tilt domain difficult by shortening time when a transverse electric field is continuously generated.

In addition, the invention is not limited to the signal processing device and is applicable to a liquid crystal apparatus, electronic equipment, and a signal processing method.

BRIEF DESCRIPTION OF THE DRAWINGS

The invention will be described with reference to the accompanying drawings, wherein like numbers reference like elements.

FIGS. 31A and 31B are diagrams illustrating a correction process in a video processing circuit according to a seventh embodiment of the invention.

DESCRIPTION OF EXEMPLARY EMBODIMENTS

Hereinafter, embodiments of the invention will be described with reference to the drawings.

First Embodiment

First, a description will be made of the first embodiment of the invention.

Figure 1:
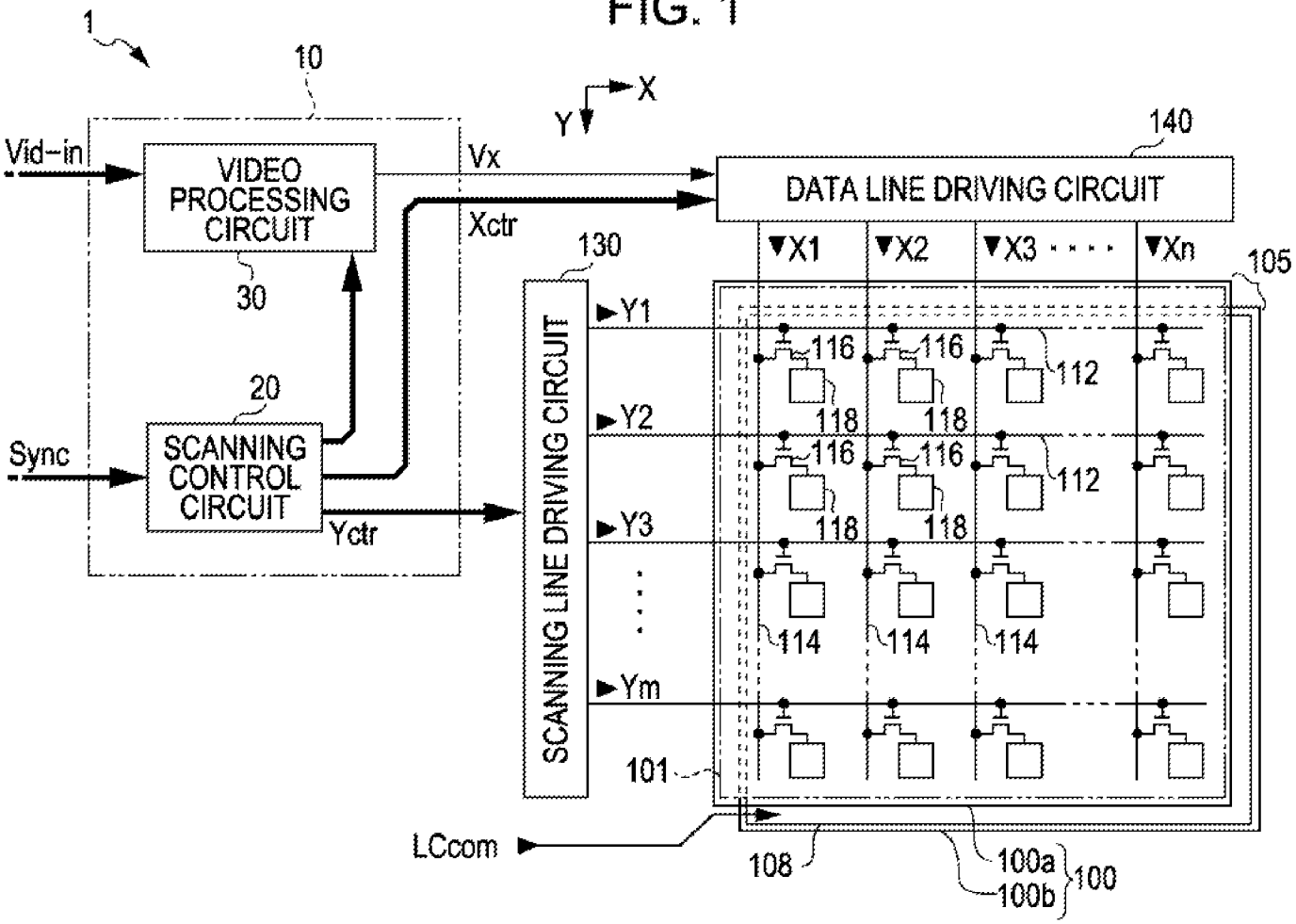
FIG. 1 is a diagram illustrating a liquid crystal display apparatus which employs a video processing circuit (signal processing device) according to a first embodiment of the invention.

FIG. 1 is a block diagram illustrating an entire configuration of a liquid crystal display apparatus 1 which employs a video processing circuit according to the present embodiment.

As shown in FIG. 1, the liquid crystal display apparatus 1 includes a control circuit 10, a liquid crystal panel 100, a scanning line driving circuit 130, and a data line driving circuit 140. A video signal Vid-in is supplied to the control circuit 10 from a high rank device in synchronization with synchronization signals Sync. The video signal Vid-in is digital data which designates a grayscale level of each pixel of the liquid crystal panel 100, and is supplied in order of scanning according to a vertical scanning signal, a horizontal scanning signal, and a dot clock signal (neither shown) included in the synchronization signals Sync.

In addition, the video signal Vid-in designates, but an applied voltage to a liquid crystal element is defined according to the grayscale level, and thus the video signal Vid-in may designate an applied voltage to the liquid crystal element.

The control circuit 10 includes a scanning control circuit 20 and a video processing circuit 30. The scanning control circuit 20 generates various control signals and controls the respective parts in synchronization with the synchronization signals Sync. The video processing circuit 30 will be described later in detail, and processes a digital video signal Vid-in which is an input video signal and outputs an analog data signal Vx.

The liquid crystal panel 100 has a configuration in which an element substrate (first substrate) 100*a* and an opposite substrate (second substrate) 100*b* are joined to each other with a specific gap, and liquid crystal 105 which is driven by an electric field in the longitudinal direction is interposed in the gap. The element substrate 100*a* is provided with a plurality of scanning lines 112 of m rows in the X (transverse) direction, and a plurality of data lines 114 of n columns in the Y (longitudinal) direction so as to be electrically insulated from the respective scanning lines 112 in an opposite surface to the opposite substrate 100*b*.

In addition, in this embodiment, in order to differentiate the scanning lines 112 from each other in FIG. 1, the scanning lines are referred to as scanning lines of first, second, third, . . . , (m−1)-th, and m-th rows in order from the top in some cases. Similarly, in order to differentiate the data lines 114 from each other, the data lines are referred to as data lines of first, second, third, . . . , (n−1)-th, and n-th columns in order from the left of FIG. 1 in some cases.

In the element substrate 100*a*, a set of an n cannel type TFT 116 and a rectangular transparent pixel electrode 118 is provided so as to correspond to each of intersections of the scanning lines 112 and the data lines 114. A gate electrode of the TFT 116 is connected to the scanning line 112, a source electrode thereof is connected to the data line 114, and a drain electrode thereof is connected to the pixel electrode 118. On the other hand, the opposite substrate 100*b* is provided with a transparent common electrode 108 on an entire surface in an opposite surface to the element substrate 100*a*. A voltage LCcom is applied to the common electrode 108 by a circuit (not shown).

In addition, in FIG. 1, since the opposite surface of the element substrate 100*a* is a back side of FIG. 1, the scanning lines 112, the data lines 114, the TFTs 116, and the pixel electrodes 118 provided on the opposite surface are indicated by broken lines but are difficult to observe, and are thus indicated by the solid lines, respectively.

Figure 2:
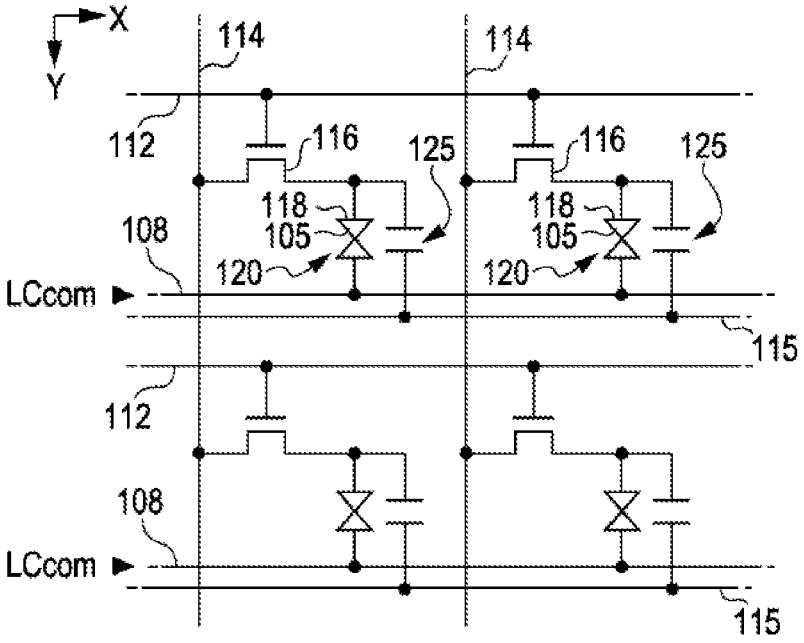
FIG. 2 is a diagram illustrating an equivalent circuit of a liquid crystal element in the same liquid crystal display apparatus.

FIG. 2 is a diagram illustrating an equivalent circuit of the liquid crystal panel 100.

As shown in FIG. 2, the liquid crystal panel 100 has a configuration in which liquid crystal elements 120 where the liquid crystal 105 is interposed between the pixel electrode 118 and the common electrode 108 are arranged so as to correspond to the intersections of the scanning lines 112 and the data lines 114. Although not shown in FIG. 1, in the equivalent circuit of the liquid crystal panel 100, as shown in FIG. 2, auxiliary capacitors (storage capacitors) 125 are practically provided in parallel to the liquid crystal elements 120. One end of each of the auxiliary capacitors 125 is connected to the pixel electrode 118 and the other end thereof is connected in common to a capacitance line 115. The capacitance line 115 is maintained at a voltage which is constant temporally.

Here, when the scanning line 112 is turned to an H level, the TFT 116 of which the gate electrode is connected to the scanning line is turned on, and thus the pixel electrode 118 is connected to the data line 114. Therefore, when the scanning line 112 is in an H level, a data signal with a voltage corresponding to a grayscale is supplied to the data line 114, and thus the data signal is applied to the pixel electrode 118 via the turned-on TFT 116. When the scanning line 112 is turned to an L level, the TFT 116 is turned off, but the voltage applied to the pixel electrode 118 is maintained by the capacitive characteristics of the liquid crystal element 120 and the auxiliary capacitor 125.

A molecular alignment state of the liquid crystal 105 varies depending on an electric field generated by the pixel electrode 118 and the common electrode 108 in the liquid crystal element 120. For this reason, if the liquid crystal element 120 is of a transmissive type, a transmittance corresponding to an applied and maintained voltage is shown. In the liquid crystal panel 100, a transmittance varies for each liquid crystal element 120, and thus the liquid crystal element 120 corresponds to a pixel. In addition, a region where the pixels are arranged is a display region 101.

Further, in the present embodiment, the liquid crystal 105 is of a VA type, and the liquid crystal element 120 is set in a normally black mode in which a black state happens when a voltage is not applied.

Figure 5A:
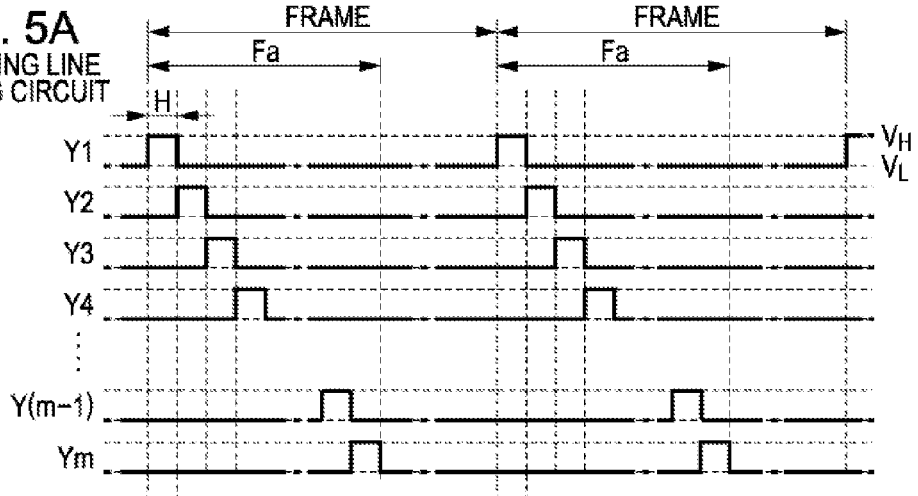
FIGS. 5A and 5B are diagrams illustrating a display operation in the same liquid crystal panel.

Referring to FIG. 1 again, the scanning line driving circuit 130 supplies scanning signals Y1, Y2, Y3, . . . , and Ym to the scanning lines 112 of the first, second, third, . . . , and m-th rows in response to a control signal Yctr from the scanning control circuit 20. Specifically, as shown in FIG. 5A, the scanning line driving circuit 130 selects the scanning lines 112 in order of the first, second, third, . . . , (m−1)-th, and m-th rows during a frame, sets a scanning signal to the selected scanning line to a selection voltage $V_H$ (H level), and sets scanning signals to the other scanning lines to a non-selection voltage $V_L$ (L level).

In addition, the frame refers to a period required to display one scene of an image by driving the liquid crystal panel 100, and, if the frequency of the vertical scanning signal included in the synchronization signals Sync is 60 Hz, the frame is 16.7 milliseconds which is a reciprocal thereof.

The data line driving circuit 140 samples a data signal Vx supplied from the video processing circuit 30 in the data lines 114 of the first to n-th columns in response to the control signal Xctr from the scanning control circuit 20 as data signals X1 to Xn.

In addition, in this description, in relation to a voltage, a ground potential is used as voltage zero unless particularly mentioned except for an applied voltage to the liquid crystal element 120. The applied voltage to the liquid crystal element 120 is a potential difference between the voltage LCcom of the common electrode 108 and a voltage of the pixel electrode 118 and is used to be differentiated from other voltages.

Figure 4A:
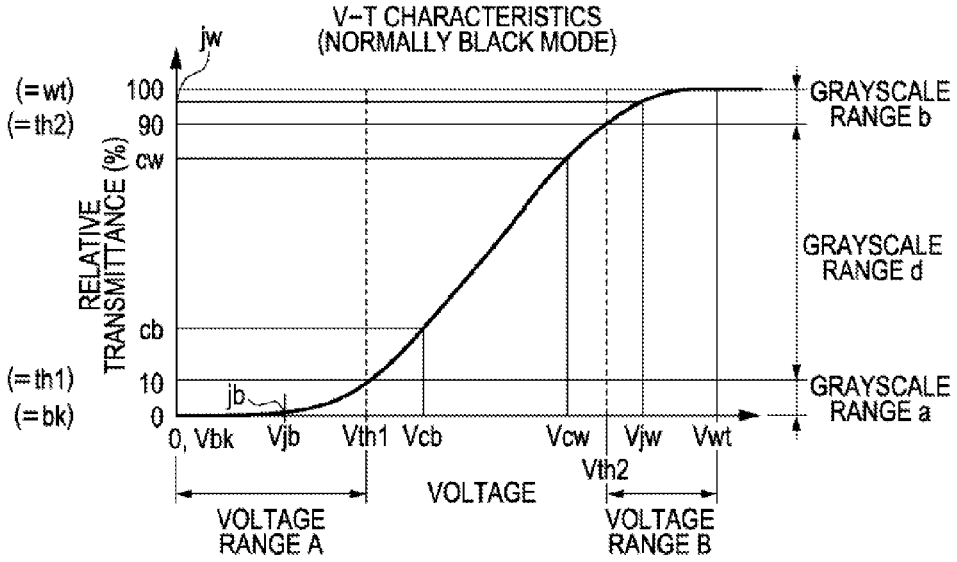
FIGS. 4A and 4B are diagrams illustrating V-T characteristics of a liquid crystal panel forming the same liquid crystal display apparatus.

However, a relationship between an applied voltage to the liquid crystal element 120 and the transmittance is expressed by the V-T characteristics, for example, as shown in FIG. 4A, in the normally black mode. For this reason, in order to make the liquid crystal element 120 represent a transmittance corresponding to a grayscale level designated by the video signal Vid-in, a voltage corresponding to the grayscale level may be applied to the liquid crystal element 120. However, if an applied voltage to the liquid crystal element 120 is merely regulated according to a grayscale level designated by the video signal Vid-in, there are cases where display defects occur due to a reverse tilt domain.

One of causes of the display defects due to the reverse tilt domain may be that the liquid crystal molecules interposed in the liquid crystal element 120 are disarrayed due to influence of a transverse electric field when the liquid crystal molecules are in an unstable state, and, then, an alignment state corresponding to an applied voltage is unlikely to happen.

Here, the case of being influenced by the transverse electric field is a case where a potential difference between pixels adjacent to each other increase, and this is a case where a dark pixel in a black level (or close to a black level) and a bright pixel in a white level (or close to a white level) are adjacent to each other in an image to be displayed.

Of them, the dark pixel refers to a pixel of the liquid crystal element 120 to which an applied voltage is in a voltage range A equal to or more than a voltage Vbk of the black level in the normally black mode and lower than a threshold value Vth1 (first reference voltage). In addition, for convenience, a transmittance range (grayscale range) of a liquid crystal element in which an applied voltage to the liquid crystal element is in the voltage range A is indicated by "a". Further, an applied voltage to the liquid crystal element for representing the grayscale range a is indicated by "Va" in some cases. The bright pixel refers to a pixel of the liquid crystal element 120 to which an applied voltage is in a voltage range B equal to or more than a threshold value Vth2 (second reference voltage) and equal to or less than a white level voltage Vwt in the normally black mode. In addition, for convenience, a transmittance range (grayscale range) of a liquid crystal element in which an applied voltage to the liquid crystal element is in the voltage range B is indicated by "b". Further, an applied voltage to the liquid crystal element for representing the grayscale range b is indicated by "Vb" in some cases.

In addition, in the normally black mode, the threshold value Vth1 is an optical threshold voltage which sets a relative transmittance of the liquid crystal element to 10%, and the threshold value Vth2 is an optical saturation voltage which sets the relative transmittance of the liquid crystal element to 90%. However, the threshold value Vth1 and the threshold value Vth2 may be voltages which respectively correspond to different relative transmittances under the condition of Vth2>Vth1. In addition, a grayscale level of a video signal of a bright pixel regulated by the threshold value Vth1 is indicated by "th1", and a grayscale level of a video signal of a bright pixel regulated by the threshold value Vth2 is indicated by "th2". Further, a grayscale level of a video signal of a bright pixel regulated by a voltage Vbk is indicated by "bk", and a grayscale level of a video signal of a bright pixel regulated by a threshold value Vwt is indicated by "wt".

Figure 35:
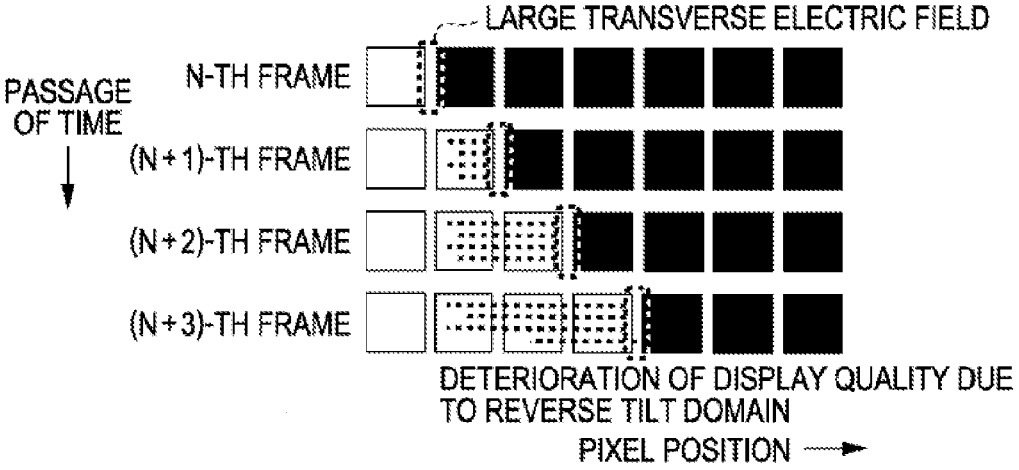
FIG. 35 is a diagram illustrating display defects and the like due to influence of a transverse electric field.

An example of the display defects due to the transverse electric field will be described. For example, as shown in FIG. 35, in a case where a black pattern in which black pixels are continuously located is moved to the right by one pixel for each frame as a background of white pixels in an image represented by the video signal Vid-in, a pixel which is to be varied from the black pixel to the white pixel at the left end edge (rear edge part of the movement) of the black pattern becomes apparent in some sort of a tailing phenomenon in which the pixel is not varied to a white pixel due to occurrence of a reverse tilt domain. As in the present embodiment, in a case where the liquid crystal panel 100 is driven at speed equal to supply speed of the video signal Vid-in, when a region of the black pixels where white pixels are a background moves by two or more pixels for each frame, this tailing phenomenon does not become apparent (or is unlikely to be visually recognized) if a response time of the liquid crystal element is shorter than a time interval when a display image is updated as described later. This reason may be considered as follows. In other words, this is because it is considered that, when a white pixel and a black pixel are adjacent to each other in a certain frame, a reverse tilt domain may occur in the white pixel, but, if a movement of an image is considered, pixels in which the reverse tilt domain occurs are discrete, and thus the tailing phenomenon is not visible.

In addition, in a reverse viewpoint of FIG. 35, in a case where a white pattern in which white pixels are continuously located is moved to the right by one pixel for each frame as a background of black pixels, a pixel which is to be varied from the black pixel to the white pixel at the right end edge (front edge part of the movement) is not varied to a white pixel due to occurrence of a reverse tilt domain. In addition, in FIG. 35, for convenience of description, the boundary vicinity of one line is extracted from an image.

Figure 4B:
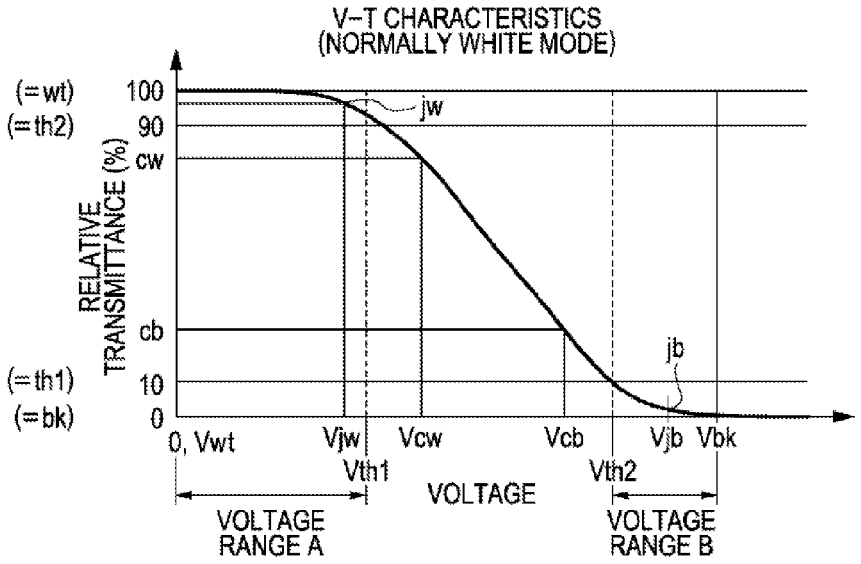

When the liquid crystal molecules are in an unstable state, an applied voltage to the liquid crystal element is lower than a judgment voltage Vjb (fourth reference voltage) shown in FIGS. 4A and 4B in the voltage range A. If an applied voltage to the liquid crystal element is lower than the judgment voltage Vjb, a regulating force of a longitudinal electric field by the applied voltage is smaller than a regulating force by the alignment layer, and thus an alignment state of the liquid crystal molecules is likely to be disarrayed by a negligible external factor. In addition, thereafter, when an applied voltage becomes equal to or more than Vjb, even though the liquid crystal molecules are to be tilted according to the applied voltage, a response takes time. Conversely, when the applied voltage becomes equal to or more than the judgment voltage Vjb, the liquid crystal molecules start to be tilted (a transmittance starts to vary) according to the applied voltage, and thus it can be said that the an alignment state of the liquid crystal molecules is in a stable state. For this reason, the judgment voltage Vjb is lower than the threshold value Vth1 regulated by a transmittance.

A grayscale level of a video signal which regulates the judgment voltage Vjb as an applied voltage to the liquid crystal element 120 is referred to as a judgment level jb.

Therefore, the video processing circuit 30 provided in the front stage of the liquid crystal panel 100 analyzes an image represented by the video signal Vid-in, and detects whether or not a dark pixel in the grayscale range a and a bright pixel in the grayscale range b are adjacent to each other. In addition, if a grayscale level of the dark pixel adjacent to a boundary between the dark pixel and the bright pixel is lower than the judgment level jb, the video processing circuit 30 corrects the video signal of the dark pixel to a video signal with a correction level cb. The judgment level jb is a grayscale level belonging to the grayscale range a. The correction level cb is a grayscale level equal to or higher than at least the judgment level jb, but, here, belongs to a grayscale range d which is higher than the grayscale range a and is lower than the grayscale range b.

An applied voltage to the liquid crystal element 120 regulated by a video signal with the correction level cb is hereinafter referred to as a correction voltage "Vcb" (third voltage).

However, easiness of occurrence of a reverse tilt domain varies depending on the strength of a transverse electric field generated in a pixel. For example, the higher the applied voltage to the liquid crystal element 120 corresponding to a bright pixel adjacent to a dark pixel, the stronger the transverse electric field caused by a potential difference between the dark pixel and the bright pixel, and thus the reverse tilt domain is likely to occur in the dark pixel. Conversely speaking, even in a case where a dark pixel and a bright pixel are adjacent to each other, the lower the applied voltage to the liquid crystal element 120 corresponding to the bright pixel, the weaker the transverse electric field caused by a potential difference between the dark pixel and the bright pixel, and thus the reverse tilt domain is unlikely to occur in the dark pixel. Therefore, as in the method in the related art, in a method of making a correction voltage constant regardless of applied voltages to the liquid crystal elements 120 corresponding to a dark pixel and a bright pixel, correction to a video signal with a correction voltage higher than necessary is performed in the dark pixel in which a transverse electric field is weak, and thus display contradiction which is likely to be perceived by a user may occur. Conversely, if a correction voltage is too low in a dark pixel in which a transverse electric field is strong, there is concern that display defects due to a reverse tilt domain may occur.

Therefore, in the present embodiment, the judgment voltage Vjb and the correction voltage Vcb are regulated as described below.

Figure 6A:
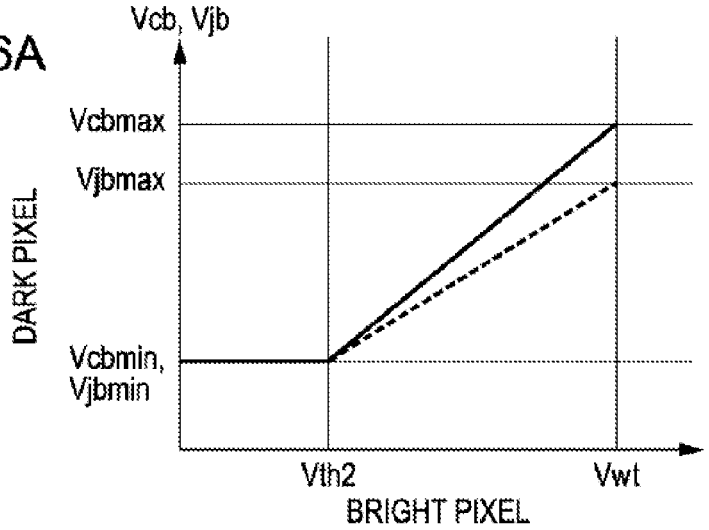
FIGS. 6A to 6C are graphs illustrating a relationship between a correction voltage and a judgment voltage of a liquid crystal element corresponding to a dark pixel and an applied voltage to a liquid crystal element corresponding to a bright pixel adjacent to the dark pixel.
Figure 6B:
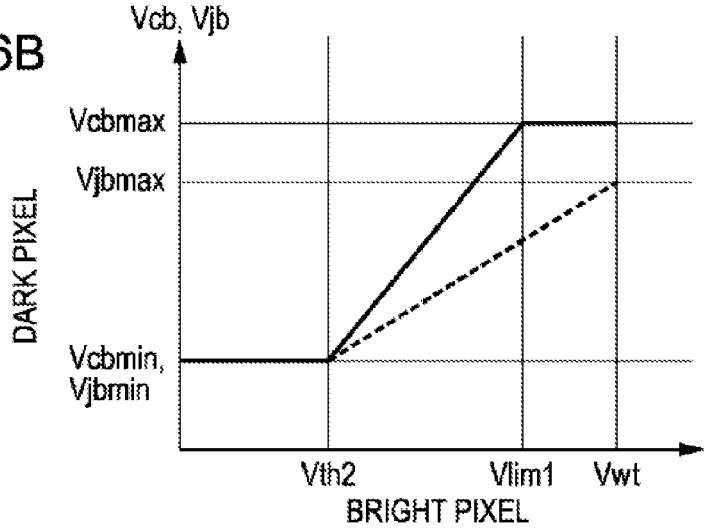
Figure 6C:
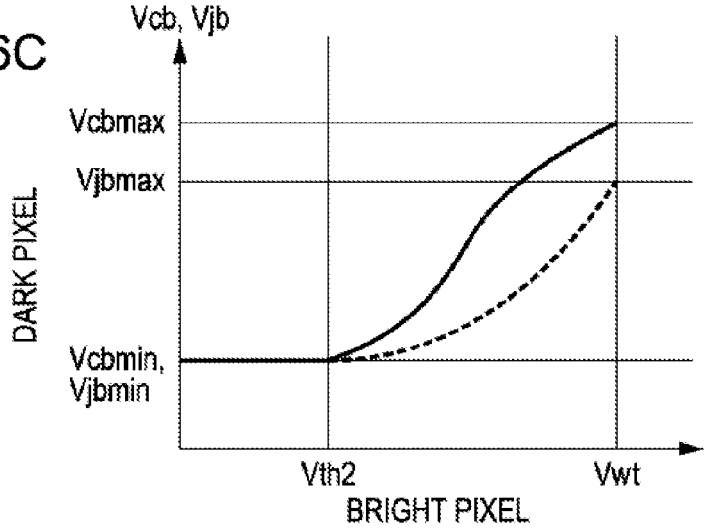

FIGS. 6A to 6C are graphs illustrating a relationship between an applied voltage (transverse axis) of the liquid crystal element 120 corresponding to a bright pixel adjacent to a dark pixel and a correction voltage and a judgment voltage (longitudinal axis) of the liquid crystal element 120 corresponding to the dark pixel. In FIGS. 6A to 6C, the solid line graph corresponds to a correction voltage of the dark pixel according to an applied voltage to the adjacent bright pixel, and the broken line graph corresponds to a judgment voltage according to an applied voltage o the adjacent bright pixel. In FIGS. 6A to 6C, relationships between an applied voltage corresponding to the bright pixel and a correction voltage corresponding to the dark pixel are different from each other, but, in all of them, the higher the applied voltage corresponding to the bright pixel, the higher the correction voltage corresponding to the dark pixel. In the graph of FIG. 6A, both the judgment voltage Vjb and the correction voltage Vcb linearly increase with respect to a voltage increase of the bright pixel. When a voltage of the bright pixel is the minimum voltage Vth2, the judgment voltage Vjb and the correction voltage Vcb are the minimum voltage, that is, Vjb=Vjbmin and Vcb=Vcbmin. On the other hand, when a voltage of the bright pixel is the maximum voltage Vwt, the judgment voltage Vjb and the correction voltage Vcb are the maximum voltage, that is, Vjb=Vjbmax and Vcb=Vcbmax. However, the relationship of the correction voltage Vcb≥judgment voltage Vjb is satisfied at all times. In the graph of FIG. 6B, both the judgment voltage Vjb and the correction voltage Vcb linearly increase with respect to a voltage increase of the bright pixel in the range in which the applied voltage to the bright pixel is Vth2 or more and Vlim1 or less. However, even if the applied voltage to the bright pixel is higher than Vlim1, the correction voltage Vcb is constant as Vcb=Vcbmax. This is because the correction voltage Vcb is limited so as not to be a specific value or more, thereby suppressing occurrence of display contradiction due to correction of the dark pixel. On the other hand, the judgment voltage Vjb linearly increases even if the applied voltage to the bright pixel exceeds Vlim1. In the graph of FIG. 6C, both the judgment voltage Vjb and the correction voltage Vcb increase in a curved manner with respect to a voltage increase of the bright pixel (that is, a slope of a tangent is not constant). Also in this example, when a voltage of the bright pixel is the minimum voltage Vth2, the judgment voltage Vjb and the correction voltage Vcb are the minimum voltage, that is, Vjb=Vjbmin and Vcb=Vcbmin. On the other hand, when a voltage of the bright pixel is the maximum voltage Vwt, the judgment voltage Vjb and the correction voltage Vcb are the maximum voltage, that is, Vjb=Vjbmax and Vcb=Vcbmax.

As described above, in the present embodiment, the higher the applied voltage to the liquid crystal element 120 corresponding to a bright pixel, the higher the correction voltage corresponding to a dark pixel of the liquid crystal element 120. As long as this condition is satisfied, a relationship between an applied voltage to a bright pixel and a correction voltage of a dark pixel may be any relationship other than the relationships shown in FIGS. 6A to 6C.

In addition, a grayscale level of a video signal of a pixel regulated by the voltage Vcbmin is indicated by "cbmin". Further, a grayscale level of a video signal of a pixel regulated by the voltage Vcbmax is indicated by "cbmax".

Figure 3:
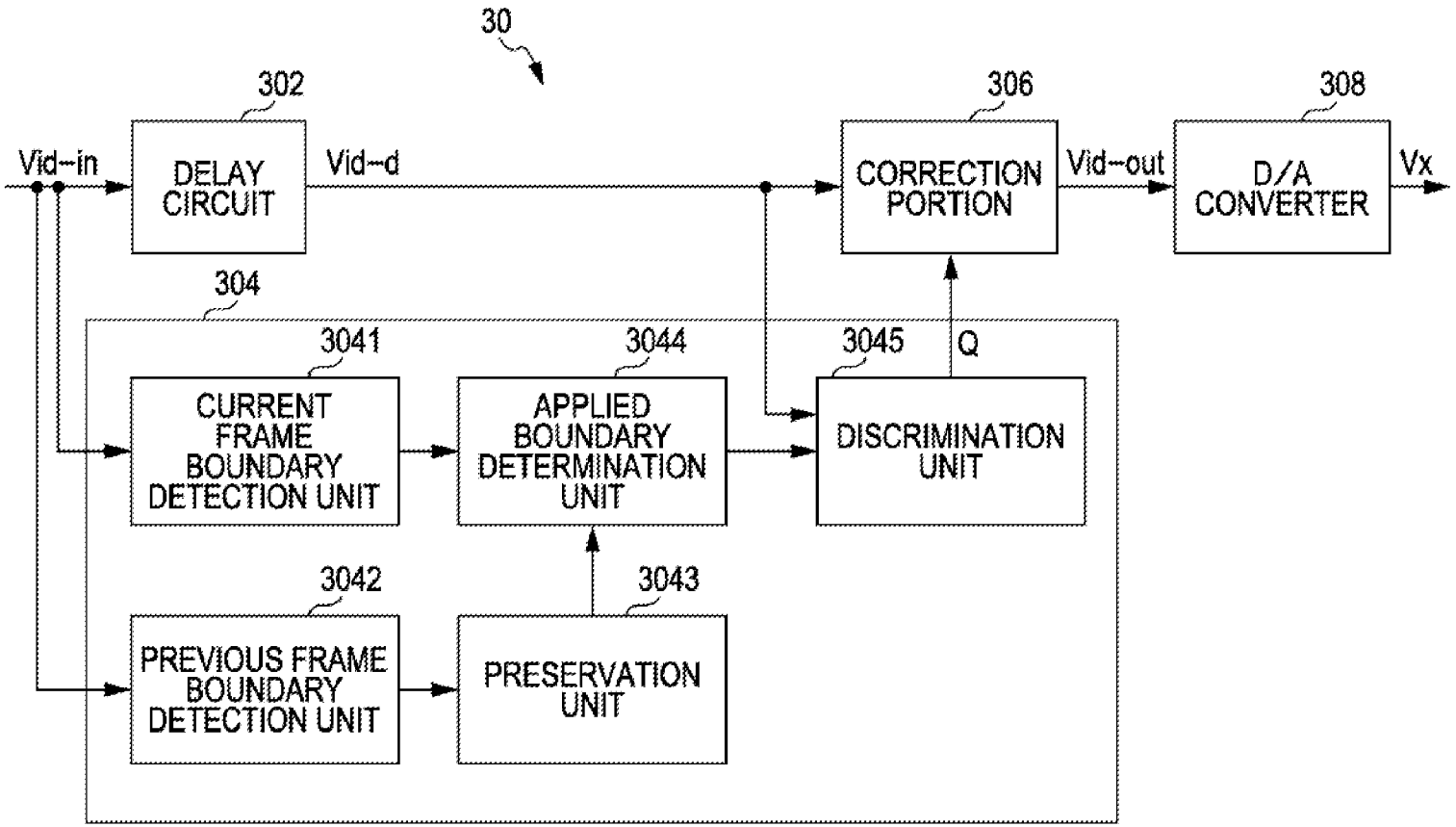
FIG. 3 is a diagram illustrating a configuration of the same video processing circuit.

Next, details of the video processing circuit 30 will be described with reference to FIG. 3. As shown in FIG. 3, the video processing circuit 30 includes a delay circuit 302, a boundary detection portion 304, a correction portion 306, and a D/A converter 308.

The delay circuit 302 is constituted by a First In First Out (FIFO) memory, a multi-stage latch circuit, or the like, accumulates video signals Vid-in supplied from a high rank device, and reads the signals after a predetermined time has elapsed so as to be output as video signals Vid-d. In addition, the accumulation and reading in the delay circuit 302 are controlled by the scanning control circuit 20.

The boundary detection portion 304 includes a current frame boundary detection unit 3041, a previous frame boundary detection unit 3042, a preservation unit 3043, an applied boundary determination unit 3044, and a discrimination unit 3045.

The current frame boundary detection unit 3041 analyzes an image represented by a video signal Vid-in of a current frame and discriminates whether or not there is a part where a dark pixel in the grayscale range a and a bright pixel in the grayscale range b are adjacent to each other. In addition, when it is discriminated that there is an adjacent part, the current frame boundary detection unit 3041 detects a boundary which is the adjacent part and outputs position information of the boundary (first boundary detection unit).

The previous frame boundary detection unit 3042 analyzes an image represented by a video signal Vid-in of a previous frame and detects a part where a dark pixel and a bright pixel are adjacent as a boundary. The previous frame boundary detection unit 3042 performs a process of the same procedures as the current frame boundary detection unit 3041 on the basis of the video signal Vid-in, so as to detect a boundary, and outputs position information of the detected boundary.

The preservation unit 3043 preserves the position information of the boundary detected by the previous frame boundary detection unit 3042 so as to be delayed by one frame period and be output.

Therefore, the boundary detected by the current frame boundary detection unit 3041 is related to the current frame, whereas the boundary which is detected by the previous frame boundary detection unit 3042 and is preserved in the preservation unit 3043 is related to the previous frame. That is, the previous frame boundary detection unit 3042 detects a boundary between the dark pixel and the bright pixel in the input video signal of the previous frame (second boundary detection unit).

The applied boundary determination unit 3044 determines a boundary which is obtained by excluding the same boundary as the boundary of the previous frame preserved in the preservation unit 3043 among boundaries of the current frame detected by the current frame boundary detection unit 3041, as an applied boundary. In other words, the applied boundary is a boundary which varies from the previous frame to the current frame, that is, it is not present in the previous frame and is present in the current frame.

The discrimination unit 3045 discriminates whether or not a pixel represented by the video signal Vid-d which is delayed and is output is a dark pixel adjacent to the applied boundary determined by the applied boundary determination unit 3044 and a grayscale level thereof is lower than the judgment level jb corresponding to an adjacent bright pixel, and outputs a flag Q of an output signal as "1" if the discrimination result is "YES". On the other hand, the discrimination unit 3045 discriminates that the pixel is not a dark pixel adjacent to the applied boundary and discriminates that a grayscale level of a dark pixel adjacent to the applied boundary is equal to or higher than the judgment level jb corresponding to an adjacent bright pixel, and outputs the flag Q of an output signal as "0".

In addition, the current frame boundary detection unit 3041 cannot detect a boundary in the vertical direction or horizontal direction unless video signals are accumulated to a degree (at least three or more rows). This is also the same for the previous frame boundary detection unit 3042. For this reason, the delay circuit 302 is provided in the meaning of adjusting supply timing of the video signal Vid-in from the higher rank device.

The above description relates to the configuration of the boundary detection portion 304.

The correction portion 306 corrects a video signal Vid-d of the dark pixel when the flag Q supplied from the discrimination unit 3045 is "1", to a video signal with a correction level cb corresponding to the adjacent bright pixel, and outputs a corrected video signal Vid-out. At this time, the correction portion 306 regulates the correction level cb so as to satisfy the relationship between the applied voltage of a bright pixel and a correction voltage of a dark pixel as shown in FIGS. 6A to 6C. On the other hand, when the flag Q supplied from the discrimination unit 3045 is "0", the correction portion 306 outputs the video signal Vid-d as the video signal Vid-out without correcting the video signal.

The D/A converter 308 converts the video signal Vid-out which is digital data into an analog data signal Vx. In order to prevent a DC component from being applied to the liquid crystal 105, a voltage of the data signal Vx alternately switches between a high potential side positive voltage and a low potential side negative voltage with respect to voltage Vcnt which is a video amplitude center.

In addition, the voltage LCcom applied to the common electrode 108 may be considered to be approximately the same as the voltage Vcnt, but may be adjusted so as to be lower than the voltage Vcnt in consideration of off-leakage or the like of the n channel type TFT 116.

Next, a display operation of the liquid crystal display apparatus 1 will be described. The video signal Vid-in is supplied from the high rank device in order of the pixels of the first row and the first column to the first row and the n-th column, the second row and the first column to the second row and the n-th column, the third row and the first column to the third row and the n-th column, . . . , and the m-th row and the first column to the m-th row and the n-column, during one frame. The video processing circuit 30 performs processes such as delay and correction on the video signal Vid-in so as to be output as the video signal Vid-out.

Figure 5B:
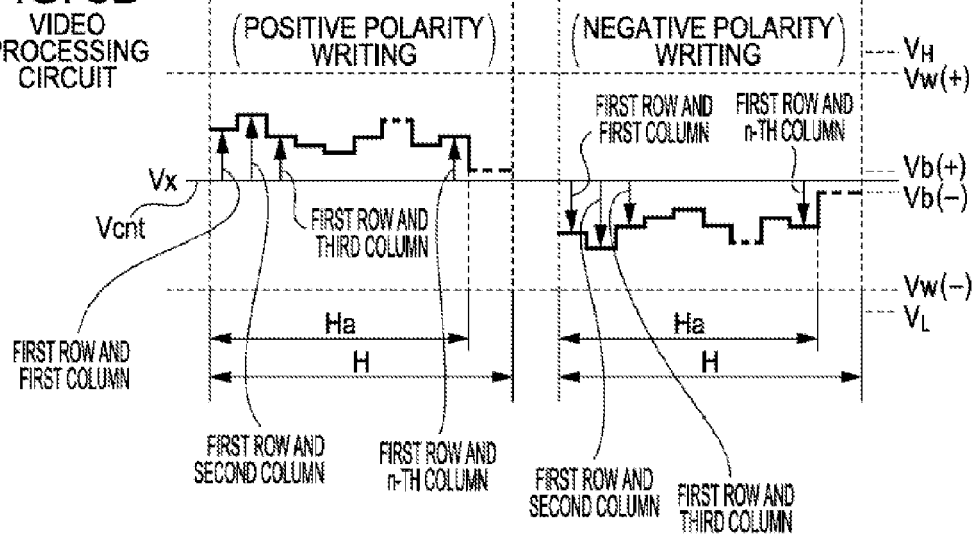

Here, in a horizontal effective scanning period (Ha) when the video signals Vid-out of the first row and the first column to the first row and the n-th column are output, the processed video signals Vid-out are converted into positive or negative data signals Vx by the D/A converter 308 as shown in FIG. 5B. Here, for example, conversion into a positive data signal is performed. This data signals Vx are sampled in the first to n-th data lines 114 as data signals X1 to Xn by the data line driving circuit 140.

On the other hand, during the horizontal scanning period when the video signals Vid-out of the first row and the first column to the first row and the n-th column are output, the scanning control circuit 20 controls the scanning line driving circuit 130 such that only the scanning signal Y1 is in an H level. When the scanning signal Y1 is in an H level, the TFTs 116 of the first row are turned on, and thus the data signals sampled in the data lines 114 are applied to the pixel electrodes 118 via the turned-on TFTs 116. Thereby, positive voltages which respectively correspond to the video signals Vid-out are written in the liquid crystal elements of the first row and the first column to the first row and the n-th column.

Successively, video signals Vid-in of the second row and the first column to the second row and the n-th column are processed by the video processing circuit 30 in the same manner so as to be output as video signals Vid-out which are converted into positive data signals by the D/A converter 308 and are then sampled in the first to n-th data lines 114 by the data line driving circuit 140.

During the horizontal scanning period when the video signals Vid-out of the second row and the first column to the second row and the n-th column are output, since only the scanning signal Y2 is turned to an H level by the scanning line driving circuit 130, the data signals sampled in the data lines 114 are applied to the pixel electrodes 118 via the turned-on TFTs 116 of the second row. Thereby, positive voltages which respectively correspond to the video signals Vid-out are written in the liquid crystal elements of the second row and the first column to the second row and the n-th column.

Hereinafter, the same writing operation is performed on the third, fourth, . . . , and the m-th rows, and thereby voltages corresponding to grayscale levels designated by the video signals Vid-out are written in the respective liquid crystal elements such that a transmissive image regulated by the video signals Vid-in is created.

In the next frame, the same writing operation is performed except that the video signal Vid-out is converted into a negative data signal according to polarity inversion of the data signal.

FIG. 5B is a voltage waveform diagram illustrating an example of the data signal Vx when the video signals Vid-out of the first row and the first column to the first row and the n-th column are output from the video processing circuit 30 during the horizontal scanning period (H). Since the normally black mode is employed in the present embodiment, the data signal Vx becomes a high potential side voltage (indicated by the upward arrow (↑) in FIG. 5B) corresponding to a grayscale level processed by the video processing circuit 30 with respect to the reference voltage Vcnt in a positive polarity, and becomes a low potential side voltage (indicated by the downward arrow (↓) in FIG. 5B) corresponding to a grayscale level with respect to the reference voltage Vcnt in a negative polarity.

Specifically, a voltage of the data signal Vx becomes a voltage deviated from the reference voltage Vcnt a range from the voltage Vw(+) corresponding to white to the voltage Vb(+) corresponding to black in a positive polarity, and becomes a voltage deviated from the reference voltage Vcnt a range from the voltage Vw(−) corresponding to white to the voltage Vb(−) corresponding to black in a negative polarity.

The voltage Vw(+) and the voltage Vw(−) are symmetric to each other with respect to the voltage Vcnt. The voltage Vb(+) and the voltage Vb(−) are also symmetric to each other with respect to the voltage Vcnt.

In addition, FIG. 5B shows a voltage waveform of the data signal Vx which is different from a voltage (a potential difference between the pixel electrode 118 and the common electrode 108) applied to the liquid crystal element 120. Further, the longitudinal scale of the voltage of the data signal in FIG. 5B is enlarged as compared with the voltage waveform of the scanning signal and the like in FIG. 5A.

A specific example of a correction process by the video processing circuit 30 will be described.

Figure 7A:
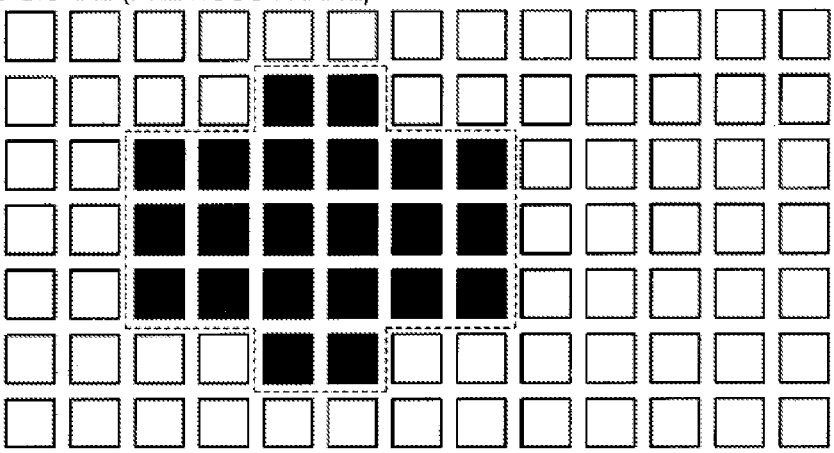
FIGS. 7A to 7C are diagrams illustrating boundary detection procedures in the same video processing circuit.
Figure 7B:
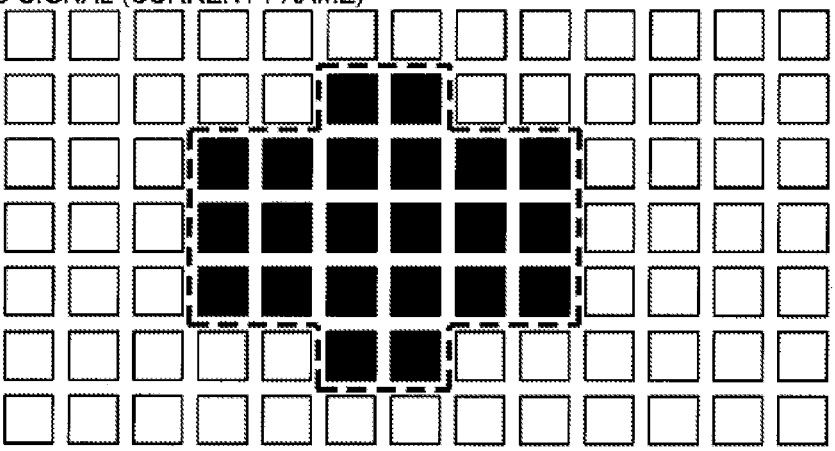
Figure 7C:
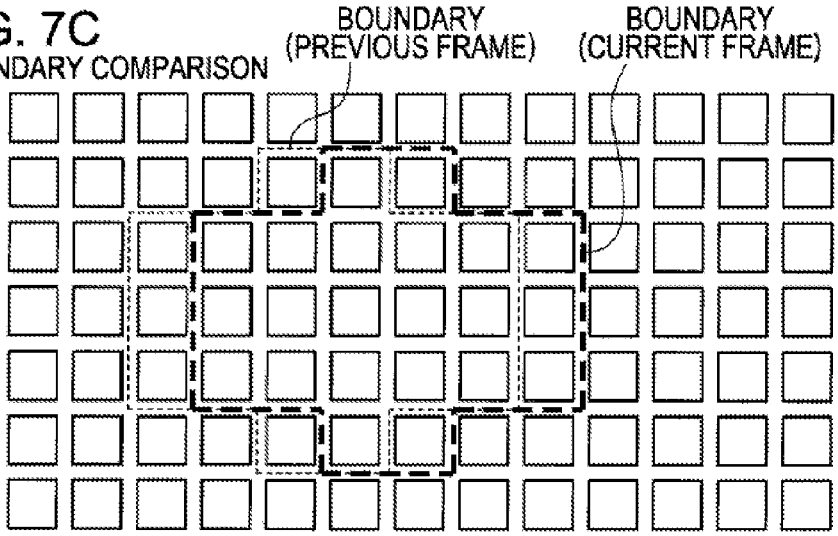
Figure 8A:
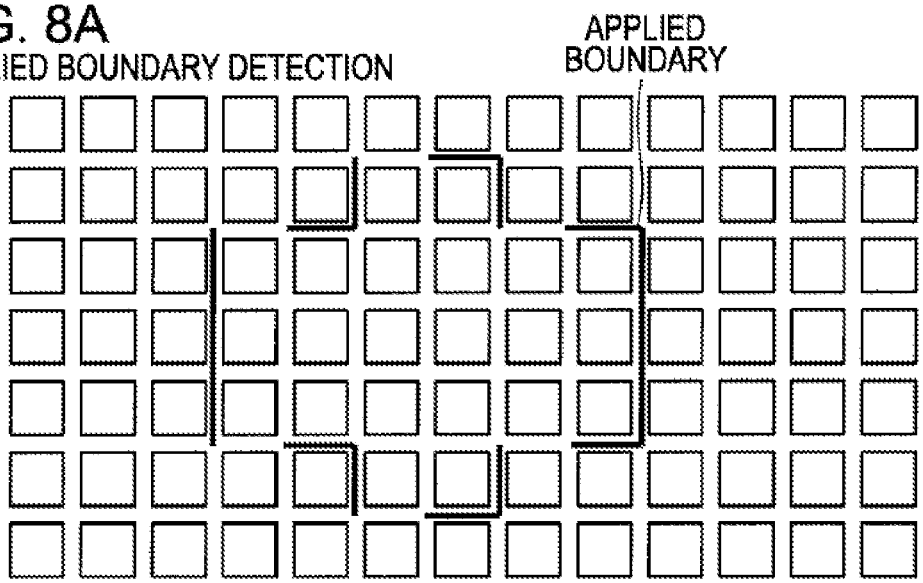
FIGS. 8A and 8B are diagrams illustrating a correction process in the same video processing circuit.

In a case where an image represented by the video signal Vid-in of a previous frame is, for example, as shown in FIG. 7A, and an image represented by the video signal Vid-in of a current frame is, for example, as shown in FIG. 7B, boundaries in the images represented by the respective video signals Vid-in are as shown in FIG. 7C. In addition, a boundary which does not overlap boundaries detected by the previous frame boundary detection unit 3042 among boundaries detected by the current frame boundary detection unit 3041 is determined as an applied boundary by the applied boundary determination unit 3044. Therefore, an applied boundary in this case is as shown in FIG. 8A.

Figure 8B:
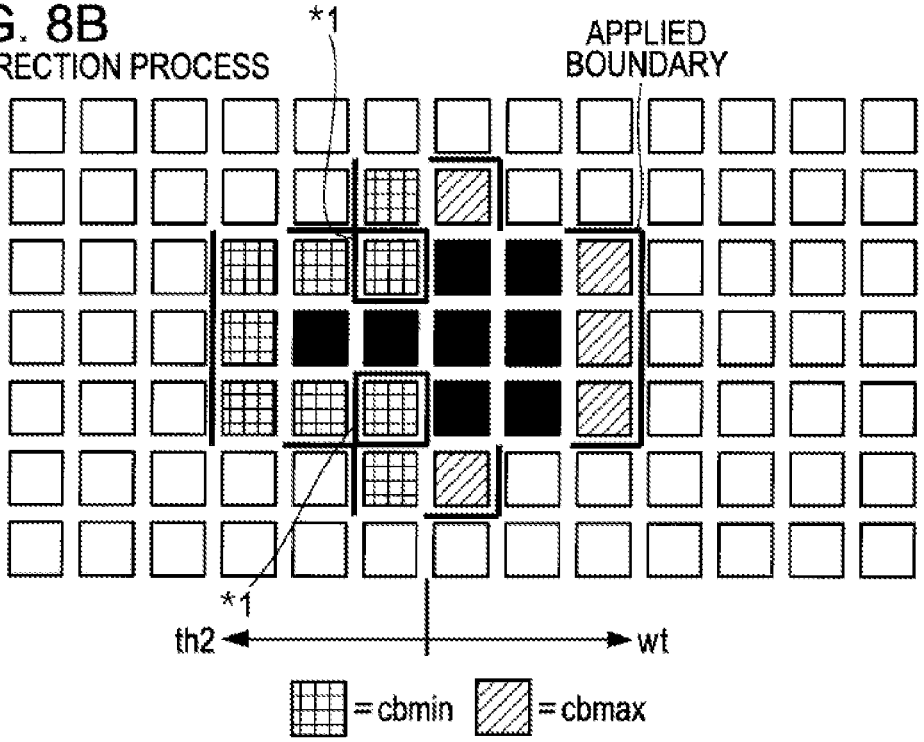

FIG. 8B is a diagram exemplifying a video signal Vid-out when the image represented by the video signal Vid-in varies from FIG. 7A to FIG. 7B.

As shown in FIG. 8B, in a case where a grayscale level of the dark pixel adjacent to the boundary which varies from the previous frame to the current frame is lower than the judgment level jb, the correction portion 306 corrects a video signal of the dark pixel adjacent to the applied boundary to a video signal with the correction level cb. Here, in a pattern of the dark pixels (shown black) using the bright pixels (shown white) shown in FIG. 7B as a background, it is assumed that a grayscale level of the bright pixel of the left half is "th2", and a grayscale level of the bright pixel of the right half is "wt". In this case, the dark pixel adjacent to the bright pixel with the grayscale level "th2" is corrected to "cbmin", and the dark pixel adjacent to the bright pixel with the grayscale level "wt" is corrected to "cbmax". Since a longitudinally and transversely continuous boundary is positioned at either the upper left or the lower left corner, the dark pixel indicated by "*1" in FIG. 8B is regarded as being adjacent to the boundary and thus becomes a correction target pixel even if the pixel is not adjacent to the bright pixel. To define the correction target pixel in this way is to take into consideration a case where an image moves at 1 pixel/frame in a tilt direction. On the other hand, a dark pixel in which a ruptured boundary is positioned only in the longitudinal direction or transverse direction at one corner of the dark pixel is not regarded as being adjacent to the boundary and thus does not become a correction target pixel, since a longitudinally and transversely continuous boundary is not positioned. This concept is common to the following description.

In the first embodiment described above, the video processing circuit 30 sets a judgment voltage and a correction voltage to be different depending on an applied voltage to a bright pixel adjacent to a correction target dark pixel. At this time, the video processing circuit 30 performs a process such that, the higher the applied voltage to the liquid crystal element 120 corresponding to a bright pixel, the higher the correction voltage corresponding to a dark pixel of the liquid crystal element 120, and, when an applied voltage to a bright pixel is Vth2, the judgment voltage Vjb and the correction voltage Vcb are the minimum voltage, and, when an applied voltage to a bright pixel is Vwt, the judgment voltage Vjb and the correction voltage Vcb are the maximum voltage. Thereby, a correction amount is reduced for a dark pixel in which a transverse electric field is relatively weak, thereby suppressing occurrence of display contradiction due to excessive correction of a video signal, and, a correction amount is increased for a bright pixel in which the transverse electric field is relatively strong, thereby suppressing display defects due to a reverse tilt domain. Thereby, it is possible to correct a video signal of each pixel at a correction amount which is necessary according to the strength of the transverse electric field for the entire display surface 101.

Modification Examples of First Embodiment

Modification Example 1 of First Embodiment

Figure 9:
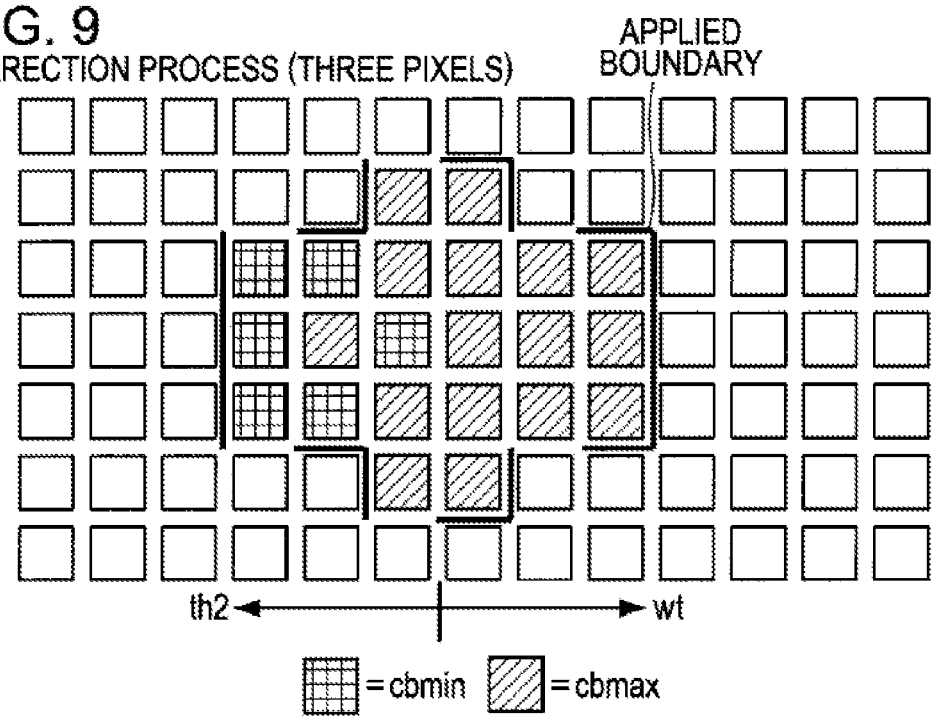
FIG. 9 is a diagram illustrating a correction process in Modification Example 1 of the same video processing circuit.

In the above-described first embodiment, the correction portion 306 sets only a pixel adjacent to an applied boundary as a correction target dark pixel. Alternatively, the correction portion 306 may set two or more dark pixels (here, three) which are continuously located in an opposite direction to an applied boundary from a dark pixel adjacent to the applied boundary as a correction target as shown in FIG. 9. In this case, a time interval when a display screen of the liquid crystal panel 100 is updated is indicated by S (milliseconds), and a response time until the liquid crystal element 120 is turned to an alignment state when an applied voltage varies from a voltage lower than the judgment voltage Vjb to a voltage Vcb is indicated by U1 (milliseconds), the number of pixels is preferably equal to or more than a value which is obtained by adding 1 to a value of an integer part of a value obtained by dividing the response time U1 by the time interval S.

In addition, in relation to the response time U1, for example, time until the liquid crystal element when Vbk indicating the minimum grayscale of a dark pixel is applied reaches a static transmittance when the maximum voltage Vcbmax is applied may be examined in advance.

If the liquid crystal panel 100 is driven at equal speed, the time interval S is 16.7 milliseconds which is the same as one frame period. For this reason, if S (=16.7)≥U1, only a single pixel adjacent to an applied boundary is sufficient as a correction target pixel. On the other hand, in recent years, the liquid crystal panel 100 tends to have been driven at higher speed such as double speed, quadruple speed, . . . . Even in this high-speed driving, video signals Vid-in corresponding to one scene are supplied from the high rank device for each frame in the same manner as in the equal speed driving. For this reason, there are cases where an intermediate image of both frames is generated between the n-th frame and the (n+1)-th frame using an interpolation technique or the like in order to improve moving image display visual characteristics and is displayed on the liquid crystal panel 100. For example, in a case of double speed driving, a time interval when a display screen is updated is 8.35 (milliseconds) which is a half. Therefore, each frame is divided into a first field and a second field, and, in the first field, update for displaying an image of the first frame is performed, and, in the second frame, update for displaying an interpolation image corresponding to the image of the first frame and an image of the next frame is performed. Therefore, there may be cases where an image pattern is moved by one pixel in a field into a frame is divided even in the high-speed driving.

If a frame period when the video signals Vid-in of one scene are supplied is indicated by V (milliseconds), and the liquid crystal panel is driven at F (where F is an integer) times speed, time of one field is a value obtained by dividing V by F, and the value is an time interval S when a display screen is updated.

For this reason, for example, if the video signals Vid-in are supplied at 16.7 milliseconds corresponding to one frame period, and the liquid crystal panel 100 is driven at double speed, a time interval S when a display screen is updated is 8.35 milliseconds which is a half thereof. Here, if the response time T is 24 milliseconds, a preferable number of pixels set as a correction target is "3" since "2.784" is a value obtained by dividing "24" by "8.35", and "3" is obtained by adding "1" to the integer part "2" thereof.

As above, even in a case where the response time U1 of the liquid crystal element is longer than the time interval S when a display screen is updated such as a case where the liquid crystal panel 100 is driven at double speed or more, it is possible to prevent occurrence display defects due to the above-described reverse tilt domain in advance by appropriately setting the number of dark pixels which are a correction target. In addition, in the normally black mode, continuous three dark pixels are set as a correction target; however, the number thereof is not limited to "3", and the number may be larger in consideration of a response time of the liquid crystal element 120 and a driving speed of the liquid crystal panel 100.

In addition, in this case, although two or more kinds of correction voltages Vcb are regulated for a single dark pixel, the maximum correction voltage may be employed, for example, in order to prioritize reduction of a reverse tilt domain. However, the correction portion 306 may regulate a correction voltage using a statistical value such as an average value or an intermediate value of two or more kinds of correction voltages Vcb.

Modification Example 2 of First Embodiment

Figure 10A:
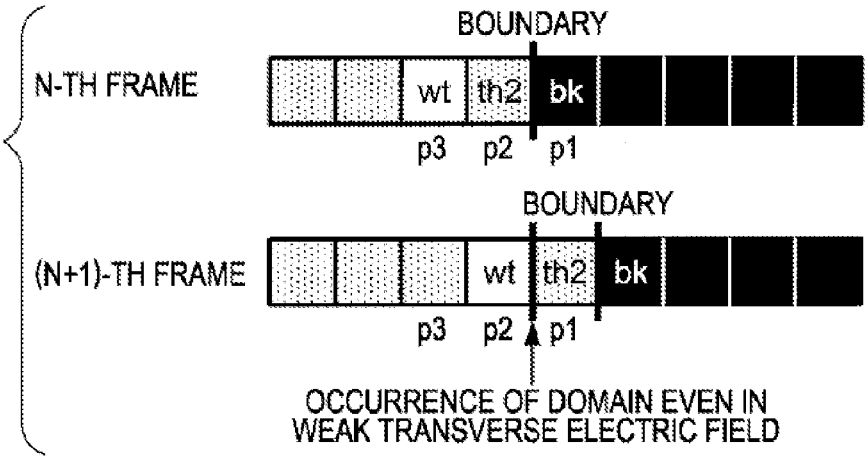
FIGS. 10A and 10B are diagram illustrating a principle that a reverse tilt domain is generated by a weak transverse electric field.

In the above-described first embodiment, in a case where a potential difference between adjacent dark pixel and bright pixel is relatively small, and a correction voltage corresponding to the dark pixel is made to be decreased, there are cases where a reverse tilt domain occurs even if a transverse electric field between the dark pixel and the bright pixel is weak after the next frame. For example, an image line is considered in which a plurality of continuous dark pixels and a plurality of continuous bright pixels are arranged in a line, for example, as shown in the N-th frame of FIG. 10A. Here, in a case where a dark pixel p1 with a grayscale level "bk" and a bright pixel p2 with a grayscale level "th2" are adjacent to each other, the dark pixel p1 is originally corrected to a video signal with a grayscale level cbmin. However, as shown in FIG. 10A, a bright pixel p3 with a grayscale level "wt" is adjacent to the bright pixel p2 on an opposite side to the dark pixel p1, and, further, the image line is assumed to move by one pixel in the rightward direction (direction from p2 to p1) of FIG. 10A from the N-th frame to the (N+1)-th frame. An alignment state of the liquid crystal 105 at this time is shown in FIG. 10B.

Figure 10B:
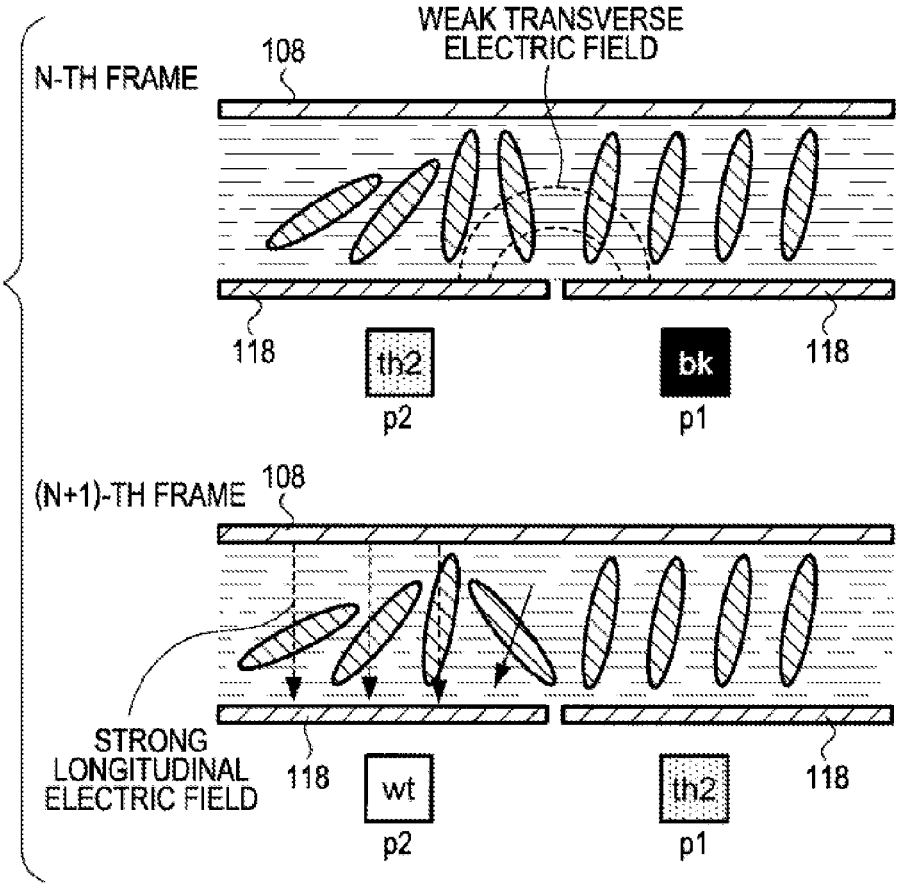

Since a grayscale difference between the dark pixel and the bright pixel is relatively small in the N-th frame, a weak transverse electric field occurs as shown in FIG. 10B, and thus reverse tilt slightly occurs in the bright pixel p2. Next, in the (N+1)-th frame, the bright pixel p2 transitions from the grayscale level "th2" to the grayscale level "wt", and thus a longitudinal electric field is strengthened. Therefore, as shown in FIG. 10B, a strong longitudinal electric field is applied to the pixel p2 and thus the reverse tilt state further deteriorates before the reverse tilt state is eliminated and then a pretilt angle returns. As above, there are cases where, if a strong longitudinal electric field is applied to the bright pixel in which a weak transverse electric field occurs, a reverse tilt domain occurs despite the weak transverse electric field. Therefore, the video processing circuit 30 of this modification example sets a correction level of a dark pixel on the basis of grayscale levels of a plurality of bright pixels (here, four bright pixels) which are continuously located in an opposite direction to an applied boundary from a bright pixel adjacent to the applied boundary. Here, the video processing circuit 30 determines a correction level of a dark pixel in the method of the above-described embodiment on the basis of a bright pixel with the maximum grayscale among a plurality of bright pixels.

Figure 11A:
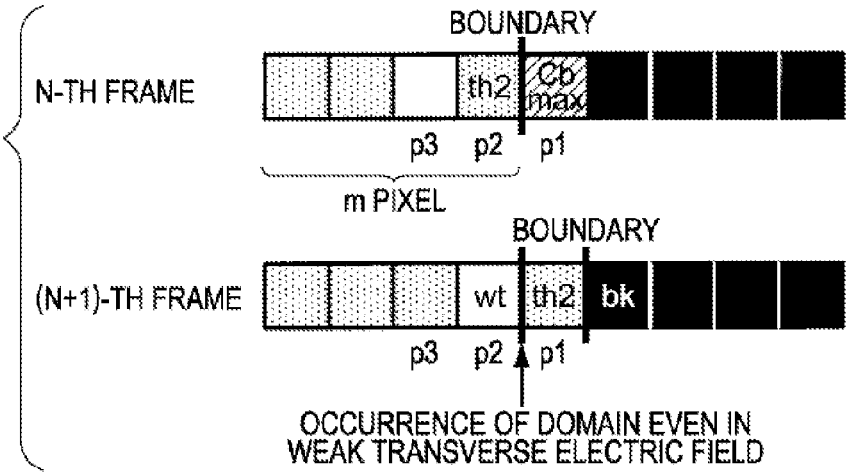
FIGS. 11A and 11B are diagrams illustrating a correction process in Modification Example 2 of the same video processing circuit.
Figure 11B:
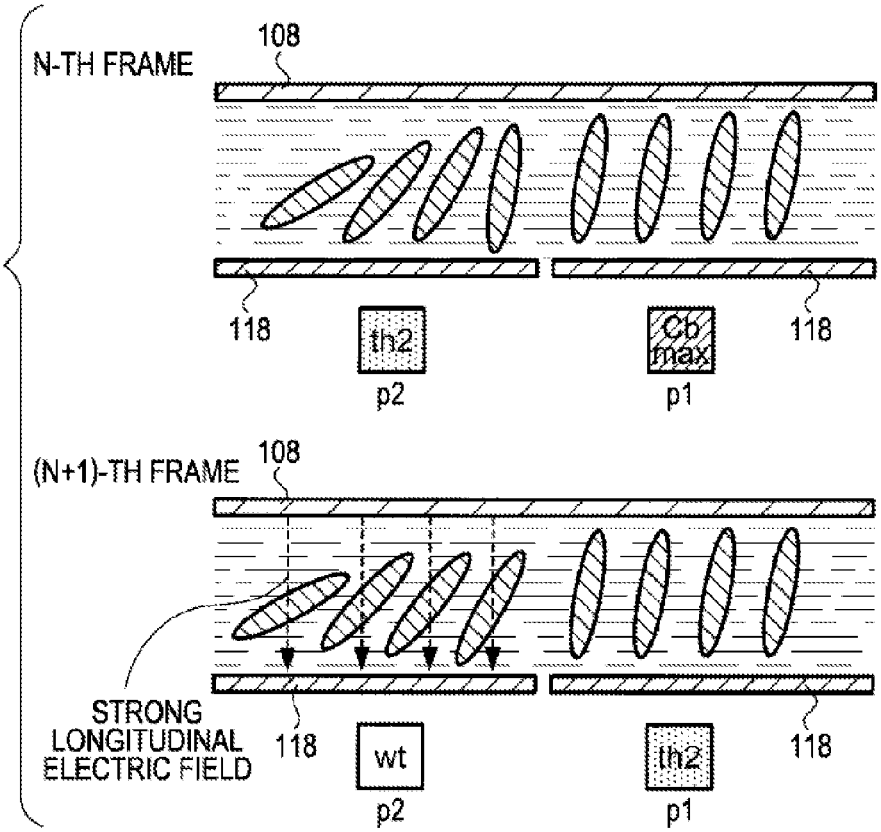

In this way, as shown in FIG. 11A, a grayscale level of the dark pixel becomes cbmax in the N-th frame, and thus reverse tilt is unlikely to occur in the bright pixel p2 in the N-th frame as shown in FIG. 11B. Thereby, as shown in FIG. 11A, even if the pixel p2 has a grayscale level wt in the (N+1)-th frame, and a strong longitudinal electric field is applied thereto, as shown in FIG. 11B, a reverse tilt domain does not occur in the bright pixel p2 in the (N+1)-th frame.

In this modification example, in the video processing circuit 30, the discrimination unit 3045 discriminates whether or not a grayscale level of a pixel represented by the video signal Vid-d is lower than the judgment level jb corresponding to m (here, m=4) bright pixels which are continuously located in an opposite direction to an applied boundary from a dark pixel adjacent to the applied boundary determined by the applied boundary determination unit 3044, and outputs a flag Q of an output signal as "1" if the discrimination result is "YES". In addition, the correction portion 306 corrects the video signal Vid-d of the dark pixel when the flag Q supplied from the discrimination unit 3045 is "1" to a video signal with a correction level cb corresponding to the m bright pixels continuously located in the opposite direction to the applied boundary, and outputs the corrected video signal Vid-out. Here, the correction portion 306 may employ the maximum grayscale among grayscale levels of the m bright pixels.

A configuration of the video processing circuit 30 is the same as in the above-described first embodiment.

According to this modification example, it is possible to suppress in advance occurrence of a reverse tilt domain due to application of a longitudinal electric field to a bright pixel in which a weak transverse electric field occurs.

Second Embodiment

Next, the second embodiment of the invention will be described.

In this embodiment, the video processing circuit 30 corrects a video signal of a bright pixel adjacent to an applied boundary instead of a dark pixel adjacent to the applied boundary. In this embodiment, the correction portion 306 does not correct a video signal of the dark pixel. In this embodiment, in a case where an applied voltage to a bright pixel adjacent to a dark pixel is higher than a judgment voltage "Vjw" (sixth voltage), a video signal is corrected such that the applied voltage to the bright pixel is set to a correction voltage "Vcw" (fifth voltage) which is equal to or less than the judgment voltage "Vjw". Hereinafter, a grayscale level of a video signal for regulating the judgment voltage "Vjw" is referred to as a judgment level "jw", and a grayscale level of a video signal for regulating the correction voltage "Vcw" is referred to as a judgment level "cw".

Even if a bright pixel is corrected, a reverse tilt domain does not occur in the bright pixel which is likely to be influenced by a transverse electric field in the liquid crystal panel 100. However, as described above, easiness of occurrence of a reverse tilt domain depends on the strength of a transverse electric field occurring in a pixel. Even in a case where a bright pixel and a dark pixel are adjacent to each other, the higher the grayscale level of the dark pixel, the weaker the transverse electric field caused by a potential difference between the bright pixel and the dark pixel, a reverse tilt domain is unlikely to occur in the bright pixel.

Therefore, in the present embodiment, the judgment voltage Vjw and the correction voltage Vcw are determined as described below.

Figure 12A:
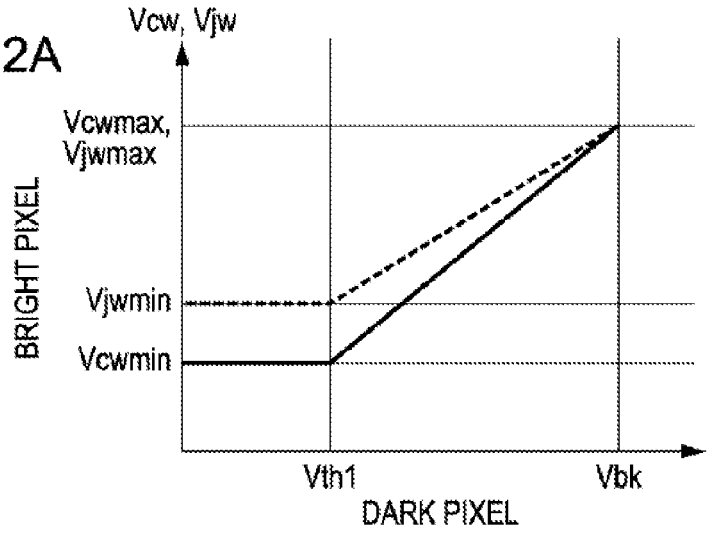
FIGS. 12A to 12C are graphs illustrating a relationship between a correction voltage and a judgment voltage of a liquid crystal element corresponding to a bright pixel and an applied voltage to a liquid crystal element corresponding to a dark pixel adjacent to the bright pixel according to a second embodiment.
Figure 12B:
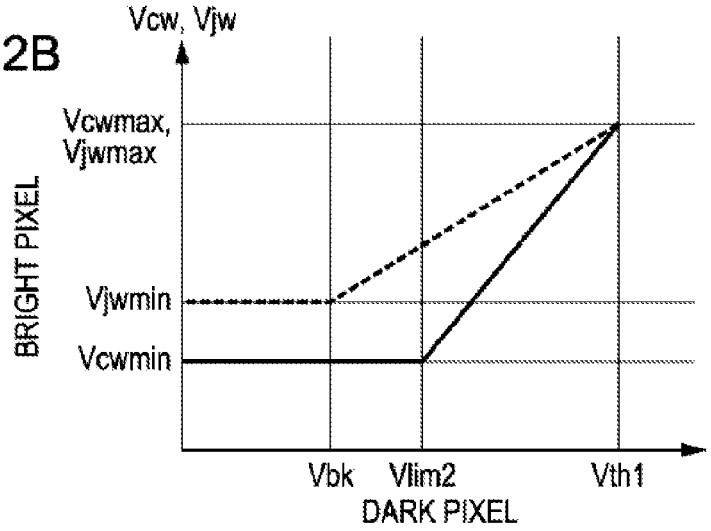
Figure 12C:
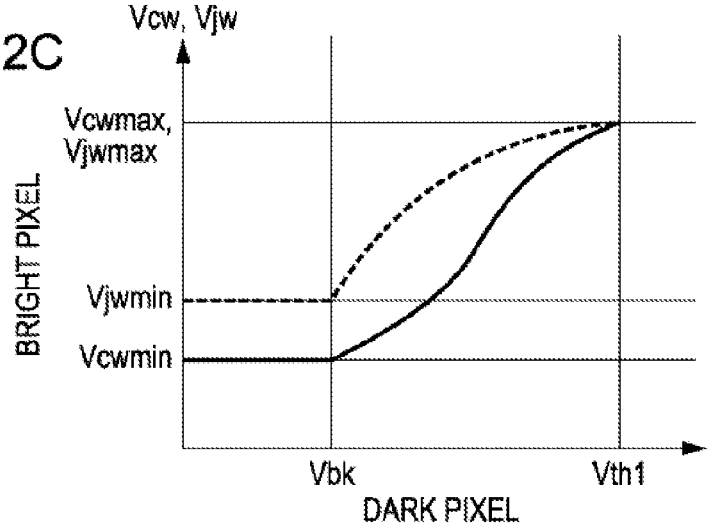

FIGS. 12A to 12C are graphs illustrating a relationship between an applied voltage (transverse axis) of the liquid crystal element 120 corresponding to a dark pixel adjacent to a bright pixel and a correction voltage and a judgment voltage (longitudinal axis) of the liquid crystal element 120 corresponding to the bright pixel. In FIGS. 12A to 12C, the solid line graph corresponds to a correction voltage of the bright pixel according to an applied voltage to the adjacent dark pixel, and the broken line graph corresponds to a judgment voltage according to an applied voltage o the adjacent dark pixel. In FIGS. 12A to 12C, relationships between an applied voltage corresponding to the dark pixel and a correction voltage corresponding to the bright pixel are different from each other, but, in all of them, the lower the applied voltage corresponding to the dark pixel, the lower the correction voltage corresponding to the bright pixel. In the graph of FIG. 12A, both the judgment voltage Vjw and the correction voltage Vcw linearly decrease with respect to a voltage decrease of the dark pixel. When a voltage of the dark pixel is the maximum voltage Vth1, the judgment voltage Vjw and the correction voltage Vcw are the maximum voltage, that is, Vjw=Vjwmax and Vcw=Vcwmax. On the other hand, when a voltage of the dark pixel is the minimum voltage Vbk, the judgment voltage Vjw and the correction voltage Vcw are the minimum voltage, that is, Vjw=Vjwmin and Vcw=Vcwmin. However, the relationship of the correction voltage Vcw≤judgment voltage Vjw is satisfied at all times. In the graph of FIG. 12B, both the judgment voltage Vjw and the correction voltage Vcw linearly decrease with respect to a voltage increase of the dark pixel in the range in which the applied voltage to the dark pixel is Vlim2 or more and Vth1 or less. However, even if the applied voltage to the dark pixel is higher than Vlim2, the correction voltage Vcw is constant as Vcw=Vcwmin. This is because the correction voltage Vcw is limited so as not to be a specific value or less, thereby suppressing occurrence of display contradiction due to correction of the bright pixel. On the other hand, the judgment voltage Vjw linearly decreases even if the applied voltage to the dark pixel is lower than Vlim2. In the graph of FIG. 12C, both the judgment voltage Vjw and the correction voltage Vcw increase in a curved manner with respect to a voltage decrease of the dark pixel (that is, a slope of a tangent is not constant). Also in this example, when a voltage of the dark pixel is the maximum voltage Vth1, the judgment voltage Vjw and the correction voltage Vcw are the maximum voltage, that is, Vjw=Vjwmax and Vcw=Vcwmax. On the other hand, when a voltage of the dark pixel is the minimum voltage Vbk, the judgment voltage Vjw and the correction voltage Vcw are the minimum voltage, that is, Vjw=Vjwmin and Vcw=Vcwmin.

As described above, in the present embodiment, the lower the applied voltage to the liquid crystal element 120 corresponding to a dark pixel, the lower the correction voltage corresponding to a dark pixel of the liquid crystal element 120. As long as this condition is satisfied, a relationship between an applied voltage to a dark pixel and a correction voltage of a bright pixel may be any relationship other than the relationships shown in FIGS. 12A to 12C.

In addition, a grayscale level of a video signal of a pixel regulated by the voltage Vcwmin is indicated by "cwmin". Further, a grayscale level of a video signal of a pixel regulated by the voltage Vcwmax is indicated by "cwmax".

In relation to a configuration of the video processing circuit 30 of the present embodiment, a difference from the above-described first embodiment will be described.

The discrimination unit 3045 discriminates whether or not a pixel represented by the video signal Vid-in is a bright pixel adjacent to the applied boundary determined by the applied boundary determination unit 3044 and a grayscale level thereof is higher than the judgment level jw corresponding to an adjacent dark pixel, and outputs a flag Q of an output signal as "1" if the discrimination result is "YES". On the other hand, in a case where the discrimination unit 3045 discriminates that the pixel is not a bright pixel adjacent to the applied boundary and discriminates that a grayscale level of a bright pixel adjacent to the applied boundary is equal to or lower than the judgment level jb corresponding to an adjacent dark pixel, the discrimination unit 3045 outputs the flag Q of an output signal as "0".

The correction portion 306 corrects a video signal Vid-d of the bright pixel when the flag Q supplied from the discrimination unit 3045 is "1", to a video signal with a correction level cw corresponding to the adjacent dark pixel, and outputs a corrected video signal Vid-out. At this time, the correction portion 306 regulates the correction level cw so as to satisfy the relationship between the applied voltage of a dark pixel and a correction voltage of a bright pixel as shown in FIGS. 12A to 12C. On the other hand, when the flag Q supplied from the discrimination unit 3045 is "0", the correction portion 306 outputs the video signal Vid-d as the video signal Vid-out without correcting the video signal.

A specific example of a correction process by the video processing circuit 30 will be described.

In a case where an image represented by the video signal Vid-in of a previous frame is, for example, as shown in FIG. 7A, and an image represented by the video signal Vid-in of a current frame is, for example, as shown in FIG. 7B, an applied boundary in this case is as shown in FIG. 8A.

Figure 13A:
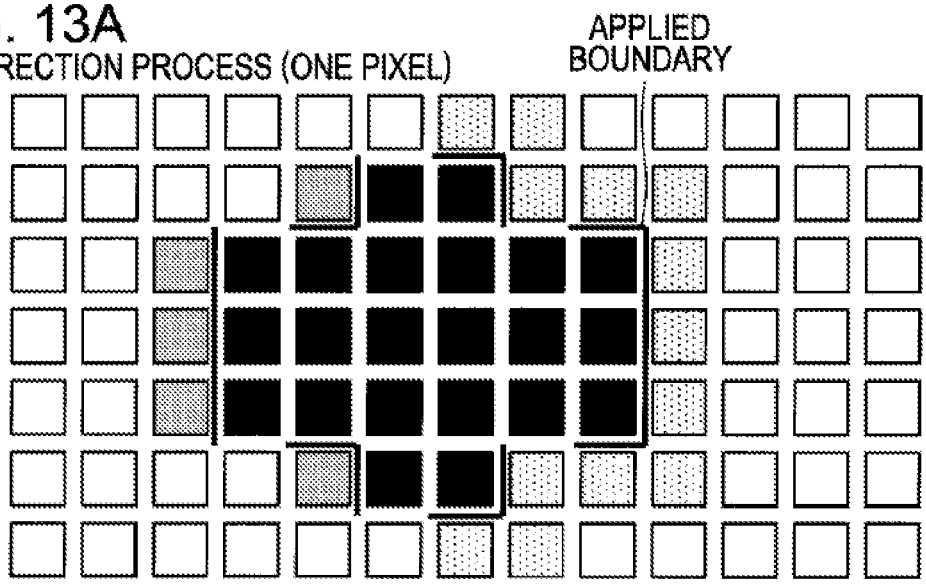
FIGS. 13A and 13B are diagrams illustrating a correction process in a video processing circuit according to the same embodiment and a modification example thereof.

FIG. 13A is a diagram exemplifying a video signal Vid-out when the image represented by the video signal Vid-in varies from FIG. 7A to FIG. 7B.

As shown in FIG. 13A, in a case where a grayscale level of the bright pixel adjacent to the boundary which varies from the previous frame to the current frame is higher than the judgment level jw, the correction portion 306 corrects a video signal of the bright pixel adjacent to the applied boundary to a video signal with the correction level cw. Here, in a pattern shown in FIG. 7B, it is assumed that a grayscale level of the dark pixel of the left half is "bk", and a grayscale level of the dark pixel of the right half is "th1". In this case, the bright pixel adjacent to the dark pixel with the grayscale level "bk"

is corrected to "cwmin", and the bright pixel adjacent to the dark pixel with the grayscale level "th1" is corrected to "cwmax".

Modification Examples of Second Embodiment

Modification Example 1 of Second Embodiment

Figure 13B:
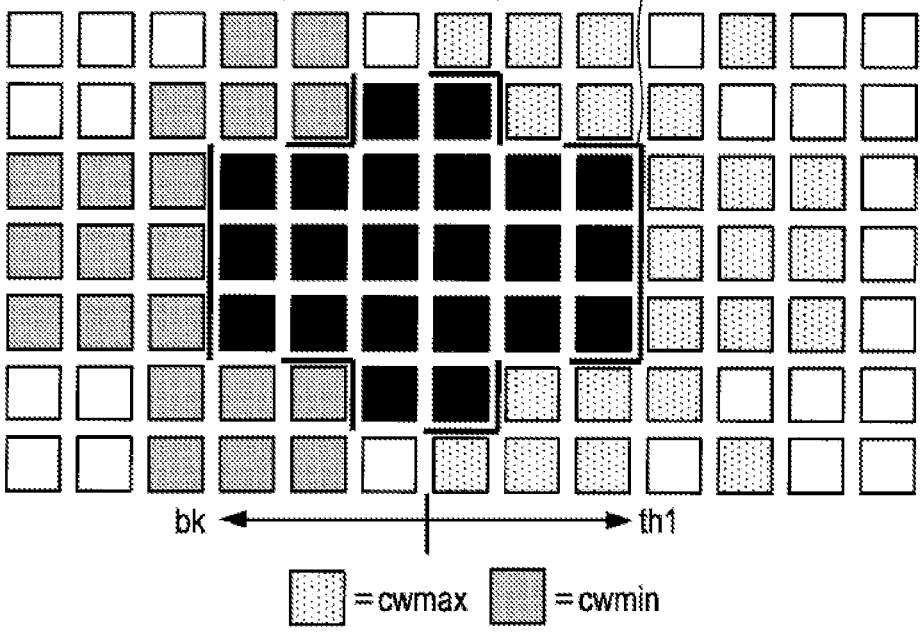

In addition, in the same manner as in Modification Example 1 of the first embodiment, the correction portion 306 may set two or more bright pixels (here, three) which are continuously located in an opposite direction to an applied boundary from a bright pixel adjacent to the applied boundary as a correction target (refer to FIG. 13B). In this case as well, in the same manner as in the first embodiment, a time interval when a display screen of the liquid crystal panel 100 is updated is indicated by S (milliseconds), and a response time until the liquid crystal element 120 is turned to an alignment state when an applied voltage varies from a voltage (for example, a voltage Vwt corresponding to the maximum grayscale) higher than the judgment voltage Vjw to a voltage Vcw (for example, Vcwmin) is indicated by U2 (milliseconds), the number of pixels is preferably equal to or more than a value which is obtained by adding 1 to a value of an integer part of a value obtained by dividing the response time U2 by the time interval S.

In the second embodiment described above, the video processing circuit 30 sets a judgment voltage and a correction voltage corresponding to a bright pixel to be different depending on an applied voltage to a dark pixel adjacent to a correction target bright pixel. At this time, the video processing circuit 30 performs a process such that, the lower the applied voltage to the liquid crystal element 120 corresponding to a dark pixel, the lower the correction voltage corresponding to a bright pixel of the liquid crystal element 120, and, when an applied voltage to a dark pixel is Vth1, the judgment voltage Vjb and the correction voltage Vcb are the maximum voltage, and, when an applied voltage to a dark pixel is Vbk, the judgment voltage Vjb and the correction voltage Vcb are the minimum voltage. Thereby, a correction amount is reduced for a bright pixel in which a transverse electric field is relatively weak, thereby suppressing occurrence of display contradiction due to excessive correction of a video signal, and, a correction amount is increased for a dark pixel in which the transverse electric field is relatively strong, thereby suppressing display defects due to a reverse tilt domain. Thereby, it is possible to correct a video signal of each pixel at a correction amount which is necessary according to the strength of the transverse electric field for the entire display surface 101.

Modification Example 2 of Second Embodiment

Figure 14A:
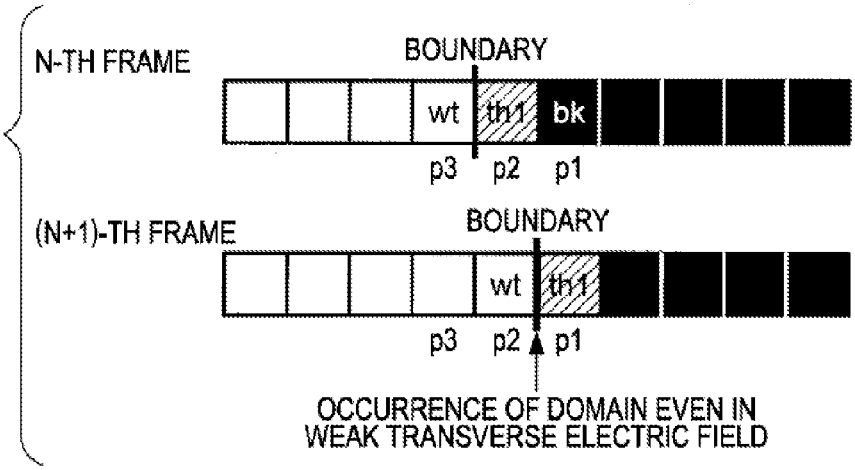
FIGS. 14A and 14B are diagrams illustrating a principle that a reverse tilt domain is generated by a weak transverse electric field.
Figure 14B:
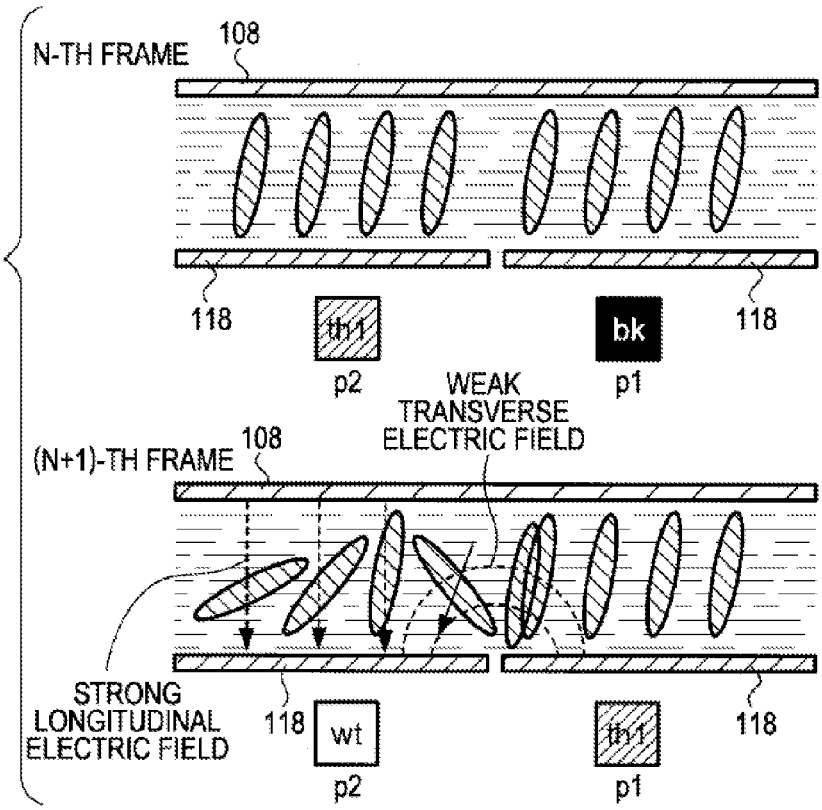

In the above-described embodiment, in a case where a potential difference between adjacent dark pixel and bright pixel is relatively small, and a correction voltage corresponding to the bright pixel is made to be increased, there are cases where a reverse tilt domain occurs even if a transverse electric field between the dark pixel and the bright pixel is weak after the next frame. For example, as shown in the N-th frame of FIG. 14A, in a case where an image line in which a plurality of continuous dark pixels and a plurality of continuous bright pixels are arranged in a line moves by one pixel in the rightward direction of FIG. 14A from the N-th frame to the (N+1)-th frame, the image line transitions as shown in FIG. 14A. An alignment state of the liquid crystal 105 at this time is shown in FIG. 14B. Here, in a case where a dark pixel p1 with a grayscale level "bk" and a dark pixel p2 with a grayscale level "th1" are adjacent to each other, and the dark pixel p2 is adjacent to a bright pixel p3 with a grayscale level "wt", a potential difference between the dark pixel p1 and the dark pixel p2 is small, and a transverse electric field is weak. However, as shown in FIG. 14B, it is assumed that the dark pixel p2 has a grayscale level "wt" in the (N+1)-th frame in a state of not being aligned so as to correspond to the grayscale level "th1" in the N-th frame. In this case, an applied voltage to the pixel p1 is Vth1, and an applied voltage to the pixel p2 is Vwt, thereby generating only a weak transverse electric field; however, the pixel p2 is still in a state close to a pretilt angle of the grayscale level "bk", and thus there are cases where a reverse tilt domain occurs even in the weak transverse electric field as in the (N+1)-th frame of FIG. 14B. Therefore, the video processing circuit 30 of this modification example sets a correction level cw on the basis of grayscale levels of a plurality of dark pixels (here, four dark pixels) which are continuously located in an opposite direction to an applied boundary from a dark pixel adjacent to the applied boundary. Here, the video processing circuit 30 determines a correction level of a bright pixel in the method of the above-described embodiment on the basis of a dark pixel with the minimum grayscale among a plurality of dark pixels.

Figure 15A:
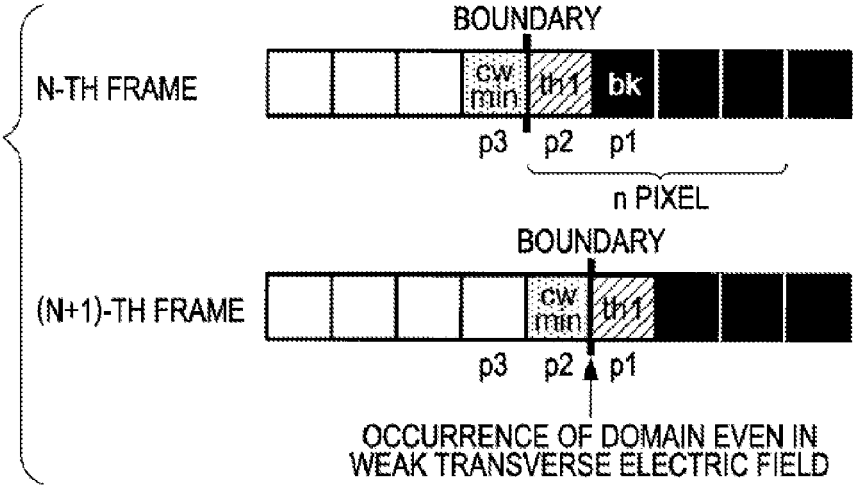
FIGS. 15A and 15B are diagrams illustrating a correction process in a modification example of the same video processing circuit.
Figure 15B:
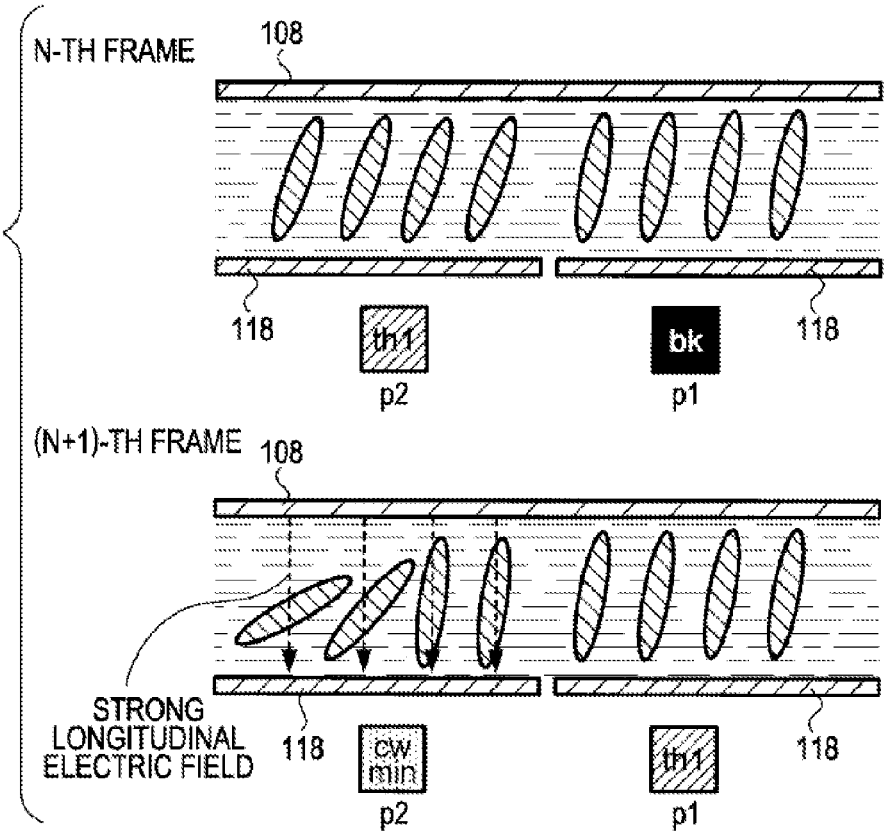

In this way, as shown in FIG. 15A, a grayscale level of the bright pixel becomes cwmin in the N-th frame. Thereby, as shown in FIG. 15A, even if the pixel p2 has a grayscale level wt in the (N+1)-th frame, as shown in FIG. 15B, since a video signal of the bright pixel is corrected in a direction in which the transverse electric field is weakened, a longitudinal electric field is weakened, and thus a reverse tilt domain is unlikely to occur.

In this modification example, in the video processing circuit 30, the discrimination unit 3045 discriminates whether or not a grayscale level of a pixel represented by the video signal Vid-d is lower than the judgment level jw corresponding to n (here, n=4) dark pixels which are continuously located in an opposite direction to an applied boundary from a dark pixel adjacent to the applied boundary determined by the applied boundary determination unit 3044, and outputs a flag Q of an output signal as "1" if the discrimination result is "YES".

In addition, the correction portion 306 corrects the video signal Vid-d of the dark pixel when the flag Q supplied from the discrimination unit 3045 is "1" to a video signal with a correction level cw corresponding to the n dark pixels continuously located in the opposite direction to the applied boundary, and outputs the corrected video signal Vid-out. Here, the correction portion 306 may employ the minimum grayscale amoung grayscale levels of the n dark pixels.

A configuration of the video processing circuit 30 which is not described here is the same as in the above-described second embodiment.

According to this modification example, it is possible to suppress in advance occurrence of a reverse tilt domain due to application of a longitudinal electric field to a bright pixel in which a weak transverse electric field occurs.

Third Embodiment

Next, the third embodiment of the invention will be described.

In this embodiment, the video processing circuit 30 performs both the dark pixel correction described in the first embodiment and the bright pixel correction described in the second embodiment. In the following description, the same constituent elements as in the first and second embodiments are given the same reference numerals, and description thereof will be appropriately omitted.

In relation to a configuration of the video processing circuit 30 of the present embodiment, a difference from the first or second embodiment will be described.

In a case where the discrimination unit 3045 discriminates that a pixel represented by the video signal Vid-d is a dark pixel adjacent to an applied boundary determined by the applied boundary determination unit 3044 and a grayscale level thereof is lower than the judgment level jb corresponding to an adjacent bright pixel, or that the pixel is a bright pixel adjacent to the applied boundary and a grayscale level thereof is higher than the judgment level jw corresponding to an adjacent dark pixel, the discrimination unit 3045 outputs a flag Q of an output signal as "1". On the other hand, in a case where the discrimination unit 3045 discriminates that the pixel is neither a dark pixel nor a bright pixel adjacent to the applied boundary, discriminates that a grayscale level of a dark pixel adjacent to the applied boundary is equal to or lower than the judgment level jb corresponding to an adjacent dark pixel, or discriminates that a grayscale level of a bright pixel adjacent to the applied boundary is equal to or lower than the judgment level jw corresponding to an adjacent dark pixel, the discrimination unit 3045 outputs the flag Q of an output signal as "0".

When the flag Q supplied from the discrimination unit 3045 is "1", the correction portion 306 corrects a video signal Vid-d of the dark pixel to a video signal with a correction level cw corresponding to the adjacent bright pixel, and outputs a corrected video signal Vid-out, and, further, corrects a video signal Vid-d of the bright pixel to a video signal with a correction level cb corresponding to the adjacent dark pixel, and outputs a corrected video signal Vid-out. On the other hand, when the flag Q supplied from the discrimination unit 3045 is "0", the correction portion 306 outputs the video signal Vid-d as the video signal Vid-out without correcting the video signal.

A specific example of a correction process by the video processing circuit 30 will be described.

In a case where an image represented by the video signal Vid-in of a previous frame is, for example, as shown in FIG. 7A, an image represented by the video signal Vid-in of a current frame is, for example, as shown in FIG. 7B, and an applied boundary in this case is as shown in FIG. 8A.

Figure 16A:
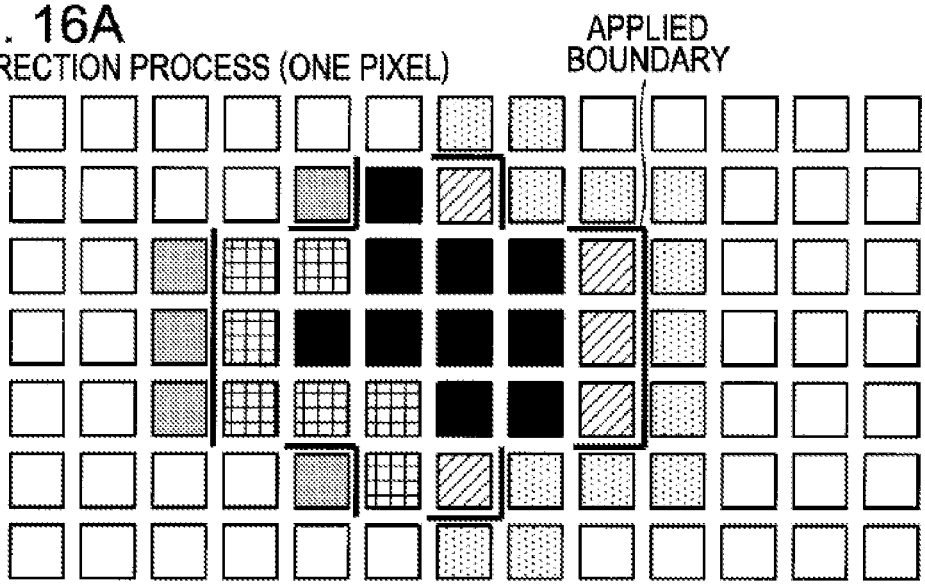
FIGS. 16A and 16B are diagrams illustrating a correction process in a video processing circuit according to a third embodiment.

FIG. 16A is a diagram exemplifying a video signal Vid-out when the image represented by the video signal Vid-in varies from FIG. 7A to FIG. 7B.

As shown in FIG. 16A, in a case where a grayscale level of the bright pixel adjacent to the boundary which varies from the previous frame to the current frame is higher than the judgment level jw, the correction portion 306 corrects a video signal of the bright pixel adjacent to the applied boundary to a video signal with the correction level cw, and, in a case where a grayscale level of the dark pixel adjacent to the boundary is lower than the judgment level jb, the correction portion 306 corrects a video signal of the dark pixel adjacent to the applied boundary to a video signal with the correction level cb. Here, in a pattern shown in FIG. 7B, it is assumed that a grayscale level of the dark pixel of the left half is "bk", a grayscale level of the dark pixel of the right half is "th1", a grayscale level of the bright pixel of the left half is "th2", a grayscale level of the bright pixel of the right half is "wt". In this case, the dark pixel adjacent to the bright pixel with the grayscale level "th2" is corrected to "cbmin", and the dark pixel adjacent to the bright pixel with the grayscale level "wt" is corrected to "cbmax". In this case, the bright pixel adjacent to the dark pixel with the grayscale level "bk" is corrected to "cwmin", and the bright pixel adjacent to the dark pixel with the grayscale level "th1" is corrected to "cwmax".

In the above-described third embodiment, the video processing circuit 30 sets both a dark pixel and a bright pixel as a correction target, and thus can suppress occurrence of display defects due to a reverse tilt domain whilst suppressing variations in video signals per pixel as compared with the first and second embodiments. In addition, according to the above-described third embodiment, effects equivalent to the above-described first and second embodiments can be achieved.

Figure 16B:
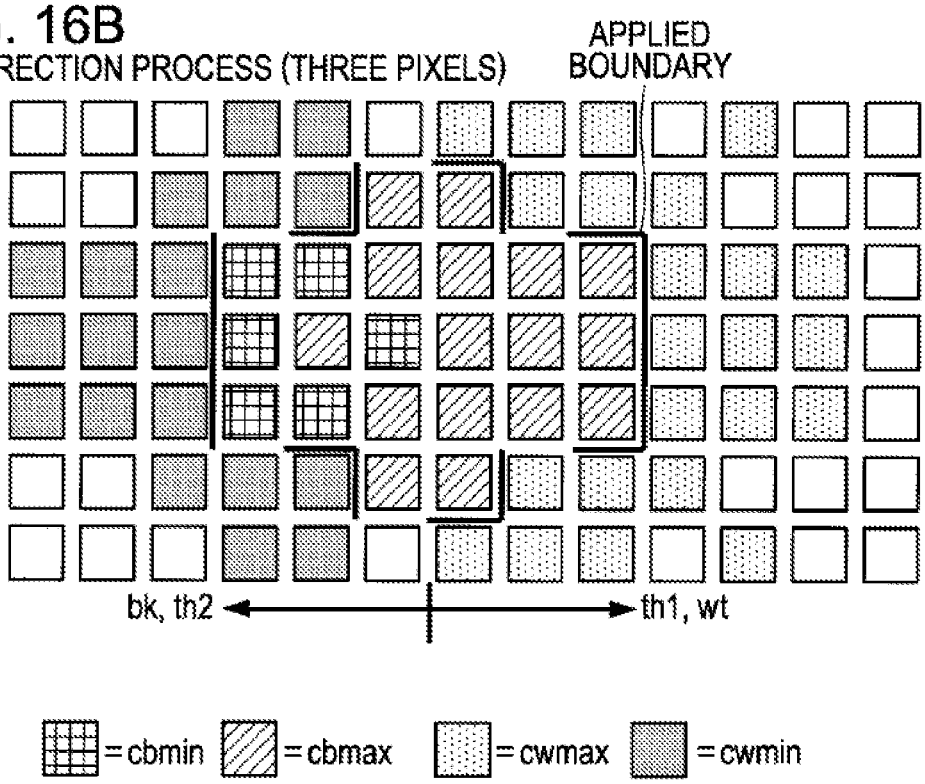

In addition, in the third embodiment as well, the video processing circuit 30 may set a correction level of a dark pixel on the basis of grayscale levels of a plurality of bright pixels (here, four bright pixels) which are continuously located in an opposite direction to an applied boundary from a bright pixel adjacent to the applied boundary, and may set a correction level on the basis of grayscale levels of a plurality of bright pixels (here, four bright pixels) which are continuously located in an opposite direction to an applied boundary from a bright pixel adjacent to the applied boundary. An operation of the video processing circuit 30 in this case is the same as described in Modification Example 2 of the first embodiment and Modification Example 2 of the second embodiment. In addition, the video processing circuit 30 may set two or more bright pixels (here, three) which are continuously located in an opposite direction to an applied boundary from a bright pixel adjacent to the applied boundary as a correction target, and may set two or more dark pixels (here, three) which are continuously located in an opposite direction to an applied boundary from a dark pixel adjacent to the applied boundary as a correction target (refer to FIG. 16B).

Fourth Embodiment

Next, the fourth embodiment of the invention will be described. In the following embodiment, both a bright pixel and a dark pixel are set as a correction target as in the above-described third embodiment, but only a bright pixel may be set as a correction target, or only a dark pixel may be set as a correction target.

The present embodiment is different from the first embodiment in that the video processing circuit 30 further narrows a correction target pixel in consideration of a tilt azimuth and a tilt angle of the liquid crystal molecules. First, a description will be made of grounds for taking into consideration a tilt azimuth and a tilt angle of the liquid crystal molecules.

As described above, it can be said that a pixel in which the liquid crystal molecules are unstable before a variation lies in circumstances in which a reverse tilt domain is likely to occur due to influence of a transverse electric field when a dark pixel and a bright pixel become adjacent to each other through movement of an image. However, if an examination is performed in consideration of an initial alignment state of the liquid crystal molecules, a reverse tilt domain may occur and may not occur depending on a positional relationship between a dark pixel and a bright pixel.

Figure 17A:
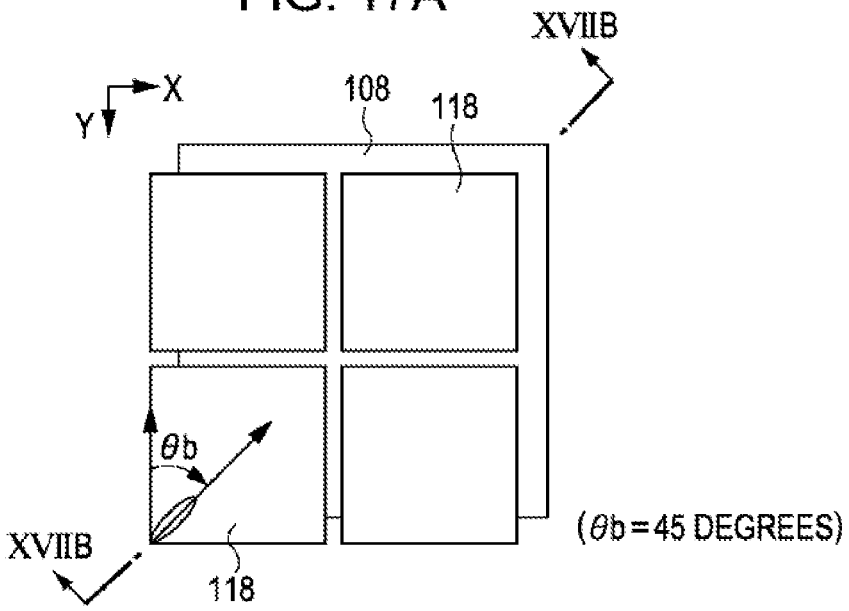
FIGS. 17A to 17C are diagrams illustrating an initial alignment when the same liquid crystal panel is of a VA type.
Figure 17B:
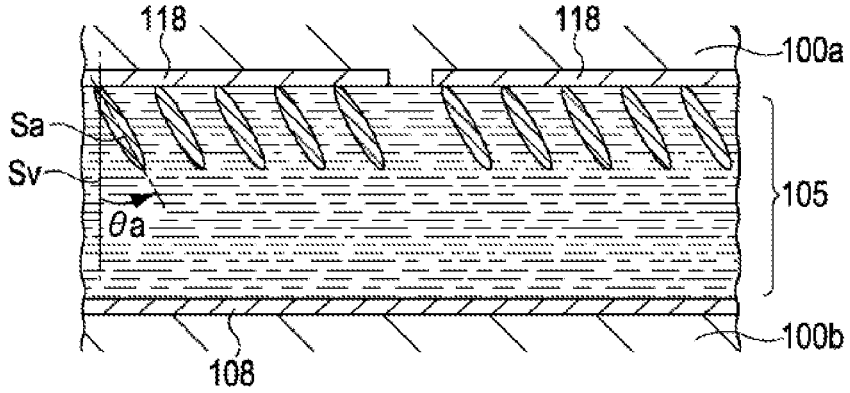

FIG. 17A is a diagram illustrating 2×2 pixels which are adjacent to each other in the longitudinal direction and transverse direction in the liquid crystal panel 100, and FIG. 17B is a simple cross-sectional view taken along the line XVIIB-XVIIB in the liquid crystal panel 100 of FIG. 17A.

Figure 17C:
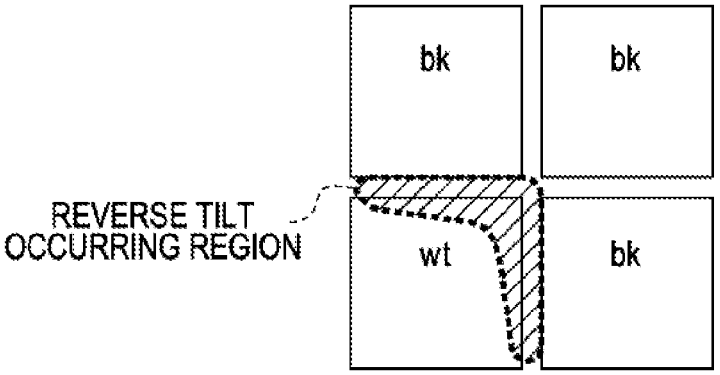

As shown in FIGS. 17A to 17C, the VA type liquid crystal molecules are initially aligned at a tilt angle θa and a tilt azimuth θb (=45 degrees) in a state in which a potential difference (an applied voltage to the liquid crystal element) between the pixel electrode 118 and the common electrode 108 is zero. Here, since a reverse tilt domain is caused by a transverse electric field between the pixel electrodes 118 as described above, behaviors of the liquid crystal molecules on the element substrate 100*a* side in which the pixel electrodes 118 are provided are problematic. For this reason, the tilt azimuth and the tilt angle of the liquid crystal molecules are regulated using the pixel electrode 118 (the element substrate 100*a*) side as a reference.

Specifically, the tilt angle θa is an angle formed by the major axis Sa of the liquid crystal molecule with respect to the substrate normal line Sv when one end on the pixel electrode 118 side is fixed and the other end on the common electrode 108 side is tilted in the major axis Sa of the liquid crystal molecule as shown in FIG. 17B.

Meanwhile, the tilt azimuth θb is an angle formed by a substrate vertical plane (a vertical plane including the line XVIIB-XVIIB) including the major axis Sa of the liquid crystal molecule and the substrate normal line Sv with respect to a substrate vertical plane in the Y direction which is an arrangement direction of the data lines 114. In addition, in relation to the tilt azimuth θb, in plan view from the pixel electrode 118 side to the common electrode 108, an angle in a direction (an upper right direction in FIG. 17A) toward the other end starting from one end of the major axis of the liquid crystal molecule from a screen upward direction (an opposite direction to the Y direction) is regulated as a clockwise direction.

In addition, similarly, in plan view from the pixel electrode 118 side, for convenience, a direction from one end on the pixel electrode side to the other end in the liquid crystal molecule is referred to as a downstream side of the tilt azimuth, and, for convenience, an opposite direction (a lower left direction in FIG. 17A) from the other end to one end is referred to as an upstream side of the tilt azimuth.

As disclosed in JP-A-2011-107174, in a case where a tilt azimuth θb is 45 degrees as shown in FIG. 17A in the VA type (normally black mode) liquid crystal, when only a self pixel varies to a bright pixel in a state in which the liquid crystal molecules are unstable in the self pixel and peripheral pixels, reverse tilt in the self pixel occurs in an inner circumferential region along the left side and the upper side as shown in FIG. 17C. Therefore, when attention is paid to a certain n-th frame, it can be said that a subsequent pixel is influenced by a reverse tilt domain in the n-th frame if the following conditions are satisfied.

That is, reverse tilt occurs in a bright pixel in the n-th frame, (1) in a case where, when attention is paid to the n-th frame, a dark pixel and a bright pixel are adjacent to each other, that is, a pixel to which an applied voltage is low and a pixel to which an applied voltage is high are adjacent to each other and thus a transverse electric field is strengthened, (2) in a case where, in the n-th frame, the bright pixel (an applied voltage thereto is high) is located on the lower left side, the left side or the lower side corresponding to the upstream side of the tilt azimuth of the liquid crystal molecules with respect to the adjacent dark pixel (an applied voltage thereto is low), and (3) when the liquid crystal molecules of a pixel which varies to the bright pixel in the n-th frame have been unstable in the (n−1)-th frame one frame before.

As described above, in (2), when a boundary indicating a part where the dark pixel and the bright pixel are adjacent to each other moves by one pixel from a previous frame, it is considered that a reverse tilt domain more easily exerts an influence.

Figure 18:
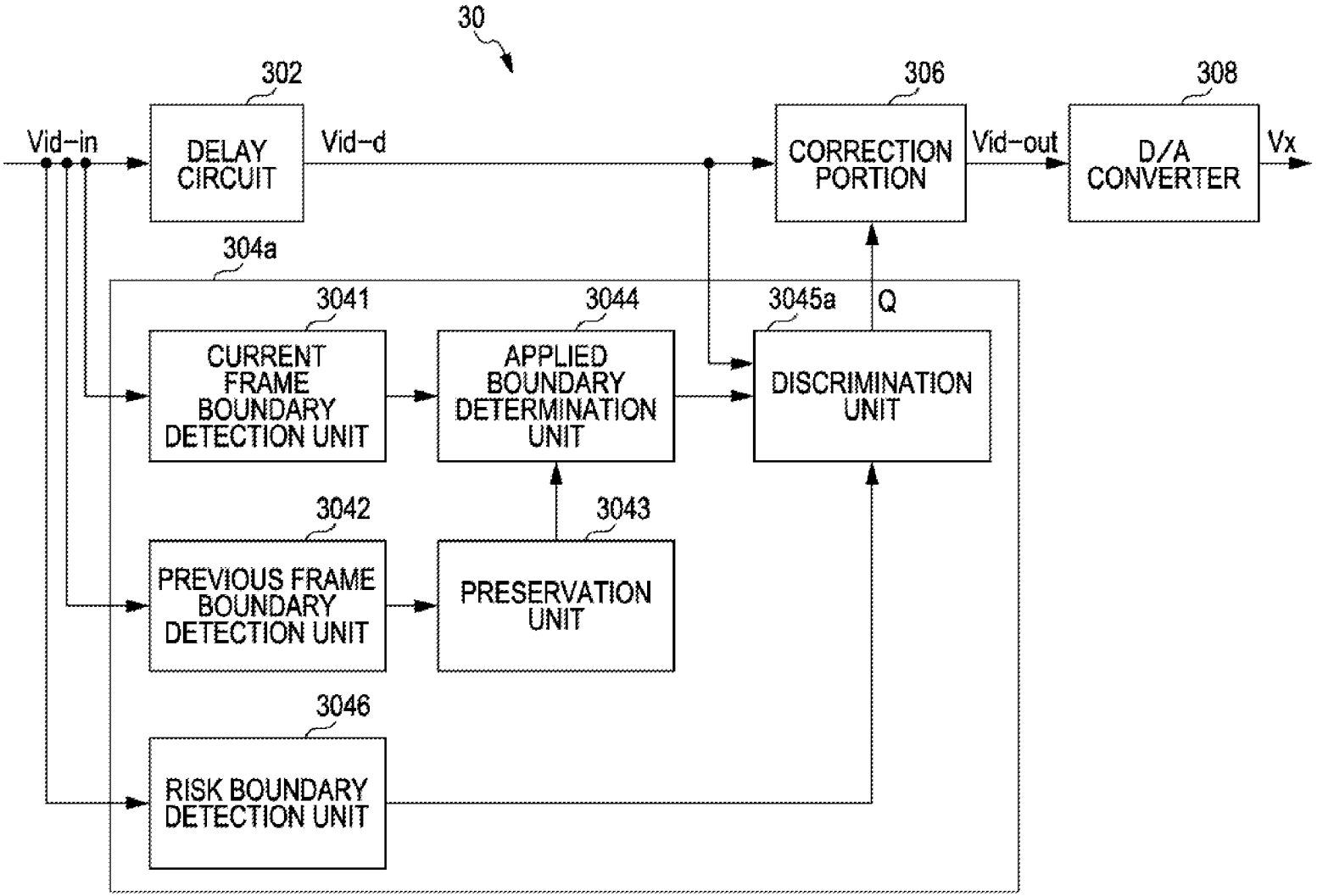
FIG. 18 is a diagram illustrating a configuration of a video processing circuit according to a fourth embodiment.

The video processing circuit 30 in FIG. 18 is a circuit for preventing occurrence of the reverse tilt domain in the liquid crystal panel 100 in advance by processing a video signal Vid-in of a current frame based on this concept.

Next, details of the video processing circuit 30 will be described with reference to FIG. 18. As shown in FIG. 18, the video processing circuit 30 includes a delay circuit 302, a boundary detection portion 304*a*, a correction portion 306, and a D/A converter 308. Among them, the delay circuit 302 and the D/A converter 308 realize functions equivalent to the configurations of the above-described first embodiment.

The boundary detection portion 304*a* includes a risk boundary detection unit 3046 in addition to the configuration of the boundary detection portion 304 of the first embodiment, and includes a discrimination unit 3045*a* instead of the discrimination unit 3045. The risk boundary detection unit 3046 analyzes an image represented by a video signal Vid-in of a current frame and discriminates whether or not there is a part where a dark pixel in the grayscale range a and a bright pixel in the grayscale range b are adjacent to each other in the vertical direction or horizontal direction. In addition, when it is discriminated that there is an adjacent part, the risk boundary detection unit 3046 detects a boundary which is the adjacent part and outputs position information of the boundary. In this way, the risk boundary detection unit 3046 detects a risk boundary which is a part of the boundary between the dark pixel and the bright pixel and is defined by a tilt azimuth of the liquid crystal 105 (first boundary detection unit).

The discrimination unit 3045*a* specifies a correction target pixel from pixels which are represented by the delayed and output video signals Vid-d and are adjacent to a boundary which is a risk boundary detected by the risk boundary detection unit 3046 and is an applied boundary determined by the applied boundary determination unit 3044. That is, the discrimination unit 3045*a* is operated in the same manner as in the above-described third embodiment except that the discrimination unit 3045*a* specifies a correction target pixel based on a boundary which is a risk boundary and is also an applied boundary.

The correction portion 306 is operated depending on a flag Q supplied from the discrimination unit 3045*a* in the same manner as in the above-described third embodiment.

A specific example of a correction process by the video processing circuit 30 will be described.

Figure 19A:
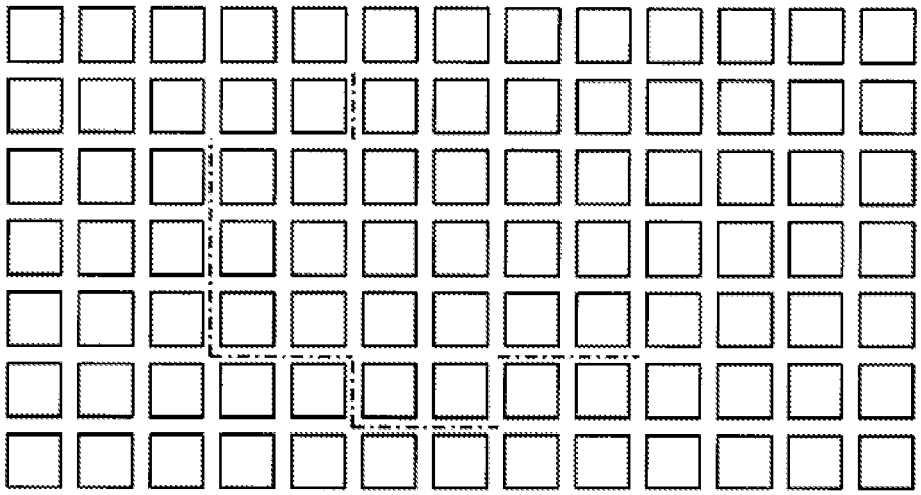
FIGS. 19A and 19B are diagrams illustrating boundary detection procedures in the same video processing circuit.
Figure 19B:
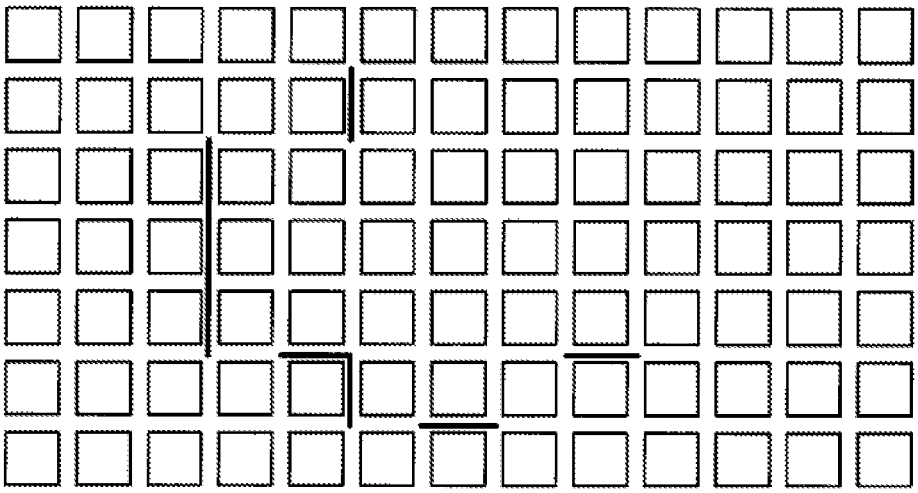

Here, in a case where an image represented by the video signal Vid-in of a previous frame is, for example, as shown in FIG. 7A, and an image represented by the video signal Vid-in of a current frame is, for example, as shown in FIG. 7B, an applied boundary by the applied boundary determination unit 3044 is as shown in FIG. 8A as described above. On the other hand, a risk boundary which is detected from the video signal Vid-in of the current frame by the risk boundary detection unit 3046 is as shown in FIG. 19A if a tilt azimuth θb is 45 degrees. Therefore, if a tilt azimuth θb is 45 degrees, a boundary which is a risk boundary is also an applied boundary is as shown in FIG. 19B in the video signal Vid-in of the current frame.

Figure 20:
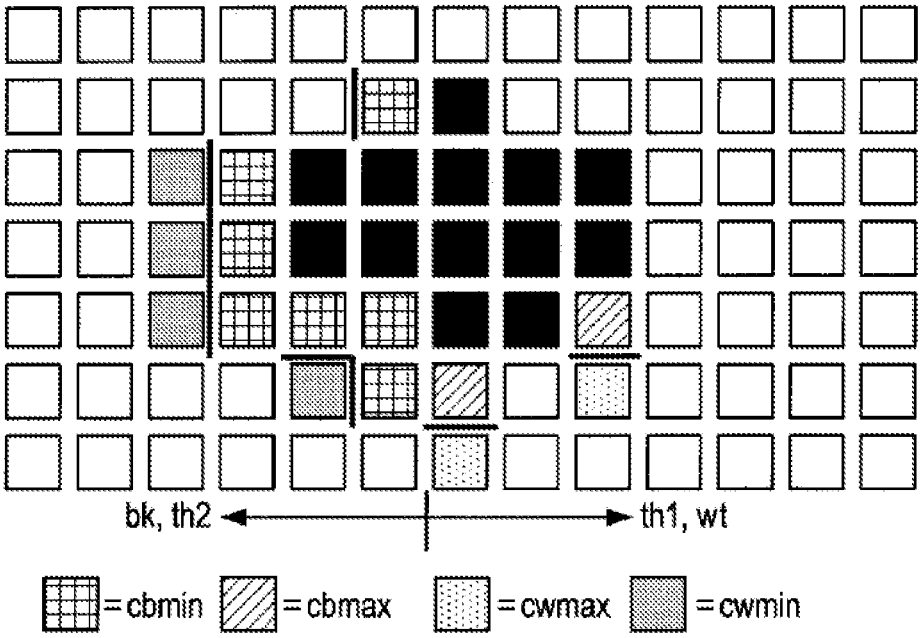
FIG. 20 is a diagram illustrating a correction process in the same video processing circuit.

The correction portion 306 sets a dark pixel and a bright pixel adjacent to the boundary which is a risk boundary and is also an applied boundary as correction target pixels, and corrects video signals of the correction target pixels as shown in FIG. 20. As can be seen from FIG. 20, the video processing circuit 30 defines correction target pixels using a dark pixel and a bright pixel adjacent to a boundary which is a risk boundary and is also an applied boundary, and thus correction target pixels are smaller than in a case of defining correction target pixels without taking a risk boundary into consideration as in the third embodiment.

Figure 25A:
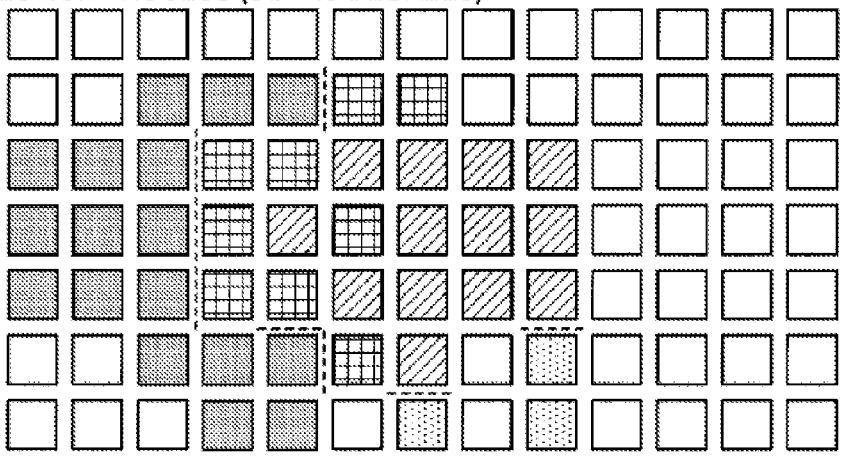
FIGS. 25A to 25C are diagrams illustrating a correction process in the same modification example.

In addition, in the same manner as in Modification Example 1 of the first embodiment or Modification Example 1 of the second embodiment, the correction portion 306 may set two or more dark pixels (here, three) which are continuously located in an opposite direction to an applied boundary from a dark pixel adjacent to the applied boundary as a correction target, and may set two or more bright pixels (here, three) which are continuously located in an opposite direction to an applied boundary from a bright pixel adjacent to the applied boundary as a correction target (refer to FIG. 25A).

Since, in the fourth embodiment, the video processing circuit 30 sets a pixel adjacent to a boundary which is a risk boundary and is also an applied boundary as a correction target, it is possible to narrow pixels in which a reverse tilt domain is likely to occur so as to reduce the number of corrected pixels, and to suppress occurrence of display defects due to the reverse tilt domain as compared with the third embodiment. In addition, according to the fourth embodiment, an effect equivalent to the above-described third embodiment can be achieved.

Modification Examples of Fourth Embodiment

Modification Example 1 of Fourth Embodiment

Although, in the fourth embodiment, a case where a tilt azimuth θb is 45 degrees in the VA type has been described as an example, the number of corrected pixels can be further reduced than in the first embodiment even if other tilt azimuths θb are used as disclosed in JP-A-2011-107174. An example in which the tilt azimuth θb is 225 degrees will be described.

Figure 21A:
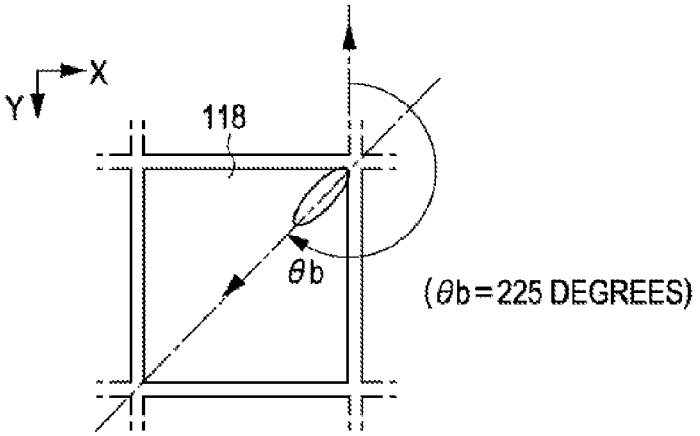
FIGS. 21A and 21B are diagrams illustrating that another azimuth is used in the liquid crystal panel.
Figure 21B:
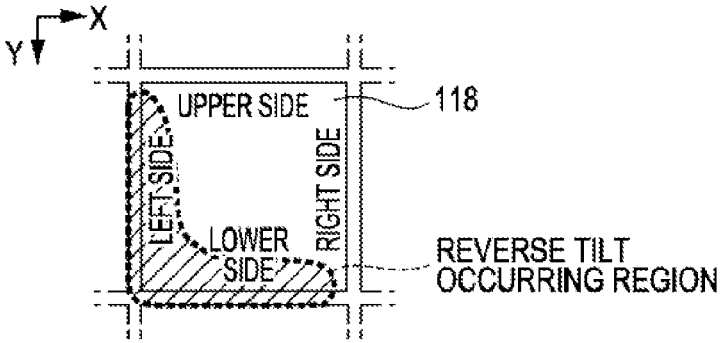

First, as shown in FIG. 21A, when only a self pixel varies to a bright pixel in a state in which the liquid crystal molecules are unstable in the self pixel and peripheral pixels, reverse tilt in the self pixel occurs in an inner circumferential region along the left side and the lower side as shown in FIG. 21B. Further, this example is equivalent to a case where rotation is performed by 180 degrees in the example, shown in FIGS. 17A to 17C, in which the tilt azimuth θb is 45 degrees.

In a case where the tilt azimuth θb is 225 degrees, among the conditions (1) to (3) in which a reverse tilt domain occurs in a case where the tilt azimuth θb is 45 degrees, the condition (2) is modified as follows. That is, the condition is modified to (2) in a case where, in the n-th frame, the bright pixel (an applied voltage thereto is high) is located on the upper right side, the right side or the upper side corresponding to the upstream side of the tilt azimuth of the liquid crystal molecules with respect to the adjacent dark pixel (an applied voltage thereto is low). In addition, the conditions (1) and (3) are not changed.

Therefore, if the tilt azimuth θb is 225 degrees, in a case where a dark pixel and a bright pixel are adjacent to each other in the n-th frame, and the dark pixel is conversely located on the lower left side, the left side or the lower side with respect to the bright pixel, a measure is preferably taken about the liquid crystal element corresponding to the dark pixel such that the liquid crystal molecules do not become unstable.

For this reason, the correction portion 306 of the video processing circuit 30 may correct a video signal based on a risk boundary between a part where a dark pixel is located on the lower side and a bright pixel is located on the upper side and a part where a dark pixel is located on the left side and a bright pixel is located on the right side among boundaries which vary from a previous frame to a current frame.

Figure 23A:
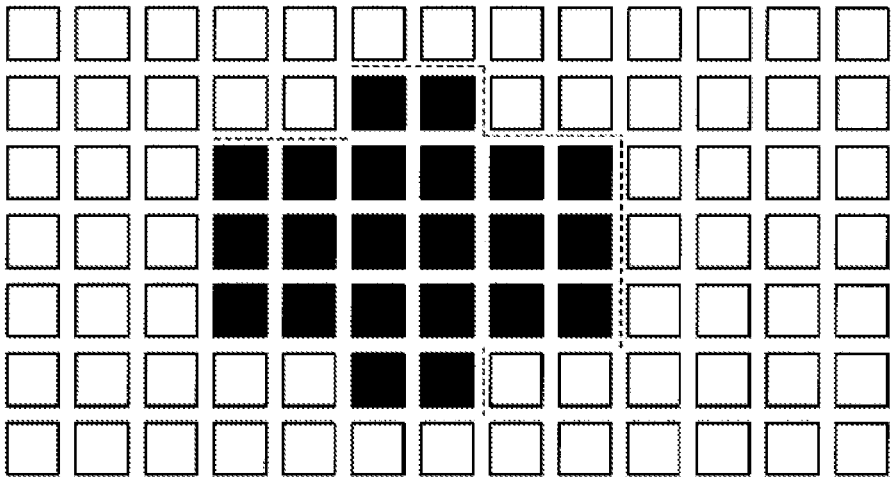
FIGS. 23A and 23B are diagrams illustrating detection procedures of a boundary in a modification example of the same video processing circuit.
Figure 24A:
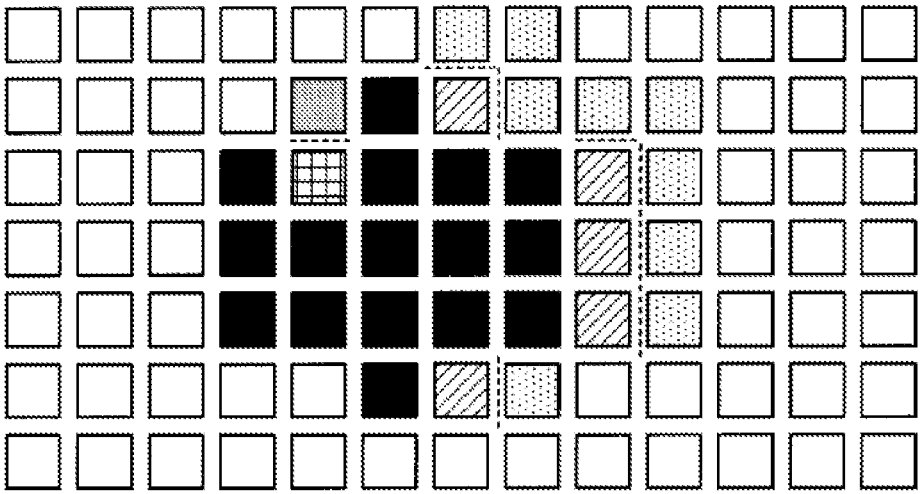
FIGS. 24A and 24B are diagrams illustrating a correction process in the same modification example.

Therefore, in a case where the tilt azimuth θb is 225 degrees, a risk boundary is detected as shown in FIG. 23A in an image varying from FIG. 7A to FIG. 7B. In addition, a correction target pixel is defined using a dark pixel adjacent to a boundary which is a risk boundary and is also an applied boundary, and the image is corrected to an image shown in FIG. 24A.

Modification Example 2 of Fourth Embodiment

Figure 22A:
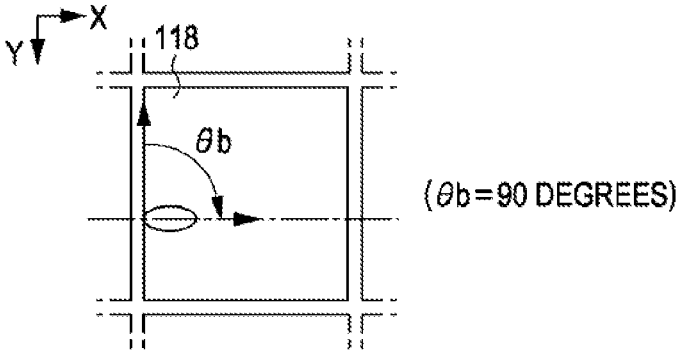
FIGS. 22A and 22B are diagrams illustrating that another azimuth is used in the liquid crystal panel.
Figure 22B:
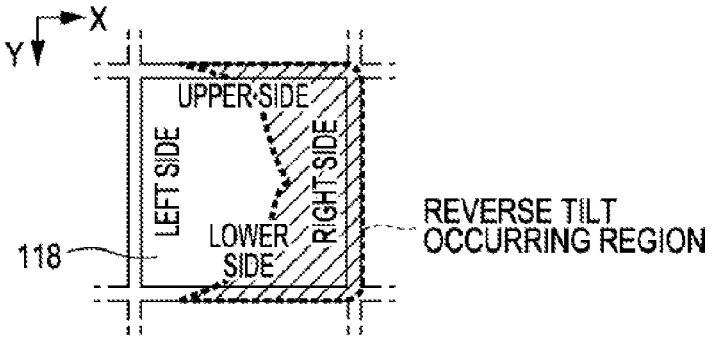

A description will be made of an example in which the tilt azimuth θb is 90 degrees as shown in FIG. 22A. In this example, when only a self pixel varies to a bright pixel in a state in which the liquid crystal molecules are unstable in the self pixel and peripheral pixels, reverse tilt in the self pixel intensively occurs in a region along the right side as shown in FIG. 22B. For this reason, it can be said that the reverse tilt domain also occurs in the rightish side of the upper side and in the rightish side of the lower side by a width with which the reverse tilt domain occurs in the right side.

In a case where the tilt azimuth θb is 90 degrees, among the conditions (1) to (3) in which a reverse tilt domain occurs in a case where the tilt azimuth θb is 45 degrees, the condition (2) is modified as follows. That is, the condition is modified to (2) in a case where, in the n-th frame, the bright pixel (an applied voltage thereto is high) is not only located on not only the left side corresponding to the upstream side of the tilt azimuth of the liquid crystal molecules but is also located on the upper side or the lower side influenced by a region occurring in the left side, with respect to the adjacent dark pixel (an applied voltage thereto is low). In addition, the conditions (1) and (3) are not changed.

Therefore, if the tilt azimuth θb is 90 degrees, in a case where a dark pixel and a bright pixel are adjacent to each other in the n-th frame, and the dark pixel is conversely located on the right side, the lower side or the upper side with respect to the bright pixel, a measure is preferably taken about the liquid crystal element corresponding to the dark pixel such that the liquid crystal molecules do not become unstable.

For this reason, the correction portion 306 of the video processing circuit 30 may correct a video signal based on a risk boundary between a part where a dark pixel is located on the right side and a bright pixel is located on the left side, a part where a dark pixel is located on the upper side and a bright pixel is located on the lower side, and a part where a dark pixel is located on the lower side and a bright pixel is located on the upper side among boundaries which vary from a previous frame to a current frame.

Figure 23B:
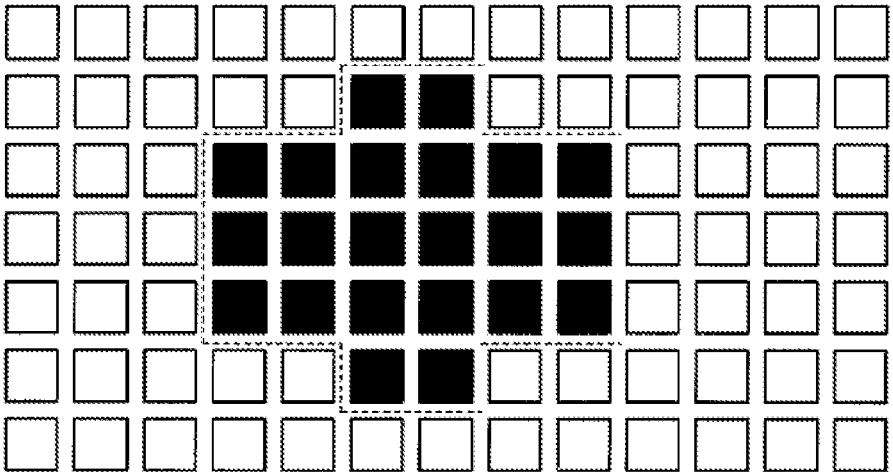
Figure 24B:
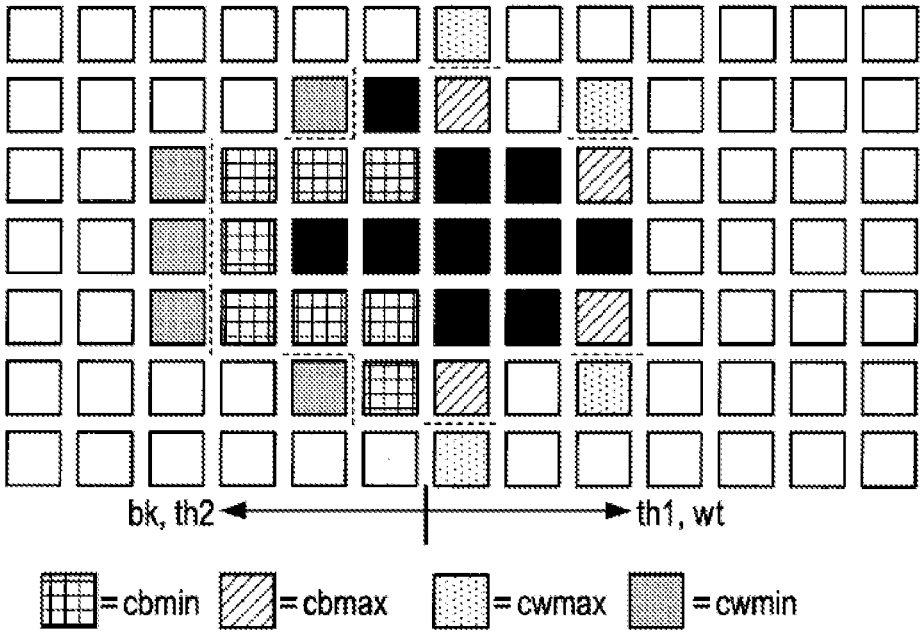

Therefore, in a case where the tilt azimuth θb is 90 degrees, a risk boundary is detected as shown in FIG. 23B in an image varying from FIG. 7A to FIG. 7B. In addition, a correction target pixel is defined using a dark pixel adjacent to a boundary which is a risk boundary and is also an applied boundary, and the image is corrected to an image shown in FIG. 24B.

Figure 25B:
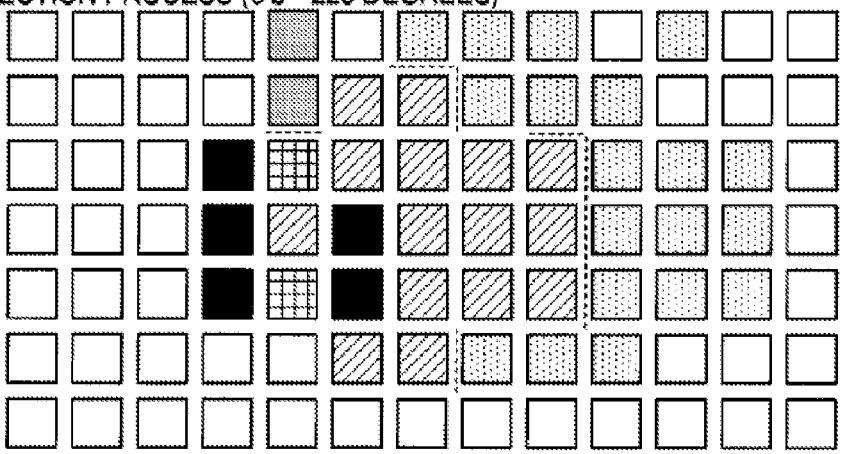
Figure 25C:
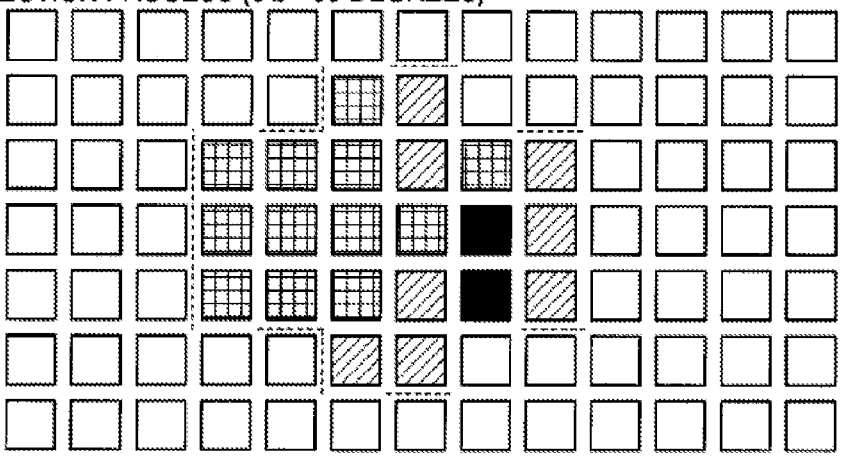

In addition, the correction portion 306 may set two or more dark pixels (here, three) which are continuously located in an opposite direction to an applied boundary from a dark pixel adjacent to the applied boundary as a correction target, and may set two or more bright pixels (here, three) which are continuously located in an opposite direction to an applied boundary from a bright pixel adjacent to the applied boundary as a correction target. FIG. 25B is a diagram exemplifying a case where the tilt azimuth θb is 225 degrees, and FIG. 25C is a diagram exemplifying a case where the tilt azimuth θb is 90 degrees.

Fifth Embodiment

Next, the fifth embodiment of the invention will be described.

In the following description, the same constituent elements as in the third embodiment are given the same reference numerals, and description thereof will be appropriately omitted.

The video processing circuit 30 of the present embodiment detects boundaries where a dark pixel and a bright pixel are adjacent to each other in a current frame, sets a dark pixel adjacent to a boundary which moves from a previous frame to the current frame by one pixel as a correction target pixel, and does not set the other pixels as correction target pixels. As described above in the first embodiment with respect to FIG. 35, when a region of dark pixels where bright pixels are background moves by two pixels for each frame, the tailing phenomenon does not become apparent (or is unlikely to be visually recognized). Therefore, if the video processing circuit 30 conditionally sets a pixel adjacent to the boundary which moves by one pixel as a correction target pixel, it is possible to further reduce the number of correction target pixels.

Therefore, in this embodiment, the applied boundary determination unit 3044 determines only a boundary which moves by one pixel as an applied boundary, and does not determine a boundary which does not move from a previous frame and a risk boundary which moves by two or more pixels as an applied boundary, from a detection result of boundaries by the current frame boundary detection unit 3041 and the previous frame boundary detection unit 3042. Functions realized by the other units of the video processing circuit 30 are the same as in the third embodiment.

Figures 26A, 26B, 26C:
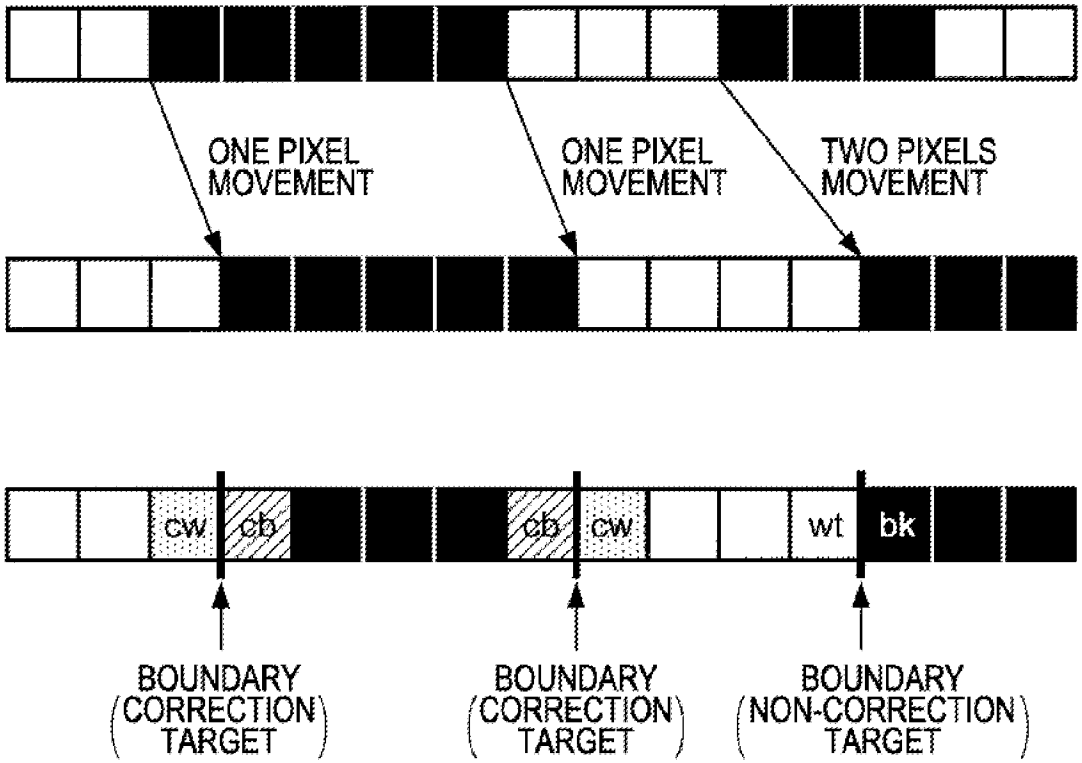
FIGS. 26A to 26C are diagrams illustrating a correction process in a video processing circuit according to a fifth embodiment of the invention.

FIGS. 26A to 26C are diagrams illustrating a correction process of the present embodiment.

As shown in FIGS. 26A to 26C, an image varies from an image shown in FIG. 26A to an image shown in FIG. 26B, and, among boundaries which vary as shown in FIGS. 26A and 26B from a previous frame to a current frame, only a dark pixel adjacent to a boundary which satisfies a movement condition of 1 pixel/frame is set as a correction target as shown in FIG. 26C, and, for example, if a boundary moves by two pixels, even a dark pixel adjacent to the boundary is not set as a correction target.

Thereby, the correction portion 306 can focus on and correct a location in which a reverse tilt domain is more likely to occur.

Modification Example of Fifth Embodiment

In the above-described fifth embodiment, in a case where both a dark pixel and a bright pixel adjacent to a boundary which moves by one pixel from a previous frame to a current frame have been bright pixels in a previous frame, the correction portion 306 may not correct a video signal corresponding to the dark pixel. It can be said that, if a pixel has been a bright pixel in a previous frame, even a dark pixel in a current frame does not reach a static transmittance. Since it is considered that this dark pixel does not enter a reverse tilt state in the current frame, the video processing circuit 30 excludes this dark pixel from correction target pixels, and thereby it is possible to further suppress occurrence of display contradiction.

Sixth Embodiment

Next, the sixth embodiment of the invention will be described.

If correction target pixels increase, there is concern that display contradiction due to the correction target pixels may be visible. Therefore, in the present embodiment, a correction target pixel is defined as follows in consideration of movement of an image.

Figure 27A:
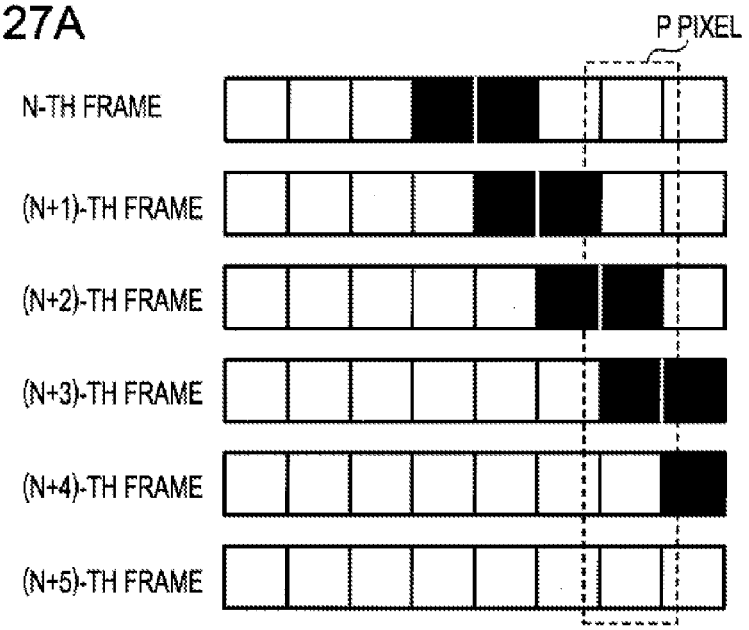
FIGS. 27A and 27B are diagrams illustrating a relationship between a movement of an image and a variation in a transmittance of a liquid crystal element.
Figure 27B:
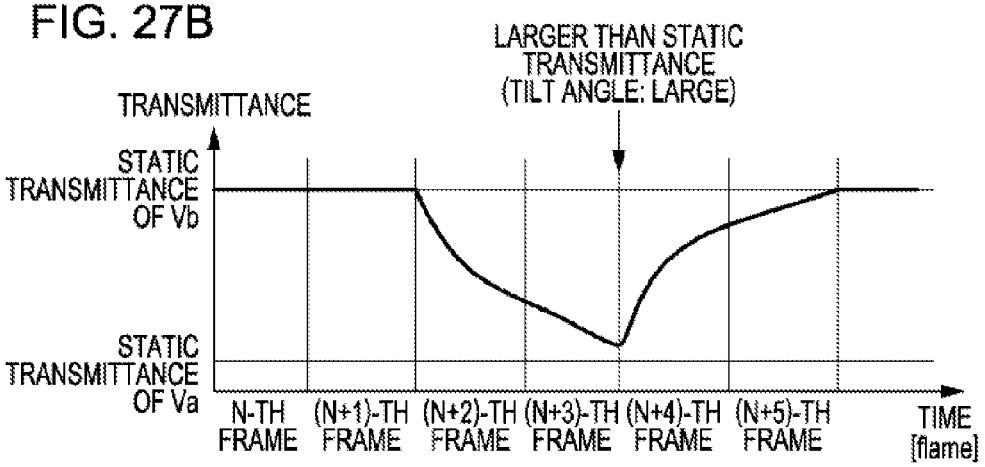
Figure 28A:
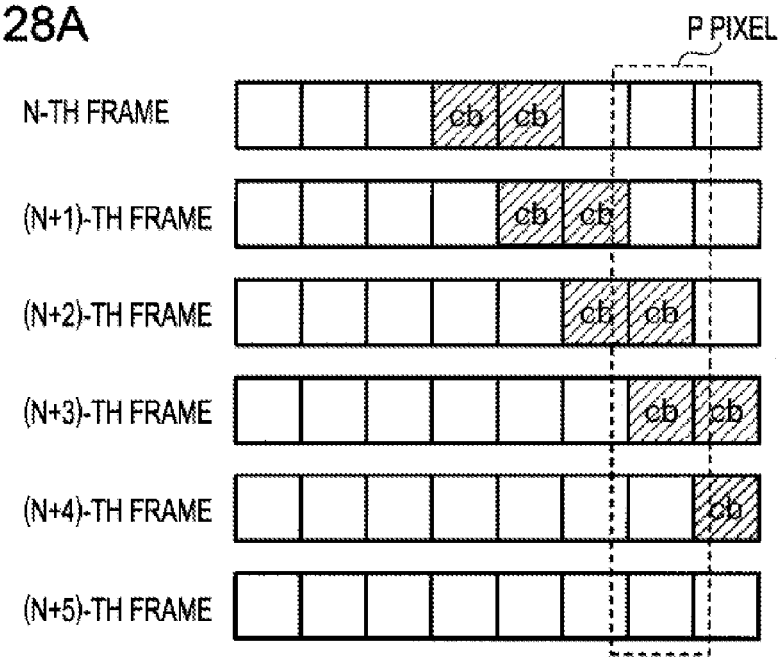
FIGS. 28A and 28B are diagrams illustrating a relationship between a movement of an image and a variation in a transmittance of a liquid crystal element.
Figure 28B:
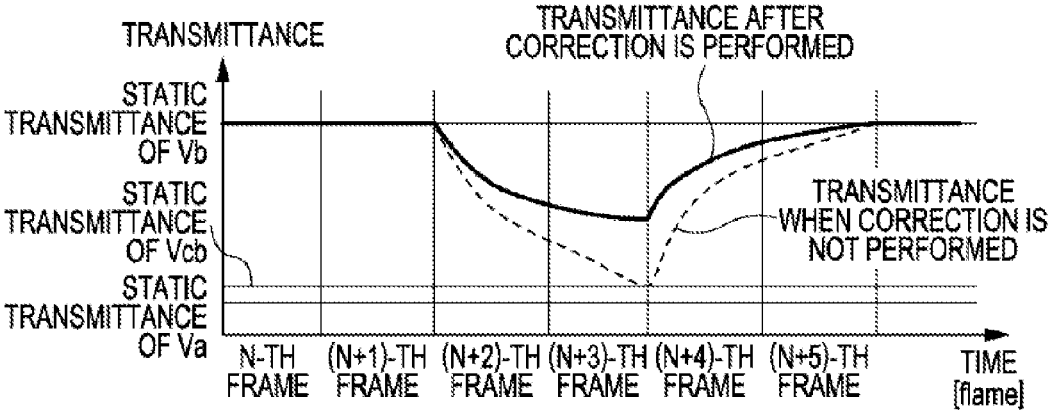
Figure 29A:
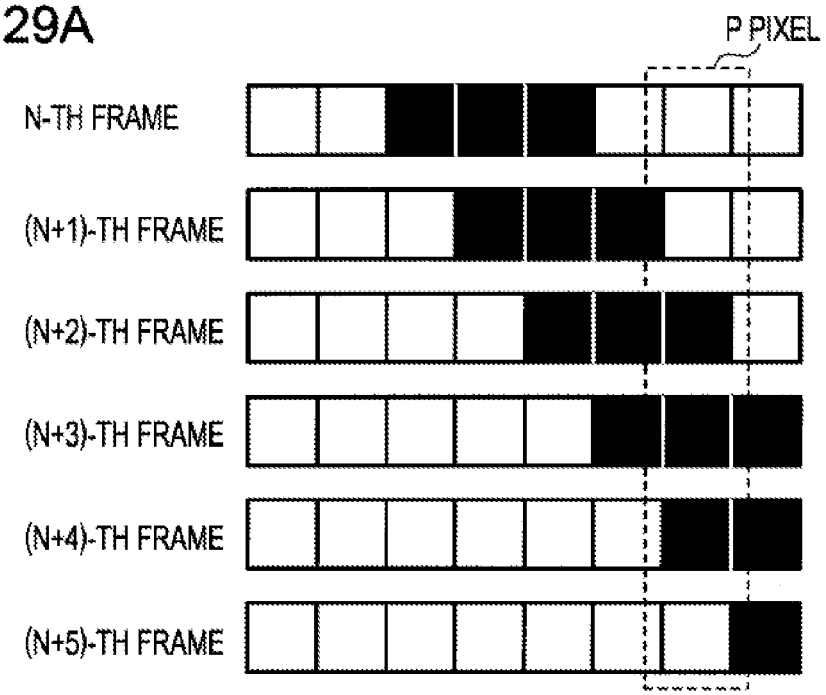
FIGS. 29A and 29B are diagrams illustrating a relationship between a movement of an image and a variation in a transmittance of a liquid crystal element.
Figure 29B:
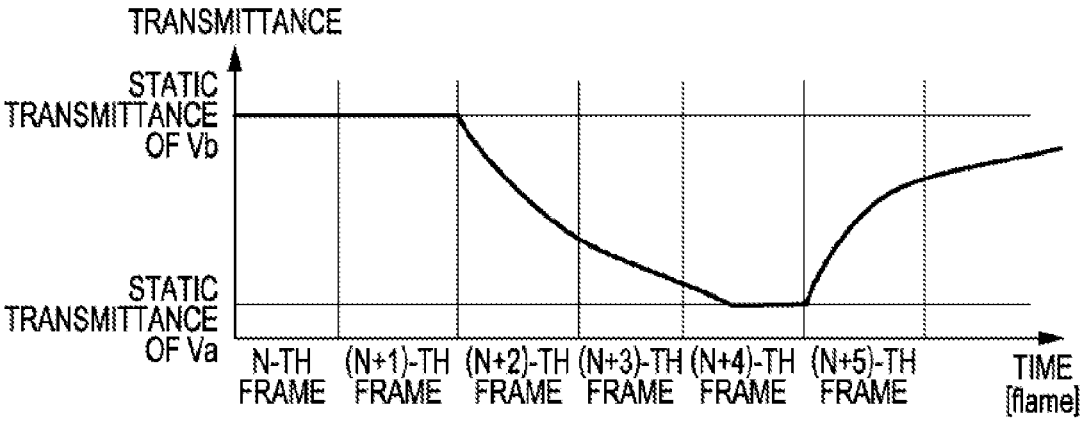

FIGS. 27A to 29B, FIGS. 27A, 28A and 29A are diagrams illustrating a state in which an image moves from the N-th frame to the (N+5)-th frame in pixels of the image of one line, and FIGS. 27B, 28B and 29B are graphs illustrating a time-series variation of a transmittance of a pixel P located at the second position from the right in FIGS. 27A, 28A and 29A.

As shown in FIG. 27A, a case is considered in which a display pattern (here, a pattern of dark pixels of continuous two pixels having white pixels as a background) in which the number of continuous dark pixels is small moves at 1 pixel/frame (one pixel moves per frame). In this case, when attention is paid to the pixel P, a voltage Va in the grayscale range a is applied thereto in the (N+2)-th and (N+3)-th frames, and a voltage Vb in the grayscale range b is applied thereto in frames before and after the (N+2)-th and (N+3)-th frames. If a response speed of the liquid crystal is disregarded, the pixel P reaches a transmittance indicated by "static transmittance of Va" in FIG. 27B in the (N+2)-th and (N+3)-th frames. However, practically, as shown in FIG. 27B, the transmittance at an end point of the (N+3)-th frame is higher than the static transmittance when the voltage Va is applied. This is because an application period of the voltage Va is shorter that the response speed of the liquid crystal element. At this time, since the tilt angle of the liquid crystal is in a state of being larger than the pretilt angle, a reverse tilt domain is unlikely to occur even if a strong transverse electric field is applied to the dark pixel. Based on this concept, such a dark pixel is excluded for correction target pixels for reducing a reverse tilt domain in the present embodiment.

In addition, as shown in FIG. 28A, in a case where an applied voltage to this dark pixel is corrected to the correction voltage Vcb, since a response to a variation from the voltage Vb to the correction voltage Vcb is later than a response to a variation from the voltage Vb to the voltage Va, the transmittance of the correction target pixel is higher than that of an uncorrected pixel in the (N+2)-th and (N+3)-th frames as shown in FIG. 28B. As a result, a grayscale difference between the background of the white pixels and the pattern of the dark pixels is reduced, and thus a contrast ratio (moving image contrast) in the image is lower than that of an original image.

For the above-described reasons, it can be said that, even in a dark pixel adjacent to a bright pixel, correction for reducing a reverse tilt domain is not preferably performed on a dark pixel to which an application period of the voltage Va finishes before reaching the static transmittance when the voltage is applied. Here, a time interval when a display screen of the liquid crystal panel 100 is updated is indicated by S (milliseconds), and a response time of the liquid crystal element 120 when an applied voltage varies from a voltage higher than the threshold value Vth2 to a voltage lower than the threshold value Vth1 is indicated by T (milliseconds). In this case, if the response time T is 2.5×S, and an application period of the voltage Va is 2S, the liquid crystal element 120 does not reach the static transmittance as shown in FIG. 27B. On the other hand, if an application period of the voltage Va lasts for 3S or more, the liquid crystal element 120 reaches the static transmittance as shown in the (N+4)-th frame of FIG. 29B. Therefore, correction for reducing a reverse tilt domain is required in a case where dark pixels to which the voltage Va is applied are continuous three or more pixels, in order to suppress display defects when an image moves at 1 pixel/frame at which display defects are likely to be visible. On the other hand, the correction for reducing a reverse tilt domain is not required in a case where dark pixels to which the voltage Va is applied are continuous two or less pixels. To generalize, if the number of continuous dark pixels to be corrected is indicated by R (where R is an integer equal to or more than 2), the correction of these dark pixels are required in a case where the number R of continuous dark pixels is equal to or more than a value which is obtained by adding 1 to a value of an integer part of a value obtained by dividing the response time T by the time interval S.

In addition, in relation to the response time T, for example, time until the liquid crystal element with a static transmittance when the voltage Vwt indicating the maximum grayscale of a bright pixel is applied reaches a static transmittance when a voltage (for example, the voltage Vbk indicating the minimum grayscale) lower than the threshold value Vth1 is applied may be examined in advance.

Figure 30A:
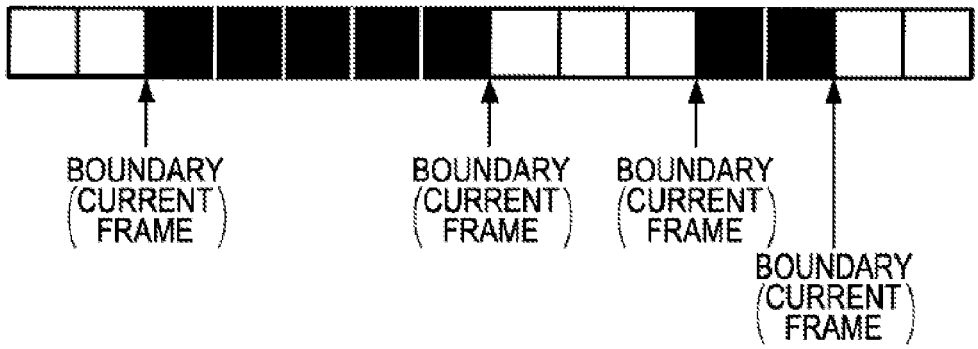
FIGS. 30A and 30B are diagrams illustrating a correction process in a video processing circuit according to a sixth embodiment of the invention.
Figure 30B:
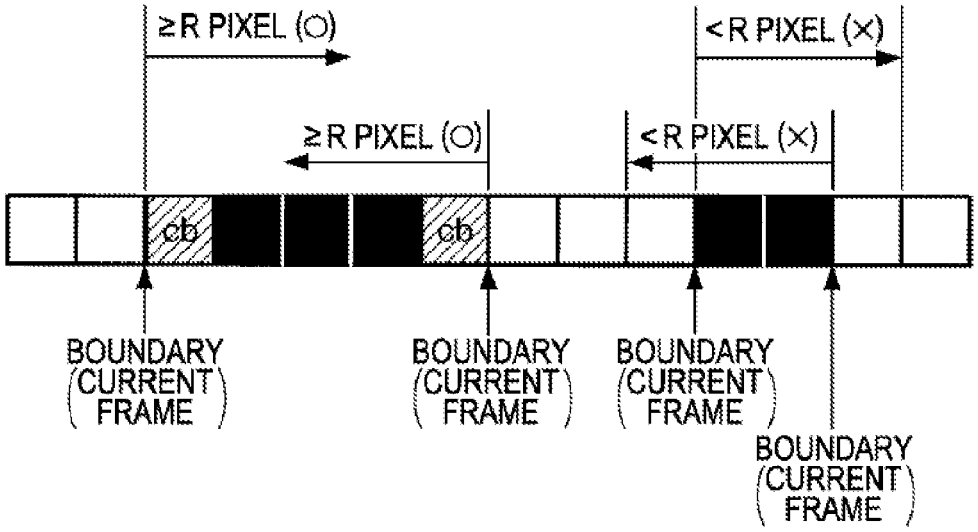

FIGS. 30A and 30B are diagrams illustrating an outline of a correction process by the video processing circuit 30 in a case where the response time T is 2.5×S.

In an image of one line as shown in FIG. 30A, pixels forming the image of one line are corrected as shown in FIG. 30B. Specifically, in a case where five dark pixels interposed between bright pixels from both sides are continuously arranged, since the number R (=5) of continuous dark pixels is equal to or more than a value (that is, 3) which is obtained by adding 1 to a value of an integer part of a value obtained by dividing the response time T by the time interval S, two dark pixels adjacent to the bright pixels are a correction target among the dark pixels and thus video signals thereof are corrected to video signals with a grayscale level cb. On the other hand, in a case where two dark pixels interposed between bright pixels from both sides are continuously arranged, since the number R (=2) of continuous dark pixels is less than a value (that is, 3) which is obtained by adding 1 to a value of an integer part of a value obtained by dividing the response time T by the time interval S, the dark pixels are not a correction target.

According to the above-described sixth embodiment, the video processing circuit 30 excludes, from correction target pixels, a dark pixel which does not arrive a static transmittance depending on the relationship between the response speed of the liquid crystal element and the update interval of the liquid crystal panel 100 when an image moves at 1 pixel/frame even in a dark pixel adjacent to an applied boundary. Thereby, the video processing circuit 30 can focus on and correct a dark pixel in which a reverse tilt domain is likely to occur in moving images, and thus can suppress occurrence of display contradiction such as reduction in moving image contrast due to correction of a video signal for reducing a reverse tilt domain.

Seventh Embodiment

Next, the seventh embodiment of the invention will be described.

Although, in the above-described respective embodiments, a correction target pixel is corrected to a video signal with the same grayscale during the entire one frame period, the video signal may be corrected such that a correction level during some period of one frame period is different from that during the other period thereof. Hereinafter, a description will be made of a case where the video processing circuit 30 realizes quadruple speed driving.

As shown in FIG. 31A, it is assumed that video signals Vid-in representing an image line in which a plurality of dark pixels with a grayscale level th1 and a plurality of bright pixels with a grayscale level th2 are arranged are supplied at supply speed of 60 Hz, and, the video signals Vid-in designate display of an image which scrolls and moves by one pixel from the left to the right of FIG. 31A with the progress of a first frame, a second frame, and a third frame. In this case, when video signals Vid-out are output without being corrected, there is a risk boundary at the same location during the entire one frame (that is, for 16.67 milliseconds) formed by first to fourth fields. If there is the risk boundary at the same position for a long time, a poor alignment state of the liquid crystal molecules tends to be fixed as described above, and thus a reverse tilt domain is likely to occur in an adjacent pixel.

Figure 32A:
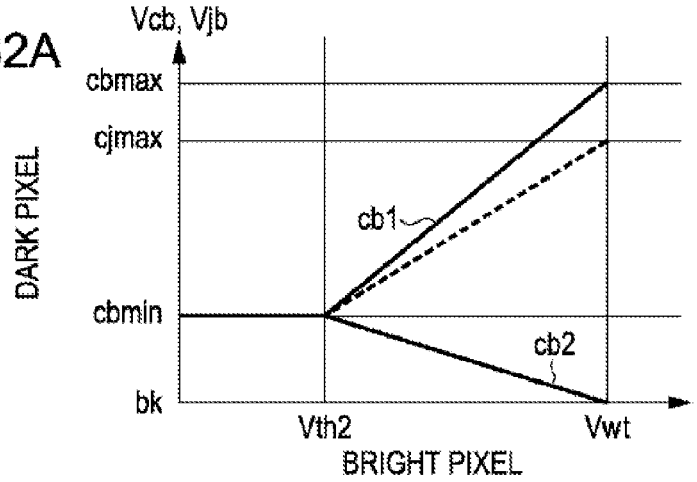
FIGS. 32A and 32B are graphs illustrating a relationship between a correction voltage and a judgment voltage of a liquid crystal element corresponding to a bright pixel and an applied voltage to a liquid crystal element corresponding to a dark pixel adjacent to the bright pixel according to the same embodiment.
Figure 32B:
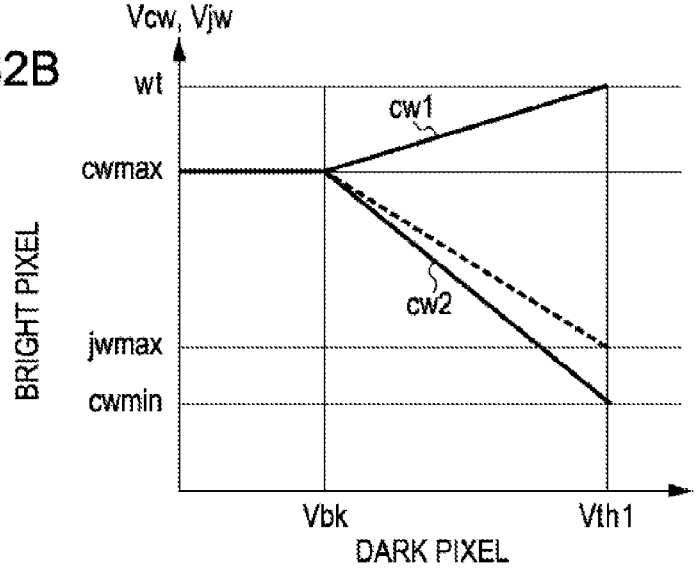

Therefore, the video processing circuit 30 performs a correction process using correction levels as shown in FIGS. 32A and 32B.

In a case where the flag Q of an output signal from the discrimination unit 3045 is "1", as shown in FIG. 32A, the correction portion 306 corrects a grayscale level of a dark pixel to a grayscale level cb1 so as to be increased in the first and third fields of one frame, and corrects the grayscale level of the dark pixel to a grayscale level cb2 so as to be decreased in the second and fourth fields of one frame. In addition, the correction portion 306 performs the correction such that the higher the grayscale level of a bright pixel adjacent to the dark pixel, the higher the grayscale level cb1, and, the lower the grayscale level of the bright pixel, the lower the grayscale level cb2. Here, the reason why the correction portion 306 performs the correction such that the higher the grayscale level of the bright pixel adjacent to the dark pixel, the higher the grayscale level cb1, is the same as in each embodiment described above. On the other hand, the reason why the correction portion 306 performs the correction such that the higher the grayscale level of the bright pixel adjacent to the dark pixel, the lower the grayscale level cb2, is that a variation in an integral value of a transmittance (an integral transmittance) is suppressed during one frame period. In this way, it is possible to suppress a transmittance variation due to correction of a video signal from being perceived by a user.

In addition, in a case where the flag Q of an output signal from the discrimination unit 3045 is "1", as shown in FIG. 32B, the correction portion 306 corrects a grayscale level of a bright pixel to a grayscale level cw1 so as to be increased in the first and third fields of one frame, and corrects the grayscale level of the bright pixel to a grayscale level cw2 so as to be decreased in the second and fourth fields of one frame. In addition, the correction portion 306 performs the correction such that, the higher the grayscale level of a dark pixel adjacent to the bright pixel, the higher the grayscale level cw1, and, the lower the grayscale level cw2. Here, the reason why the correction portion 306 performs the correction such that the higher the grayscale level of the bright pixel adjacent to the dark pixel, the higher the grayscale level cw1, is the same as in each embodiment described above. On the other hand, the reason why the correction portion 306 performs the correction such that the higher the grayscale level of the dark pixel adjacent to the bright pixel, the lower the grayscale level cw2, is that a variation in an integral value of a transmittance (an integral transmittance) is suppressed during one frame period. In this way, it is possible to suppress a transmittance variation due to correction of a video signal from being perceived by a user.

In addition, in the present embodiment, the dark pixel is corrected such that the grayscale level is increased in the first and third fields, and is corrected such that the grayscale level is decreased in the second and fourth fields. The bright pixel is corrected such that the grayscale level is increased in the first and third fields, and is corrected such that the grayscale level is decreased in the second and fourth fields. This is employed in order to prevent a transverse electric field from being temporarily strengthened when the bright pixel with the high grayscale level and the dark pixel with the low grayscale level are adjacent to each other. However, as long as there is no risk boundary at the same location during the entire one frame period, it does not matter that there are cases where the bright pixel with the high grayscale level and the dark pixel with the low grayscale level are adjacent to each other.

In addition, the video processing circuit 30 of the present embodiment is not limited to quadruple speed driving, and is applicable to a liquid crystal display apparatus employing speed driving such as, for example, double speed driving or eight times speed driving. Further, the video processing circuit 30 of the present embodiment is applicable to a liquid crystal display apparatus which does not employ the speed driving. For example, the video processing circuit may perform the above-described correction process by using at least some of display periods (for example, a plurality of frame periods) corresponding to video signals Vid-in of one scene as a correction period (for example, one frame period).

Modification Examples

Modification Example 1

Although the video processing circuit 30 varies both the correction level and the judgment level in the respective embodiments, the judgment level may be fixed.

Modification Example 2

Figure 33:
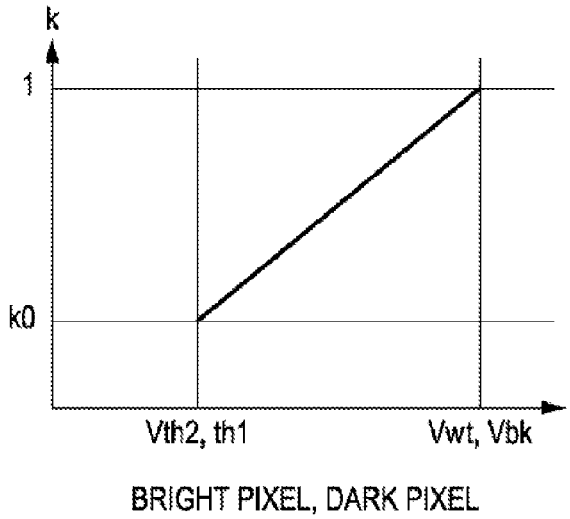
FIG. 33 is a diagram illustrating a correction process in a modification example.

Although the video processing circuit 30 sets a correction level according to the relationships shown in FIGS. 6A to 6C and 12A to 12C in the respective embodiments, a correction level may be set in the following method. For example, in a case where a dark pixel is corrected, the correction portion 306 sets, as a correction level cb, a value which is obtained by adding a grayscale level a of the dark pixel before being corrected to a value obtained by multiplying a difference between the maximum value cbmax of the correction level and the grayscale level a of the dark pixel before being corrected by a coefficient k. The coefficient k in this case satisfies, for example, a relationship shown in FIG. 33. In other words, as a grayscale level of a bright pixel adjacent to a dark pixel becomes higher, the coefficient k linearly increases from an initial value k0 and then becomes 1 at the grayscale level "wt" of the bright pixel. Similarly, in a case where a bright pixel is corrected, the video processing circuit 30 may set, as a correction level cw, a value which is obtained by subtracting, from a grayscale level b of the bright pixel before being corrected, a value obtained by multiplying a difference between the minimum value cbmin of the correction level and the grayscale level b of the bright pixel before being corrected by a coefficient k. The coefficient k in this case may also satisfy a relationship shown in FIG. 33. Therefore, the coefficient k in this case satisfies the relationship shown in FIG. 33, and, as a grayscale level of a dark pixel adjacent to a bright pixel becomes lower, the coefficient k linearly increases from an initial value k0 and then becomes 1 at the grayscale level "bk" of the bright pixel.

Modification Example 3

In the respective embodiments, the video processing circuit 30 detects a boundary which varies from a previous frame to a current frame, and defines a correction target pixel using a dark pixel adjacent to the detected boundary. The invention can be specified even if the video processing circuit 30 does not have constituent elements corresponding to the previous frame boundary detection unit 3042, the preservation unit 3043, and the applied boundary determination unit 3044. Even a configuration of this video processing circuit 30 can correct a video signal at a correction amount corresponding to the strength of a transverse electric field.

Modification Example 4

Although an example in which the liquid crystal 105 employs the VA type has been described in the respective embodiments, a TN type may be employed. The reason thereof is the same as disclosed in JP-A-2011-107174.

Modification Example 5

In a case of correcting a video signal of a dark pixel, the correction portion 306 may correct the video signal of the dark pixel to a video signal with a grayscale level corresponding to the brightness of an image of the display region 101. For example, the correction portion 306 acquires information indicating the brightness of the display region 101, and performs correction such that the higher (that is, the brighter) the level of the brightness defined by the acquired information, the higher the grayscale level of a video signal after being corrected. This is because, since a variation in a grayscale due to the correction is unlikely to be visible as the display region 101 is brighter, display contradiction is unlikely to be perceived by a user even if a grayscale level after being corrected increases in order to prioritize reduction in a reverse tilt domain. There is the brightness (for example, illuminance) of peripheral video display surroundings of the display region 101 as the information indicating the brightness of the display region 101. In this case, the correction portion 306 may acquire a detection result from an optical sensor provided in the liquid crystal display apparatus 1, and the correction portion 306 may determine a corrected grayscale level. In addition, the correction portion 306 may acquire a grayscale level of an input video signal as the information (for example, an average value of grayscale levels of input video signals of one frame) indicating the brightness. This is because, as an image of video signals with higher grayscale levels is displayed, the display region 101 also becomes brighter. Further, the correction portion 306 may acquire mode information for designating any one of a plurality of video display modes which regulate the brightness or contrast ratio of an image displayed in the display region 101. The correction portion 306 uses a correction amount corresponding to the luminance or contrast ratio defined by a video display mode. In this case, the correction portion 306 may perform correction to a video signal with a grayscale level corresponding to a display mode in a state of increasing a grayscale level in order of a so-called dynamic mode, a normal mode and a power saving mode.

In addition, the correction portion 306 may acquire a detection result from a temperature sensor which detects peripheral temperature of the liquid crystal display apparatus 1 or temperature inside the liquid crystal display apparatus 1, and may determine a grayscale level of a video signal after being corrected according to temperature indicated by the detection result. Generally, since the transmittance of the liquid crystal element increases as temperature becomes higher, the correction portion 306 may perform correction to a video signal with a grayscale corresponding to temperature so as to reduce temperature dependency of a transmittance.

In addition, in relation to a method of determining a video signal after being corrected (an applied voltage to the liquid crystal element 120), the correction portion 306 may have a configuration in which calculation is performed using an arithmetic expression or may have a configuration in which a lookup table is referred to.

Modification Example 6

Although the video signal Vid-in designates a grayscale level of a pixel in the respective embodiments, the video signal Vid-in may directly designate an applied voltage to the liquid crystal element. In a case where the video signal Vid-in designates an applied voltage to the liquid crystal element, a boundary may be discriminated using a designated applied voltage, and a voltage may be corrected.

In addition, in the respective embodiments, the liquid crystal element 120 is not limited to a transmissive type and may be of a reflective type.

Electronic Equipment

Figure 34:
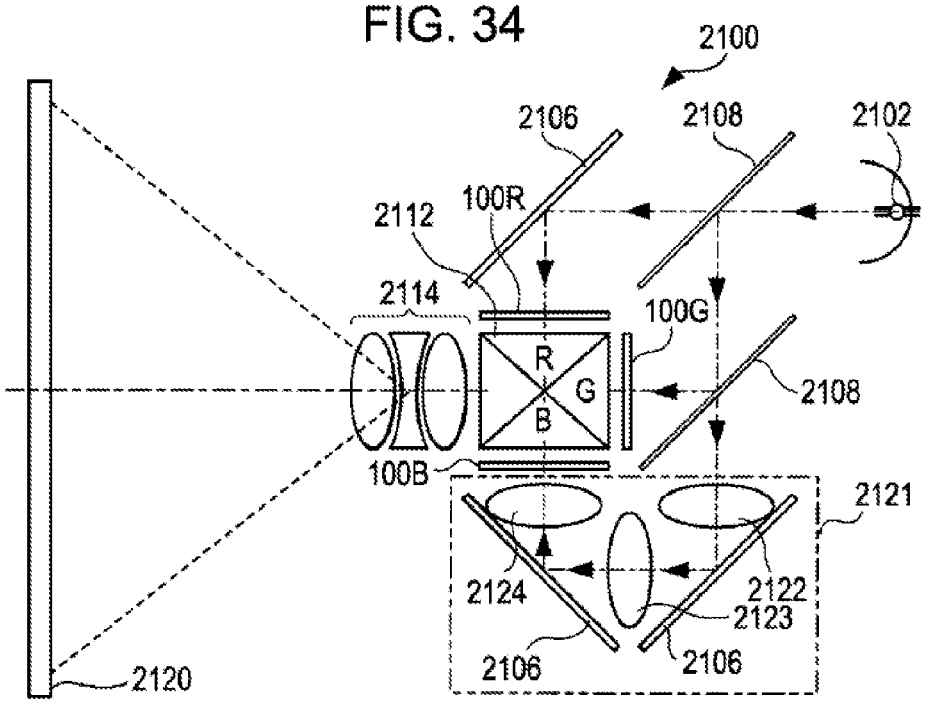
FIG. 34 is a diagram illustrating a projector which employs the liquid crystal display apparatus.

As an example of electronic equipment employing the liquid crystal display apparatus related to the above-described embodiments, projection type display equipment (projector) which uses the liquid crystal panel 100 as a light valve will be described. FIG. 34 is a plan view illustrating a configuration of the projector.

As shown in FIG. 34, a lamp unit 2102 including a white light source such as a halogen lamp or the like is provided in the projector 2100. Projection light emitted from the lamp unit 2102 is divided into three primary colors of red (R), green (G), and blue (B), by three mirrors 2106 and two dichroic mirrors 2108 disposed therein, and is guided to light valves 100R, 100G and 100B corresponding to the respective primary colors. The light of B has a longer light path than that of the R or the G, and is thus guided to a relay lens system 2121 including a light-incident lens 2122, a relay lens 2123, and a light-exciting lens 2124 in order to prevent losses thereof.

In this projector 2100, three liquid crystal display apparatuses including the liquid crystal panel 100 are provided so as to respectively correspond to R, G, and B. Each of the light valves 100R, 100G and 100B has the same configuration as the above-described liquid crystal panel 100. A video signal corresponding to each primary color of R, G and B is supplied from an external high rank device, and the light valves 100R, 100G and 100B are respectively driven.

Light beams respectively modulated by the light valves 100R, 100G and 100B are incident to a dichroic prism 2112 from three directions. In this dichroic prism 2112, the light beams of R and B are refracted by 90 degrees, whereas the light of G travels straight. Thereby, images of the respective primary colors are combined, and then a color image is projected on a screen 2120 by a projection lens 2114.

Since the light beams respectively corresponding to R, G and B are incident to the light valves 100R, 100G and 100B by the dichroic mirror 2108, color filters are not required. In addition, the transmitted images from the light valves 100R and 100B are projected after reflected by the dichroic prism 2112, whereas the transmitted image from the light valve 100G is projected as it is, and thus the horizontal scanning direction by the light valves 100R and 100B is made to be reverse to the horizontal scanning direction by the light valve 100G, so as to display bilaterally inverted images.

As the electronic equipment, in addition to the projector described referring to FIG. 35, there are, for example, a television set, a view finder type/monitor direct view type video tape recorder, car navigation equipment, a pager, an electronic diary, an electronic calculator, a word processor, a workstation, a television-phone, a POS terminal, a digital still camera, a mobile phone, and equipment having a touch panel, and the like. Needless to say, the above-described liquid crystal display apparatus is applicable to the variety of electronic equipment.

This application claims priority to Japan Patent Application No. 2012-058983 filed Mar. 15, 2012, the entire disclosures of which are hereby incorporated by reference in their entireties.

What is claimed is:

1. A signal processing device which is used in a liquid crystal apparatus including a plurality of pixels, comprising:

a detection portion that detects a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; and a correction portion that corrects the first signal correlated with the first pixel to a third signal for applying a third voltage which is higher than the first voltage and lower than the second voltage, wherein the second reference voltage is higher than the first reference voltage, and wherein the third voltage is a different value when the second voltage is high and when the second voltage is low.

2. The signal processing device according to claim 1, wherein the third voltage is higher when the second voltage is high than when the second voltage is low.

3. The signal processing device according to claim 1, wherein the correction portion corrects the first signal correlated with the first pixel to the third signal for applying the third voltage when the first voltage is lower than a third reference voltage which is lower than the first reference voltage.

4. The signal processing device according to claim 3, wherein the third reference voltage is higher when the second voltage is high than when the second voltage is low.

5. The signal processing device according to claim 1, wherein the correction portion corrects a signal correlated with a third pixel adjacent to the first pixel in the same manner as in the first pixel, and wherein the first pixel is disposed between the third pixel and the second pixel.

6. The signal processing device according to claim 1, wherein the correction portion corrects the second signal correlated with the second pixel to a fourth signal for applying a fourth voltage which is lower than the second voltage and higher than the third voltage, and wherein the fourth voltage is higher when the first voltage is high than when the first voltage is low.

7. The signal processing device according to claim 1, wherein the second voltage correlated with the second pixel is corrected to the fourth voltage when the second voltage is higher than a fourth reference voltage which is higher than the second reference voltage.

8. The signal processing device according to claim 1, wherein the correction portion corrects a signal correlated with a fourth pixel adjacent to the second pixel in the same manner as in the second pixel, and wherein the second pixel is disposed between the first pixel and the fourth pixel.

9. A liquid crystal apparatus comprising the signal processing device according to claim 1.

10. Electronic equipment comprising the liquid crystal apparatus according to claim 9.

11. A signal processing device which is used in a liquid crystal apparatus including a plurality of pixels, comprising:

a detection portion that detects a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; and a correction portion that corrects the first signal correlated with the first pixel to a third signal for applying a third voltage which is higher than the first voltage and lower than the second voltage correlated with the second pixel, wherein the second reference voltage is higher than the first reference voltage, and wherein the third voltage is higher when a difference between the first voltage and the second voltage is large than when the difference is small.

12. The signal processing device according to claim 11, wherein the correction portion further corrects the second signal correlated with the second pixel to a fourth signal for applying a fourth voltage which is lower than the second voltage and higher than the first voltage correlated with the first pixel, and wherein the fourth voltage is lower when a difference between the first voltage and the second voltage is large than when the difference is small.

13. A liquid crystal apparatus comprising the signal processing device according to claim 11.

14. Electronic equipment comprising the liquid crystal apparatus according to claim 13.

15. A signal processing device which is used in a liquid crystal apparatus including a plurality of pixels, comprising:

a detection portion that detects a first pixel a first signal, correlated with a first pixel, for applying a first voltage lower than a first reference voltage, and a second signal, correlated with a second pixel, for applying a second voltage higher than a second reference voltage on the basis of a signal for controlling a voltage applied to each of the plurality of pixels; and a correction portion that corrects the first signal correlated with the first pixel to a third signal for applying a third voltage which is higher than the first voltage and lower than the second voltage correlated with the second pixel, wherein the second reference voltage is higher than the first reference voltage, and wherein the third voltage is higher when the second voltage is high than when the second voltage is low.

16. A liquid crystal apparatus comprising the signal processing device according to claim 15.

17. Electronic equipment comprising the liquid crystal apparatus according to claim 16.

18. A signal processing method of processing signals displayed in a liquid crystal apparatus including a plurality of pixels, comprising:

detecting a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; and correcting the first signal correlated with the first pixel to a third signal for applying a third voltage which is higher than the first voltage and lower than the second voltage correlated with the second pixel, wherein the second reference voltage is higher than the first reference voltage, and wherein the third voltage is higher when the second voltage is high than when the second voltage is low.

19. A signal processing device which is used in a liquid crystal apparatus including a plurality of pixels, comprising:

a detection portion that detects a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; and a correction portion that corrects the first signal correlated with the first pixel to a third signal for applying a third voltage which is higher than the first voltage and lower than the second voltage correlated with the second pixel, wherein the second reference voltage is higher than the first reference voltage, and wherein the third voltage is a voltage corresponding to the second voltage.

* * * * *